US011111071B2

(12) United States Patent
Dunn et al.

(10) Patent No.: US 11,111,071 B2
(45) Date of Patent: Sep. 7, 2021

(54) MIXING APPARATUS, METHOD OF MAKING THE MIXING APPARATUS AND USING THE MIXING APPARATUS

(71) Applicant: V1 Enterprises, LLC, Colorado Springs, CO (US)

(72) Inventors: Donald T. Dunn, Colorado Springs, CO (US); Chance E. Tanner, Colorado Springs, CO (US)

(73) Assignee: V1 Enterprises, LLC, Colorado Springs, CO (US)

( * ) Notice: Subject to any disclaimer, the term of this patent is extended or adjusted under 35 U.S.C. 154(b) by 0 days.

(21) Appl. No.: 16/050,449

(22) Filed: Jul. 31, 2018

(65) Prior Publication Data

US 2019/0031427 A1 Jan. 31, 2019

Related U.S. Application Data

(60) Provisional application No. 62/539,127, filed on Jul. 31, 2017.

(51) Int. Cl.
*B01F 9/00* (2006.01)
*B01F 13/00* (2006.01)
(Continued)

(52) U.S. Cl.
CPC ..... *B65D 83/38* (2013.01); *B01F 9/003* (2013.01); *B01F 9/0016* (2013.01);
(Continued)

(58) Field of Classification Search
CPC .... B65D 83/38; B65D 83/207; B65D 1/0215; B65D 83/14; B01F 9/0016;
(Continued)

(56) References Cited

U.S. PATENT DOCUMENTS 2,846,201 A * 8/1958 Mermelstein ..... B01F 11/0008 366/110
2,944,799 A 7/1960 Larson
(Continued)

FOREIGN PATENT DOCUMENTS

WO WO 2019/027985 2/2019

OTHER PUBLICATIONS

Notification of Transmittal of International Search Report and the Written Opinion of the International Search Authority for International Patent Application (PCT) No. PCT/US2018/044550 dated Oct. 1, 2018; 11 pages.

*Primary Examiner* — Charles Cooley
(74) *Attorney, Agent, or Firm* — Messner Reeves LLP; Scott J. Hawranek

(57) ABSTRACT

An apparatus is provided that is configured to be used with a container having contents to permit mixing of the contents of the container. The apparatus includes a main body having a geometrical shape having an open end, a closed end, and a longitudinally extending bore or opening extending from the open end to the closed end. The opening or bore is configured to receive at least a portion of a container. A shaft is generally orthogonally positioned from a portion of the closed end. The shaft is configured to be received by a rotational device. The mixing apparatus can be used to mix various sized containers containing contents having one or more materials to be mixed. The container is not attached to any portion of the main body and the container is configured to rotate freely and independently of the main body during an operation of the rotational device.

20 Claims, 60 Drawing Sheets

(51) Int. Cl.

| | |
|---|---|
| ***B65D 83/38*** | (2006.01) |
| ***B65D 1/02*** | (2006.01) |
| ***B65D 83/20*** | (2006.01) |
| ***B01F 15/00*** | (2006.01) |
| ***B05B 15/25*** | (2018.01) |
| *B65B 31/00* | (2006.01) |
| *B65D 83/14* | (2006.01) |

(52) U.S. Cl.
CPC ..... *B01F 9/0034* (2013.01); *B01F 13/0028* (2013.01); *B01F 15/0074* (2013.01); *B01F 15/00733* (2013.01); *B05B 15/25* (2018.02); *B65D 1/0215* (2013.01); *B65D 83/207* (2013.01); *B65B 31/003* (2013.01); *B65D 83/14* (2013.01)

(58) Field of Classification Search
CPC ..... B01F 15/0074; B01F 15/00733; B01F 13/0028; B01F 9/0034; B01F 9/003; B05B 15/25; B65B 31/00
USPC ..... 366/130
See application file for complete search history.

(56) References Cited

U.S. PATENT DOCUMENTS 3,330,537 A * 7/1967 Wason ..... B01F 11/0008 366/114
3,430,927 A 3/1969 Pouzar
3,542,344 A 11/1970 Oberhauser et al.
3,733,648 A 5/1973 Seiler
3,980,281 A 9/1976 Okabayashi et al.
4,176,797 A 12/1979 Kemp
4,318,622 A * 3/1982 Sterrenberg ..... B01F 11/0008 366/110
4,398,829 A * 8/1983 Shick ..... B01F 11/0008 366/110
4,420,262 A * 12/1983 Sterrenberg ..... B01F 3/04014 366/110
D277,729 S 2/1985 Maxwell
4,497,581 A * 2/1985 Miller ..... B01F 9/0001 366/208
D290,084 S 6/1987 Klapperich
5,098,193 A * 3/1992 Christensen ..... B01F 7/00408 279/102
D334,577 S 4/1993 Wheat
5,439,287 A * 8/1995 Roepke, Sr. ..... B01F 11/0008 366/130
5,451,105 A * 9/1995 Koering ..... A47J 43/042 366/130
D366,596 S 1/1996 Hewin
5,704,711 A 1/1998 Simmons
D393,180 S 4/1998 VanWestrienen
D403,920 S 1/1999 Pytlewski
5,897,205 A * 4/1999 Sinsteden ..... B01F 11/0037 366/212
D421,030 S 2/2000 Panaccione et al.
6,213,631 B1 * 4/2001 Miranda ..... B01F 7/1695 366/130
D484,657 S 12/2003 Scolley et al.
6,718,867 B2 4/2004 Hatakeyama
6,863,430 B2 3/2005 Berube
D512,292 S 12/2005 Martin
7,204,392 B2 4/2007 Kwasny et al.
D563,069 S 2/2008 Yovanoich
D601,850 S 10/2009 Ikuta
7,997,787 B2 * 8/2011 Blair ..... B01F 11/0008 366/110
D663,185 S 7/2012 Denning
D665,643 S 8/2012 Brinton
8,403,177 B2 3/2013 Kwasny
8,528,837 B2 9/2013 Kwasny
D708,033 S 7/2014 Bohanan
9,004,741 B2 * 4/2015 Stephenson ..... B01F 9/0016 366/110
9,144,777 B2 * 9/2015 Brawley ..... B01F 9/0016
D751,873 S 3/2016 Yanoff
D751,880 S 3/2016 Howell
9,491,292 B2 11/2016 Kwasny
10,220,359 B2 * 3/2019 Greene ..... B05B 15/20
D913,067 S * 3/2021 Dunn ..... D8/70
2001/0014700 A1 8/2001 Kwasny
2005/0226096 A1 * 10/2005 Damhuis ..... A23L 3/10 366/234
2006/0133196 A1 * 6/2006 Byers ..... B01F 11/0082 366/289
2007/0008817 A1 * 1/2007 Gerner ..... B01F 11/0008 366/208
2009/0161479 A1 * 6/2009 Blair ..... B01F 11/0008 366/130
2014/0084551 A1 * 3/2014 Brawley ..... B01F 9/0016 279/94
2014/0340981 A1 * 11/2014 Stephenson ..... B01F 9/0016 366/204
2015/0352508 A1 * 12/2015 Brawley ..... B01F 9/0016 279/94
2016/0002475 A1 1/2016 Potthoff et al.
2018/0369766 A1 * 12/2018 Greene ..... B05B 15/20
2019/0031427 A1 * 1/2019 Dunn ..... B65D 83/38

* cited by examiner

MIXING APPARATUS, METHOD OF MAKING THE MIXING APPARATUS AND USING THE MIXING APPARATUS

The present application claims the benefits of and priority, under 35 U.S.C. § 119(e), to U.S. Provisional Application Ser. No. 62/539,127, filed Jul. 31, 2017, which is fully incorporated herein by reference

BACKGROUND OF THE INVENTION

Field of the Invention

The present disclosure generally relates to a mixing apparatus and method of using the same, and more particularly to a mixing apparatus configured to mix contents of a container, e.g., aerosol cans, paint cans, or other containers.

Discussion of the Related Art

Conventional container and aerosol cans for holding material have a natural fault of letting the pigment (the color) settle in the bottom of the container, e.g., within the seams of the seal of the can. The settling of these pigments over any amount of time, increases additional effort by the user to mix the materials in the can, e.g., by physically shaking by hand for longer times other than recommended by the manufacture. The longer the container resides in an unused state requires more time and effort to mix the materials of the container. One related art paint mixer for the home is unsafe or hard to use, e.g., requiring tools that can be considered a specialty tool for the average home owner or hobbyist and they would never buy except to use that type of paint mixer.

There is a need for an inexpensive, safe, and improved apparatus for mixing contents of a container.

SUMMARY OF THE INVENTION

Accordingly, the invention is directed to a mixing apparatus, method of using and making the same that substantially obviates one or more of the problems due to limitations and disadvantages of the related art.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and as described in the disclosure, one implementation is directed towards a mixing apparatus including a cylindrically shaped main body having an open first end, a closed second end, and a longitudinally extending bore extending from the open first end to the closed second end. The longitudinally extending bore is configured to receive at least a portion of a container. The container is not attached to any portion of the cylindrically shaped main body or compressed by any compression mechanism. A shaft extends from the closed second end and is orientated orthogonally from the closed second end and at least a portion of the shaft is configured to be inserted into a rotational device.

In another aspect of the disclosure and according to one implementation, a mixing includes a main body having an open first end, a closed second end, and a longitudinally extending bore extending from the open first end to the closed second end. The longitudinally extending bore is configured to receive at least a portion of a container. The container is not attached to any portion of the main body and at least a portion of the main body is configured to be rotated with a rotational device.

In another aspect of the disclosure, one implementation includes a method of using a mixing apparatus for mixing contents of a container. The method includes providing a mixing apparatus as described herein and operating the rotation device to rotate the main body and container. The main body rotates at an angular velocity greater than the angular velocity of the container for at least a period of time.

This Summary section is neither intended to be, nor should be, construed as being representative of the full extent and scope of the present disclosure. Additional benefits, features and embodiments of the present disclosure are set forth in the attached figures and in the description hereinbelow, and as described by the claims. Accordingly, it should be understood that this Summary section may not contain all of the aspects and embodiments claimed herein.

Additionally, the disclosure herein is not meant to be limiting or restrictive in any manner. Moreover, the present disclosure is intended to provide an understanding to those of ordinary skill in the art of one or more representative implementations supporting the claims. Thus, it is important that the claims be regarded as having a scope including constructions of various features of the present disclosure insofar as they do not depart from the scope of the methods and apparatuses consistent with the present disclosure (including the originally filed claims). Moreover, the present disclosure is intended to encompass and include obvious improvements and modifications of the present disclosure.

BRIEF DESCRIPTION OF THE DRAWINGS

The accompanying drawings, which are included to provide a further understanding of the invention and are incorporated in and constitute a part of this specification, illustrate implementations of the disclosure and together with the description serve to explain various aspects of the invention.

In the drawings:

FIG. 10D illustrates a side perspective view of a mixing apparatus and loaded aerosol can according to an implementation of the present disclosure.

DETAILED DESCRIPTION OF THE ILLUSTRATED EMBODIMENTS

Figure 1A:
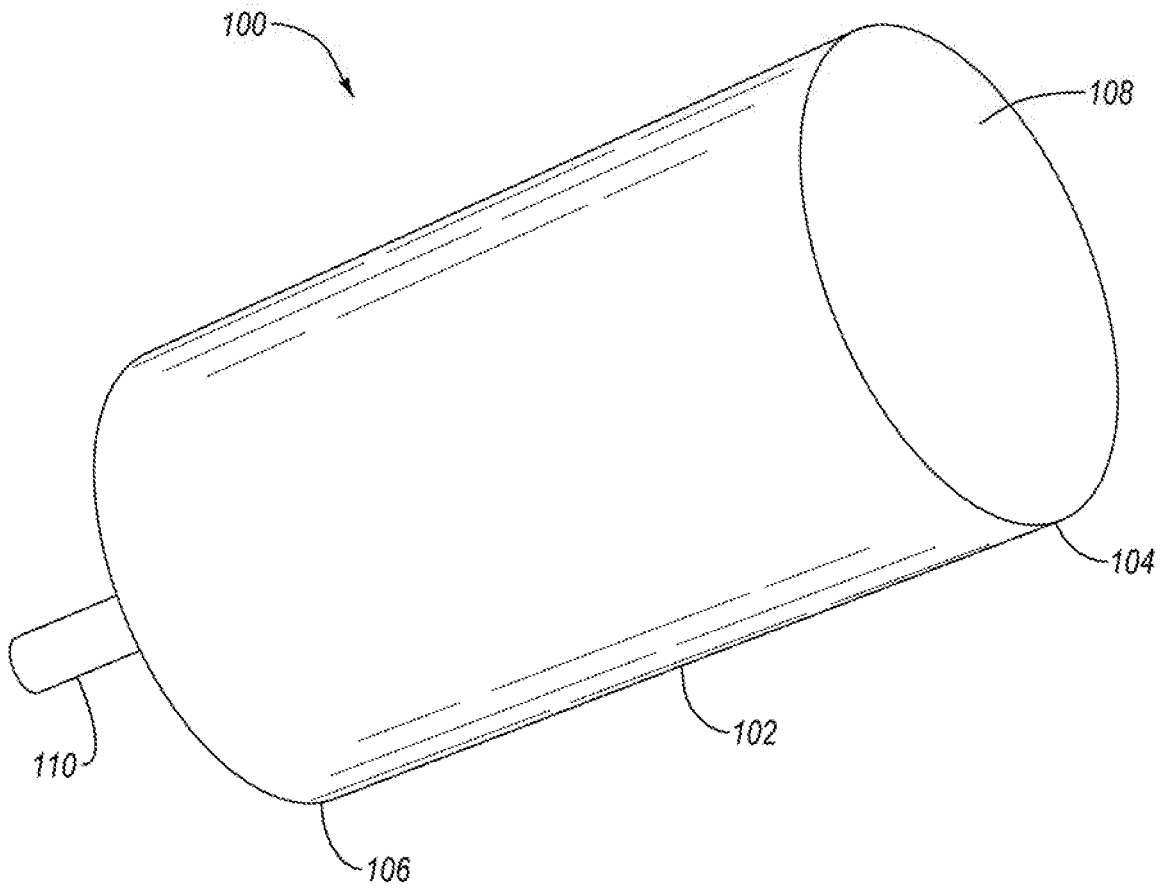
FIG. 1A illustrates a side perspective view of a mixing apparatus according to an implementation of the present disclosure.

The following detailed description describes a mixing apparatus, and is presented to enable any person skilled in the art to make and use the disclosed subject matter in the context of one or more particular implementations. Various modifications, alterations, and permutations of the disclosed implementations can be made and will be readily apparent to those skilled in the art, and the general principles defined may be applied to other implementations and applications, without departing from scope of the disclosure. The present disclosure is not intended to be limited to the described or illustrated implementations, but to be accorded the widest scope consistent with the described principles and features.

In order to more fully appreciate the present disclosure and to provide additional related features, each of the following references are fully incorporated therein by reference in their entireties:

(1) U.S. Pat. No. 2,944,799 issued to K. O. Larson, which relates generally to machines granular or pulverulent materials and more particularly to devices for making concrete by the admixing of cement or like with aggregates and water.

(2) U.S. Pat. No. 3,330,537 issued to R. E. Wason, which relates to an attachment for holding a cylindrical container on the vibrating shoe of a portable power sander, causing mixing of the container contents. A pan-like structure fits the bottom of the shoe, is removably attachable thereto, and supports parallel wedge-shaped members which engage elements of the container while a flexible strap holds the container thereagainst.

(3) U.S. Pat. No. 3,430,927 issued to E. G. Pouzar, which relates a mixer having a rotating support for a removable receptacle and a stirrer blade adjustable radially within the receptacle about its support and coaxially with respect to the center axis of the receptacle; a support for the blade cooperating with a locking member provided by the blade to adjustably position the same within the receptacle in relation to the material therein to be mixed.

(4) U.S. Pat. No. 4,318,622 issued to Sterrenberg, which relates to an apparatus for shaking an aerosol spray paint container includes a base having a cradle for receiving the container and a pair of clamps for removably securing the container within the cradle. The base is releasably secured to the movable driven member of a hand-held power tool for shaking the container. If a hand-held power sander is utilized to shake the container, then the base of the shaking apparatus is clamped to the vibrating sanding plate of the sander.

If a drill or other hand-held power tool having a rotatable chuck is utilized to shake the container, then the shaking apparatus includes a first drive shaft rotatably mounted to the base; a second drive shaft is concentrically mounted to the first drive shaft and is engaged by the rotatable chuck of the power tool for causing the base to rapidly oscillate and vibrate.

(5) U.S. Pat. No. 4,420,262 issued to Sterrenberg, which relates to an apparatus for shaking an aerosol spray paint container with a hand-held power drill includes a base member secured to the container by a band or a mounting bracket. The shaking apparatus further includes a first drive shaft rotatably mounted to the base; a second drive shaft is eccentrically mounted to the first drive shaft and is engaged by the rotatable chuck of the drill for causing the base member to rapidly oscillate and vibrate.

(6) U.S. Pat. No. 5,098,193 issued to Christensen, et al., which relates to a mixing apparatus comprising a wire coil body defining a cylinder of revolution, with a cylindrical central cavity. The wire coil body includes a wire lower end portion coaxially aligned with the cylindrical central cavity and extending underlying the wire coil body for securement within a chuck portion of a rotary drill. A modification of the invention includes tubing members mounted along the wire coil body to enhance grasping of an associated spray can in a rotary mixing procedure.

(7) U.S. Pat. No. 5,704,711 issued to Simmons, which relates to a portable mixing apparatus (10) for mixing concrete, mortar, roof sealant, paint and other materials that is powered by a hand-held power tool such as an electric drill (22). The mixing apparatus (10) includes a support base (14), a bucket holder (16) carried by the support base (14) for rotational movement on to the support base (14), a drive assembly (18) for rotating the bucket holder (16) on the support base (14), and structure (20) for coupling the drive assembly (18) with the electric drill (22) for powering the drive assembly (18) and therefore rotating the bucket holder (16) for mixing the materials contained in a bucket (12).

(8) U.S. Pat. No. 6,213,631 issued to Miranda, which relates to an adapter is provided for mixing a hardener and sealant within a cartridge assembly having a handle rotatably and reciprocably mounted therein. The adapter includes a cylindrical base having a first flat surface provided with a coupling pin extending substantially perpendicular thereto. The coupling pin is adapted to be chucked into a power drill. The base has a second flat surface provided with a plurality of spaced apart, headed elements engageable with the cartridge assembly handle. The adapter is constructed and arranged to transfer rotary motion from the drill to the handle to enable mixing of the sealant and hardener together.

(9) U.S. Pat. No. 7,997,787 issued to Blair, which relates to an apparatus and method for shaking a can of paint or bottle of aerosol spray paint. The apparatus comprises a cradle securely fastened to a tang and at least one strap for securing a can or bottle into the cradle. One end of the tang is shaped so as to be received in a chuck of a hand-held power tool such as a variable speed reciprocating saw. The apparatus is useful for quickly and effectively mixing relatively small cans of paint near in time and place to using the paint.

(10) U.S. Pat. No. 9,144,777 issued to Brawley, which discloses an apparatus is provided that is configured for attachment to an aerosol can to permit mixing of contents therein. The apparatus includes a generally flat base portion coupled to a drive shaft orthogonally oriented relative to the base portion, and a securing strap attached to the base portion. The securing strap is configured to engage or grip a cylindrical end portion of an aerosol can to secure the aerosol can to the apparatus, whereby the drive shaft is configured to be mounted within a drill chuck to permit the mixing apparatus to rotate an aerosol can attached thereto for mixing contents within the aerosol can.

(11) U.S. Pat. No. D665,643 issued to Brinton, directed towards a paint shaking saw attachment.

In one implementation, a mixing apparatus includes an apparatus that is configured to be used with a container having contents to permit mixing of the contents of the container. The apparatus includes a main body having a geometrical outer portion that defines a longitudinal axis, the geometrical body portion having an open end, a closed end, and a longitudinally extending bore or opening from the open end to the closed end. The opening or bore is configured to receive at least a portion of a container. A shaft is generally orthogonally positioned from a portion of the closed end. The shaft is configured to be received or inserted into a rotational device.

A mixing apparatus including a main body having a first end, a closed second end, and a longitudinally extending bore or lumen extending from the first end to the closed second end. The longitudinally extending bore or lumen is configured to receive at least a portion of a container. The container is not attached or directly attached to any portion of the main body. A rotational mechanism is arranged on a bottom portion of the main body configure to allow a rotation device with or without a secondary device, e.g., spindle or other attachment mechanism, to be releasably coupled to the rotational mechanism.

The main body may be constructed from a variety of different materials or combinations of materials including thermoplastic materials, metals, alloys, composites, wood, and the like. Some typical thermoplastic materials include polymers, polypropylene copolymer, prime polypropylene, acrylic, ABS, Nylon, PLA, polybenzimidazole, polycarbonate, polyethersulfone, polyoxymethylene, polyetheretherketone, polyetherimide, polyethylene, polyphenylene oxide, polyphenylene sulfide, polypropylene, polystyrene, polyvinyl chloride and polytetrafluoroethylene and combinations thereof and the like. Thermoplastics that are capable of injection molding, three-dimensional printed with a three-dimensional printer, or other molding, e.g., cavity molds, can also be used.

Optionally and/or alternatively, the thermoplastic materials have properties that allow them to be flexible without breaking in order to permit it to move or bend from a first orientation to a second orientation. In addition, in one implementation, the thermoplastic materials are configured, so the main body has shape memory in a preformed configuration or orientation. Some type of external force is required to move, bend, and/or twist at least a portion of the main body and the portion moves from a first position or orientation to a second position or orientation without breaker. Optionally, the thermoplastic material is strong enough to remain in a first position during operation, e.g., rotation. Further optionally and/or alternatively, a retaining strap or mechanism as described herein can be utilized to secure at least one more portion of the main body.

The main body and/or shaft may be of any color or combination of colors, e.g., any combination of red, green and blue. In one implementation, the main body is a solid fluorescent green color. The main body may also have different designs that create different impressions at different RPMs. The main body may also include embedded pictures, text, e.g., instructions in a portion of the main body interior or exterior.

The main body or housing is configured to hold at least a portion of a container and the container is arranged at least partially within a bore or lumen of the main body. The main body may be configured into any geometrical configuration with radial symmetry, e.g., circle, cylinder, oval, square, triangle, diamond, pentagon, hexagon, heptagon, octagon, nonagon, combinations of the same and the like. The main body also may be formed into one more section, e.g., claim shell type design. In addition, the main body may be formed with one or void spaces, e.g., a helical structure having void spaces between the helical windings. The main body may also have an open, partially opened, closed, partially closed, or closed first end and/or second end and combinations of the same. The main body may have one or more vents as described herein.

The inside diameter of the main body may be in a range from about 10 mm to about 300 mm or greater. In a preferred embodiment, inside diameter of the main body is about 50 mm to about 100 mm and is sized to accommodate different containers with varying outside diameter dimensions. The main body may also be configured with an offset by having a different inside diameter. In a preferred embodiment, the offset is created by a difference of inside diameters between a first end compared to the inside diameter at the second end. The first end may be bottommost portion of the main body and the second end may be uppermost portion of the main body. The offset can be in range from about 0.1 degrees to about 5 degrees or greater. In a preferred embodiment, the offset is about 1.5 to about 3 degrees. The offset can also be formed at any portion of the main body extending from the first end to the second end, e.g., the offset can be in a middle portion of the main body and extending to an uppermost portion. In one implementation, the main body includes a substantially cylindrical geometric configuration having a circumferential wall extending from the bottom end of the main body to a top end of the main body in a tapered configuration with about a 2 degree offset with an inside diameter at a bottom end of about 75 mm an inside diameter at a top end at about 80 mm. The main body may have thickness, e.g., wall thickness, in a range from about 0.0001 mm to 10 mm or greater. The thickness may vary throughout different locations of the main body.

In one implementation, the inside diameter of the main body of the apparatus may be constant along a longitudinal axis of the main body from a first end closed portion to a second end open portion. Optionally and/or alternatively, the inside diameter of the main body may linearly or non-linearly increase from the bottom end to the upper end. In one implementation, the inside diameter is configured to leave about 10 mm (5 mm on each side) of space when a container resides within a lumen of the main body, i.e., the inside diameter of the container is about 10 mm greater than an outside diameter of the container. This space dimension may also be greater or less than the 10 mm.

The main body may have a length in range from about 5 mm to about 250 mm or greater. The length of the main body may be configured to be greater than, less than or equal to the length of the container. Optionally and/or alternatively, the main body has a height to accept the full length of the aerosol can.

In one implementation, a shaft 110 is arranged at an orthogonal configuration relative to the flat base of a bottom end of the main body. The shaft is configured and sized to be inserted into a receiving portion of a rotational device. The receiving portion of the rotational device is a chuck or a specialized type of clamp configured to releasable hold at least a portion of the shaft. The chuck or clamp as known in the art is used to hold an object with radial symmetry, e.g., a cylinder.

The shaft may be constructed from a variety of different materials including thermoplastic materials, metal materials, alloy materials, wood materials, composite materials and combinations of the same. The shaft may be integral or constructed with the main body of a single solid unitary piece. The shaft may be the same or different materials relative to the main body.

The shaft may be centered with a central axis of the may body or offset. The shaft can be configured into a number of different geometrical configurations with radial symmetry, e.g., having a cross-sectional shape like a circle, triangle, square, pentagon, hexagon, heptagon, octagon, nonagon, combinations of the same and the like. The shaft may also have a constant diameter or dimension or a variable diameter or dimension from a first end to a second end. The change diameter of the shaft or dimension can be step change, linear change, and/or non-linear change.

The shaft can have a length from about 5 mm with a length of about 30 mm or greater.

Optionally and/or alternatively, the shaft 110 can be reinforced with materials, e.g., metals, composites, thermoplastics, alloys, combinations of the same and the like.

The shaft may also be reinforced with one or more supporting members configured to support the shaft and add weight to the apparatus. In one implementation, the supporting members are coequally spaced apart from each other in a radial configuration, however, they don't have to be coequally spaced. The number of supporting members may be increased or decreased. The supporting members are configured to add strength and rigidity to at least a portion of the shaft. In one implementation, the shaft is attached to the main body.

Optionally and/or alternatively, a rotational mechanism is used instead of a shaft coupled to the main body. When using the rotational mechanism, a removable shaft is attached to a rotation device at one end and the other end engages a recess or screw head in the rotation mechanism. In this implementation, the shaft is more of a spindle having any radial symmetry as described herein. The recess can include any screw head pattern as known in the art.

The container to be mixed may be any type of container with or without radial symmetry for holding any material and any physical state of matter of the material to be mixed. Some typical physical states include of materials include, e.g., liquid, solid, gas, plasma, semi-solid, liquid/solid, powder, and combinations of the same to be mixed. The liquid, liquid/solid, powder, and combinations of the same to be mixed may include any material to mixed. Some illustrative examples of materials to be mixed including, tattoo ink, model paints, chemicals, liquids, paints, epoxy, drink mixes, e.g., protein sport drink mixes, other powder and/or liquid mixes and the like. Essentially, the liquid, liquid/solid, powder, and combinations of the same to be mixed may be any material, liquid, solid or combination of the same desired to be mixed can be mixed with the mixing apparatus.

Some typical geometrical configurations of container with radial system include one or more of the following sided configurations, cylinder, oval, square, triangle, diamond, pentagon, hexagon, heptagon, octagon, nonagon, combinations of the same and the like.

In one implementation of the disclosure, the container is an aerosol container, for example, a single component system or more than one component system as described with reference to one or more of U.S. Pat. Nos. 7,204,392; 8,403,177; 8,528,837; and 9,493,292 and U.S. Patent Application Publication Nos.: 2001/0014700 and U.S. Patent Application Publication No. 2016/0002475, each of foregoing patents and patent applications are hereby fully incorporated by reference as if fully set forth herein.

In a preferred embodiment, the container relates to an aerosol can includes a body containing a propellant and an aerosol product, a valve whose actuation enables said aerosol product to be sprayed, and a spray head which serves to discharge the aerosol product to the environment when the valve is actuated, said spray head being provided with an axial borehole through which the aerosol product enters the spray head. The aerosol product to be sprayed is any aerosol product as known in the art, e.g., a varnish, a painting preparation agent or other coloring substance. The implementations of the disclosure apply to and is to be used for all types of aerosol cans as known in the art.

In one implementation of the disclosure, the aerosol container has a length in range of about 50 to about 200 mm or greater with a cap. In another implementation, the aerosol container has a length of about 150 mm in length and has a cap with a length of about 50 mm for a total length of about 200 mm. The aerosol container when arranged in a lumen of the main body has about 50 mm or more sticking out from the mixing apparatus. Leaving about one third or less (about 66 mm of the container extending outside the main body in this implementation). It is believed this creates enough support for the aerosol container to stay contained in the lumen of the main body without being physically attached to the apparatus while also using gravity and centrifugal force during operation. That is, there is no physical securing device to attach an aerosol can to the mixing unit.

In one implementation of the disclosure, the container is not attached, secured, or coupled to the main body of the mixing apparatus or another portion of the mixing apparatus. There is no mechanism for attaching, securing or directly attaching the container to the mixing apparatus or main body of the mixing apparatus. There is also no mechanism to provide a compression force to secure or attach any portion of the container to the main body. The container can rotate freely in the main body. Also, during operation, a user can stop the rotation of the container by holding a portion of the container and the main body continues to rotate. In one implementation, the container simply resides in at least a portion of the main body of the mixing apparatus such that more than quarter of the container's length extends past the main body. The diameter or dimension of the housing is greater than the diameter or dimension of the container. Typically, the container is held in place by gravity and at least a portion of the inner walls of the housing. The container may move independently from the housing.

In one implementation of the disclosure, the mixing apparatus and the container to be mixed are not coupled, directly coupled or attached together in any configuration. That is, the centrifugal force, i.e., an apparent force that acts outward on a body moving around a center, arising from the body's inertia, acts on the container in the housing by rotating the mixing apparatus. This allows a container to rotate in a lumen of the main body in a direction of the rotation of the housing. The container can also be moved independent when in the lumen of the main body from the main body. The mixing unit and/or housing has no attachment mechanism or means for the container to couple or attach releasably the container to the housing. The container can also rotate at a different rotational velocity as compared to the main body during operation for at least an amount of time, e.g., startup time or greater as described herein.

In one implementation of the disclosure, an inner surface of the main body may include an insert material, coating, geometric configuration, e.g., bumps, and other agitating mechanisms, e.g., one or more protrusions, e.g., blades, brushes, rubber blades, to assist with agitation of the contents of the container.

In one implementation of the disclosure, a lack of attachment mechanism is thought to be a safety feature. This safety feature allows a user to stop rotation of the container by applying a stopping force to the container independent of the housing of the mixing apparatus. The container residing within a portion of the housing can move independently or substantially independently from one another. In one implementation, a conventional drill is used as the rotation device and coupled to the shaft of the housing the drill can remain on in a rotation mode while a user holds the container with their hand to stop, slow or prevent rotation of the container while the housing is moving by the drill. In direct contrast, if the housing was directly coupled to the container this independent movement would not be possible. This independent motion allows the container rotational velocity to ramp more slowly upon starting rotation of the drill and slow more slowly upon deactivation of the drill. Moreover, a user has greater control of mixing compared to a unit that is coupled to container, e.g., a user can hold or partially hold the container throughout operation of the mixing unit to increase or decrease speed of the container by application of holding force as the container moves independent of the housing.

In one implementation of the disclosure, the apparatus can work with various sized containers having different dimensions in outside diameter or dimension, weight, and/or length. In addition, the main body permits one to rapidly mix multiple sized containers or the same sized containers as no attachment mechanism is required and instead as user can simply place a portion of the container in the main body, operate, and remove the container as no attachment mechanisms are required, and repeat. That is, there is no time lost by avoiding any time to couple and/or uncouple a housing of the mixing unit from the container.

Optionally and/or alternatively, the mixing unit can include one or more sensors configured to determine or be used as a timer, velocity, revolutions per minute (RPM), location, revolution counter, an electronic sensor unit configured to indicate when the liquid, liquid/solid, powder, and combinations of the same have been mixed or agitated to a predetermined condition, e.g., by indicating number of revolutions, time of revolutions and other data indicative of mixing. The predetermined condition can also be user specified.

Optionally and/or alternatively, the mixing apparatus may include one more commercial logos, trademarks writing or ornamental designs on any surface, embedded in the main body or shaft, affixed, e.g., sticker, decal and combinations of the same. The main body and/or shaft may also be constructed or include phosphorescence material, e.g., glow-in-dark, of any color or design.

In one implementation of the disclosure, one or more lights of one or more color are arranged on in a portion of the main body. For example, the one or more lights can be recessed within a portion of the main body, or completely covered within a portion of the main body. Optionally, the lights are configured to change color to indicate one or more of mixing complete, velocity, RPM, revolution counter, time, and the like. The lights can be conventional light emitting diodes (LEDs) as known in the art. The lights can be part of reinforcement ribs of the main body.

The rotational device can be any rotational device known in the art. The rotation device can be electronic, battery operated, operated with a direct connection to a power source, mechanically operated. The rotation device can also be integral with, e.g., non-detachable from the mixing apparatus. In one implementation, an integral mixing unit includes a rotational device that is integral with a portion of housing and cannot be attached or detached from a portion of the housing. The rotational device may include a drill, Dremel, mill, drill, electric drill, battery drill, mechanical drill, drill press, and other type devices as known in the art.

In one implementation of the disclosure, the rotation device is configured to rotate in a range from about 1 RPM to about 1500 RPM or greater. In one implementation, the RPM for mixing a typical aerosol can or paint container, is in a range from about 700 RPM to about 1300 RPM or greater.

In one implementation of the disclosure, a method of using a mixing apparatus for mixing contents of a container. The method includes providing any of the mixing apparatuses described herein. Providing a rotational device as described herein. Arranging the mixing apparatus into a bore or lumen of the main body of the mixing apparatus. Attaching the rotational device to a portion of the apparatus. Operating the rotation device to rotate the main body and container one or more RPMs for a predetermined time to achieve a desired mixing of one or more contents in the container.

In one implementation, the apparatus described herein can be made by an injection molding manufacturing process by injection of molten material into a mold with materials described herein, e.g., metals, glasses, elastomers, confections, thermoplastic and thermosetting polymers as known in the art. The apparatus can be fabricated as single unitary piece including the main body, shaft and any other implementations as described herein. Of course, other types of molding as known in the art may also be utilized, e.g., blow molding, powder metallurgy, compression molding, extrusion molding, laminating, rotational molding, thermoforming and combinations of the same and the like. The apparatus may also be constructed by three-dimensional printing. The apparatus may be constructed as not a single solidary unit.

Reference will now be made in detail to an embodiment of the present invention, example of which is illustrated in the accompanying drawings.

Figure 1B:
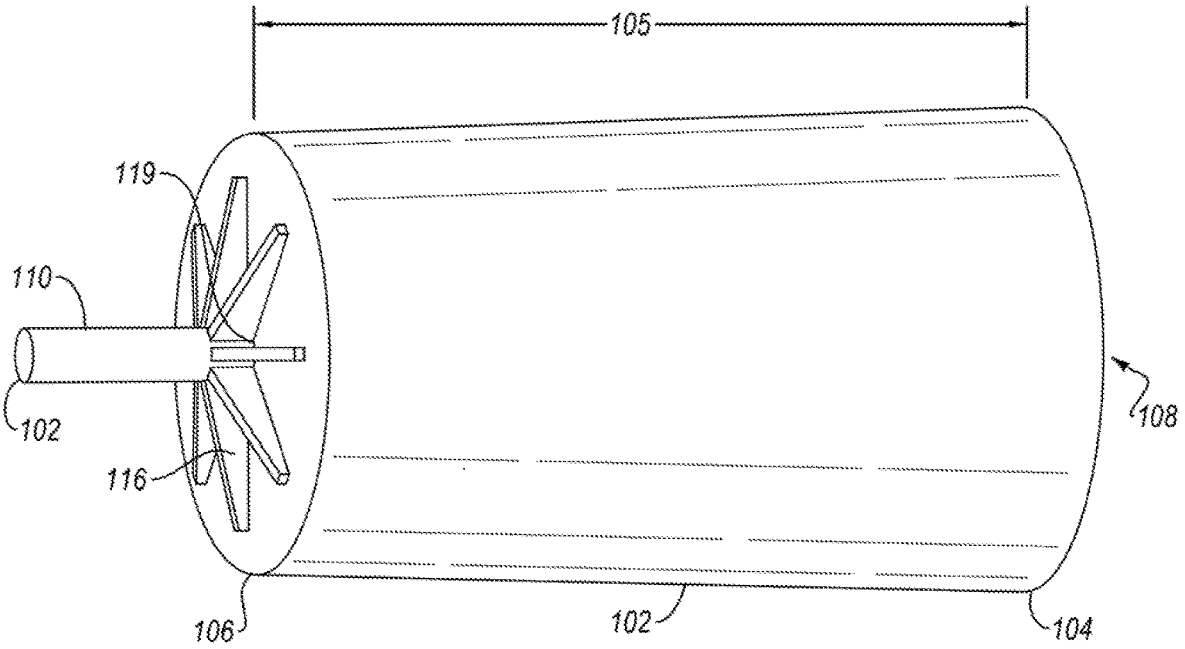
FIG. 1B illustrates a side view of the mixing apparatus of FIG. 1A, according to an implementation of the present disclosure.
Figure 1C:
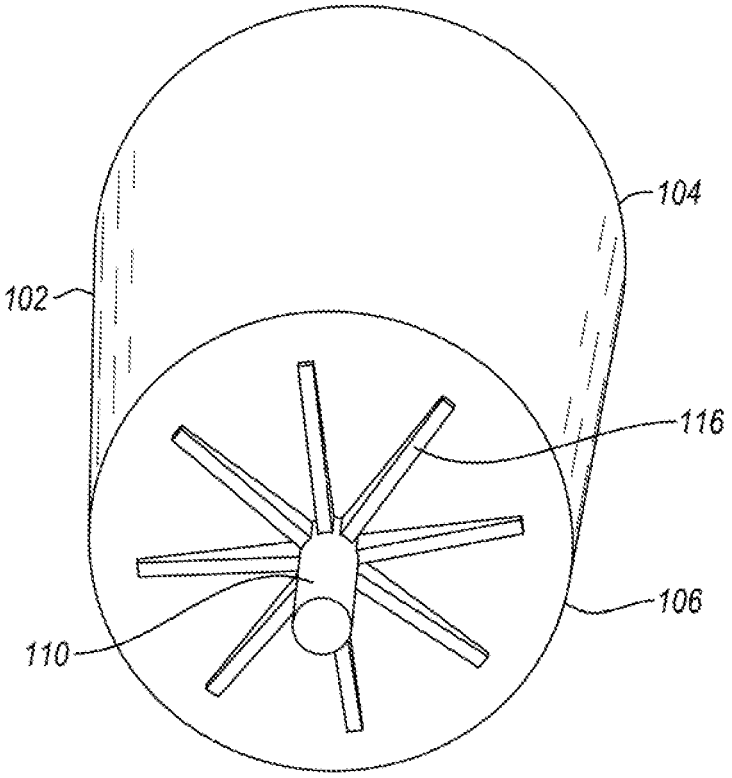
FIG. 1C illustrates a bottom perspective view of the mixing apparatus of FIG. 1A, according to an implementation of the present disclosure.

FIG. 1A illustrates a perspective view of a mixing apparatus according to an implementation of the present disclosure. FIG. 1B illustrates a side perspective view of the mixing apparatus of FIG. 1A, according to an implementation of the present disclosure. FIG. 1C illustrates a bottom perspective view of the mixing apparatus of FIG. 1A, according to an implementation of the present disclosure.

Referring to FIGS. 1A-1C, a mixing apparatus 100 includes a main body or housing 102, a first end 104, a second end 106, a lumen or bore 108 extending from the first end 104 to the closed second end 106. The second end 106 of the main body 102 has a substantially flat base. A shaft 110 is arranged at an orthogonal configuration relative to the flat base of second end 106. The shaft 110 is configured and sized to be inserted into a receiving portion of a rotational device.

The receiving portion of the rotational device is a chuck or a specialized type of clamp configured to releasable hold at least a portion of the shaft 110. The chuck or clamp as known in the art is used to hold an object with radial symmetry, e.g., a cylinder.

The housing 102 is configured to hold at least a portion of container (not shown) and the container is arranged at least partially within a bore 108 of the main body 100. The main body 100 may be configured into any geometrical configuration with radial symmetry, e.g., cylinder, oval, square, triangle, diamond, pentagon, hexagon, heptagon, octagon, nonagon, combinations of the same and the like.

In this implementation, the main body 102 has a substantial cylindrical configuration having about a 1 degree or greater offset or angle from the second end 106 to the first end 104. The offset can be in range from about 0.1 degrees to about 5 degrees or greater. The offset is created by a difference of inside diameter between or at the second end 106 compared to the inside diameter at the first end 104. The inside diameter at the second end 106 is smaller than the inside diameter at the first end 104. In this configuration a container can be easily inserted into the lumen or bore 108 as the inside diameter at either the first end 104 or second end 106 is greater than any outside diameter of the container.

Optionally and/or alternatively, the inside diameter at the second end 106 may also be equal to or less than the inside diameter at the first end 104. When the inside diameter at the first end 104 is equal to the inside diameter at the second 106 there is no offset.

In this implementation, the inside diameter of the body 102 at the first end 104 is 84 mm and the inside diameter at the second end 106 is about 80 mm, thereby creating about a 2-degree offset and a cone type shaping of the cylinder from the second end 106 to the first end 104. In other implementations, the inside diameter at the first end 104 and second end 106 may be in a range from about 10 mm to about 150 mm or greater. The length 105 of the body 102 may be in a range from about 5 mm to about 250 mm or greater.

The main body 102 and shaft 110 may be constructed from a variety of different materials including thermoplastic materials, metal materials, alloy materials, wood materials, composite materials and combinations of the same. Housing 102 may be the same or different materials relative to the shaft 110. In this implementation the housing 102 and shaft 110 are constructed from the same thermoplastic material, as an integral unit with a single mold.

In this implementation the shaft 110 extends from the base of the body 102 and is substantially centered and extends orthogonally from the base. The shaft 110 has radial symmetry and is configured with a cylindrical geometry. In other implementations, the shaft 110 geometry may include any type of geometric shape with radial symmetry, e.g., triangle, square, pentagon, hexagon, heptagon, octagon, nonagon, combinations of the same and the like. The shaft 110 may also have a constant diameter or dimension or a variable diameter or dimension from a first end 112 to a second end 114. The change diameter of the shaft 110 or dimension can be step change, linear change, non-linear change. In this implementation the diameter is a constant dimension of about 10 mm with a length of about 30 mm. In another implementation, the diameter can be in a range from about 5 mm to about 15 mm or more. In a preferred embodiment, the diameter is about 8 mm to about 10 mm. The shaft may be any size and geometric configuration that is appropriate for common rotational devices, e.g., electric drill, mechanical drill, battery drill.

Optionally and/or alternatively, the shaft 110 can be reinforced with materials.

In this implementation, eight supporting members 116 are used to support the shaft 110. The supporting members 116 are coequally spaced apart from each other in a radial configuration. The number of supporting members 116 may be increased or decreased. The supporting members also add weight to a bottom portion of the housing 102. The supporting members 116 add strength and rigidity to the shaft. The shaft 110 may also be reinforced with various materials including, e.g., metals, composites, thermoplastics, alloys, combinations of the same and the like.

Figure 2A:
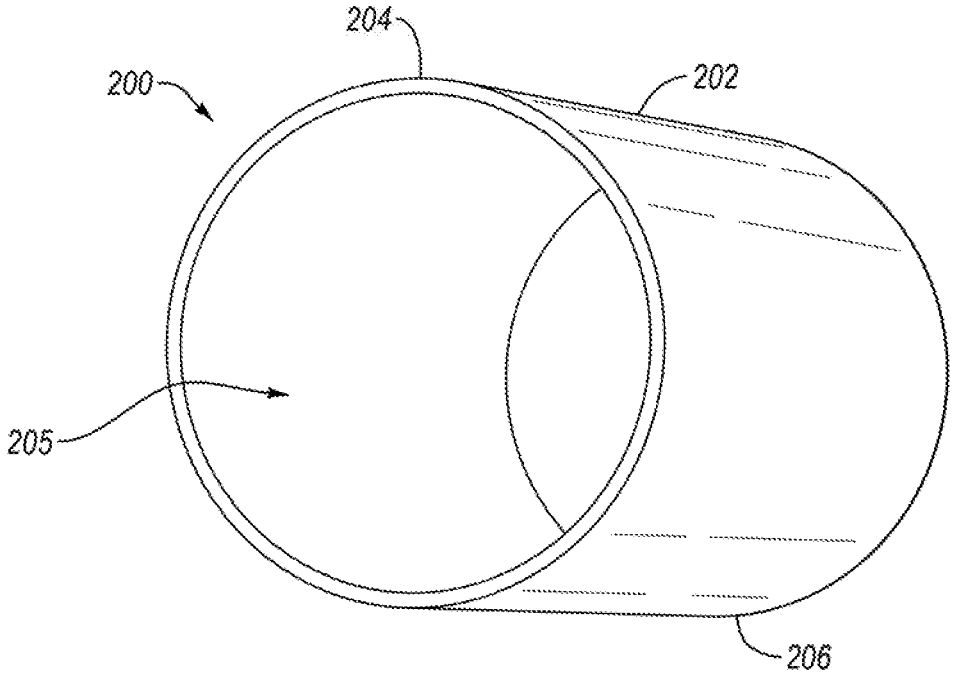
FIG. 2A illustrates a top perspective view of a mixing apparatus according to an implementation of the present disclosure.
Figure 2B:
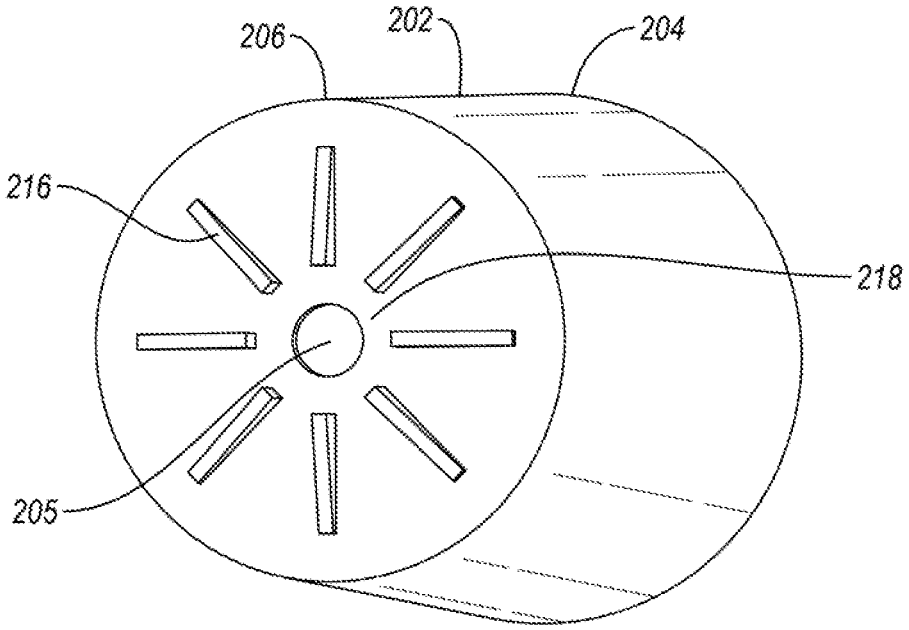
FIG. 2B illustrates a bottom perspective view of the mixing apparatus of FIG. 2A, according to an implementation of the present disclosure.
Figure 2C:
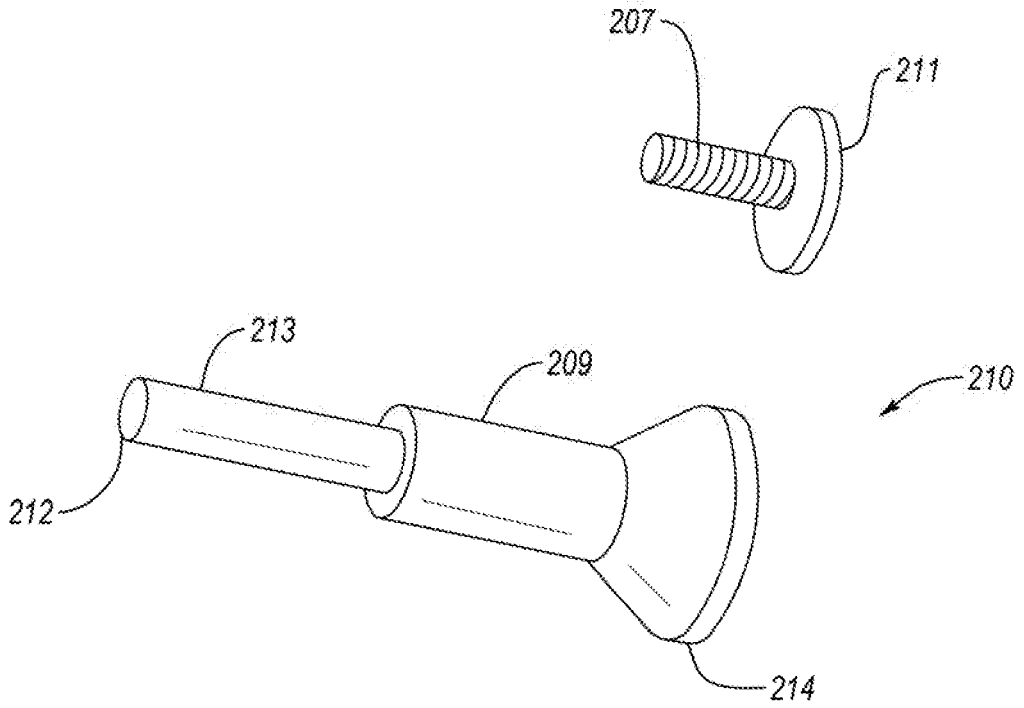
FIG. 2C illustrates a disassembled side perspective view of a shaft of the mixing apparatus of FIG. 2A, according to an implementation of the present disclosure.
Figure 2D:
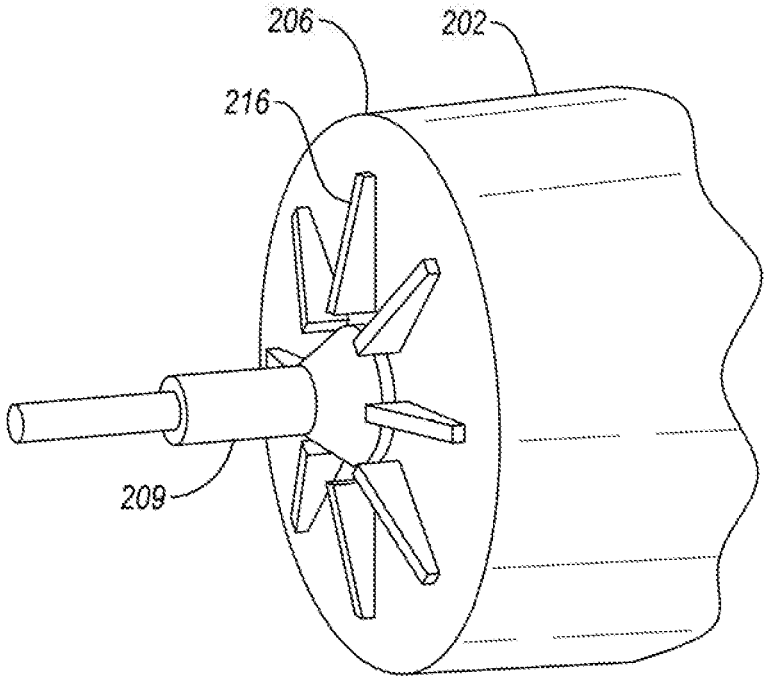
FIG. 2D illustrates an assembled side perspective view of a shaft and the mixing apparatus of FIG. 2A, according to an implementation of the present disclosure.
Figure 2E:
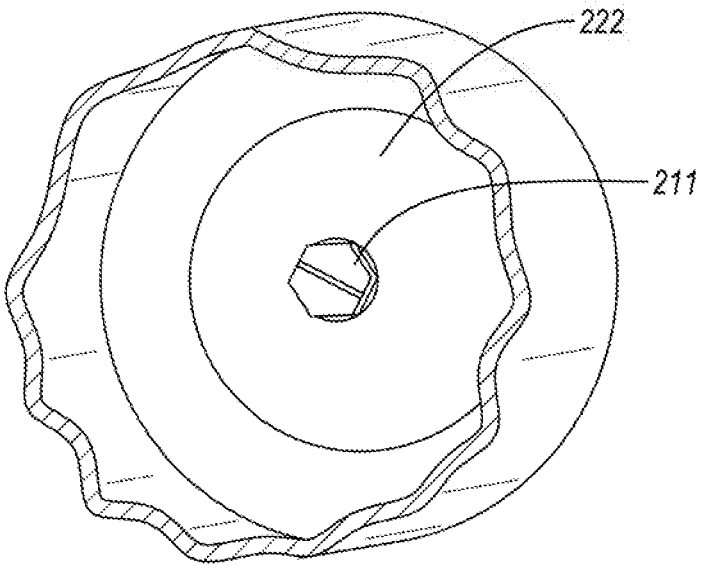
FIG. 2E illustrates an assembled top perspective and partial cross-sectional view of a shaft and the mixing apparatus of FIG. 2A, according to an implementation of the present disclosure.

FIG. 2A illustrates a top perspective view of a mixing apparatus according to an implementation of the present disclosure. FIG. 2B illustrates a bottom perspective view of the mixing apparatus of FIG. 2A, according to an implementation of the present disclosure. FIG. 2C illustrates a disassembled side perspective view of a shaft of the mixing apparatus of FIG. 2A, according to an implementation of the present disclosure. FIG. 2D illustrates an assembled side perspective view of a shaft and the mixing apparatus of FIG. 2A, according to an implementation of the present disclosure. FIG. 2E illustrates an assembled top perspective and partial cross-sectional view of a shaft and the mixing apparatus of FIG. 2A, according to an implementation of the present disclosure.

Referring to FIGS. 2A-2E, a mixing apparatus 200 includes a main body or housing 202, a first end 204, a second end 206, a lumen or bore 208 extending from the first end 204 to the second end 206. The second end 206 is closed and not open. The second end 206 of the main body 202 has a substantially flat base.

The second end 206 includes an orifice 205 to receive a shaft unit 210. The shaft unit 210 includes a shaft unit having a radially symmetrical unit 209 and a coupling unit 207 configured to couple the radially symmetrical unit 209 to the main body 202 via the orifice 205. The radially symmetrical unit 209 includes a first end 212 and a second end 214. The second end includes a lumen to receive threaded portion of the coupling unit 207. The head 211 of the coupling unit 207 includes a slot drive configuration. However, any type of head screw type as known in the art may be utilized, e.g., cross, Philips, frearson, mortorq, hex and the like. In addition, any type of attachment mechanism may also be utilized to couple a main body to a shaft, e.g., rivet, bolt and nut, and others. In this implementation, the shaft unit is metal and is sized to give the unit some extra weight. The first end 212 includes a first diameter and the second end 214 includes a second diameter that is greater than the first diameter. The radially symmetrical unit includes a portion 213 configured to be received by a conventional rotation device chuck.

Also, in this implementation, eight supporting members 216 are used to support the radially symmetrical unit 209. The supporting members 216 are coequally spaced apart from each other in a radial configuration and configured with a recess portion 218. The recess portion is sized to have a dimension greater than an outer dimension of the second end 214 of the radially symmetrical unit 209. The supporting members also add weight to a bottom portion of the housing 202. The supporting members 216 add strength and rigidity to at least a portion of the shaft unit 210. The shaft unit 210 may also be reinforced with various materials including, e.g., metals, composites, thermoplastics, alloys, combinations of the same and the like. Optionally and/or alternatively, a washer 222 is utilized as shown in FIG. 2E. An adhesive, e.g., thread locking adhesive, may also be used to lock the threads 207 into the lumen of the of the radially symmetrical unit 209.

Figure 3A:
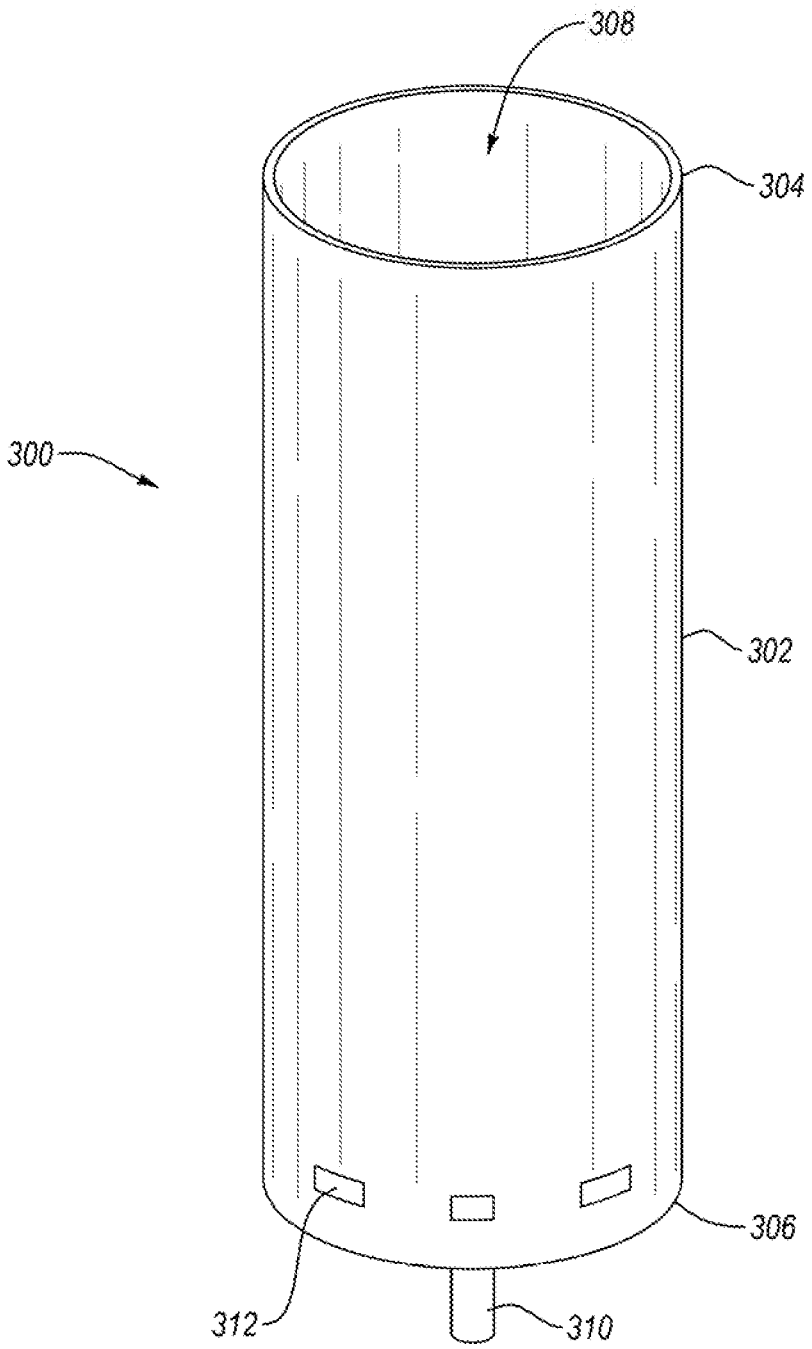
FIG. 3A illustrates a top perspective view of a mixing apparatus according to an implementation of the present disclosure.
Figure 3B:
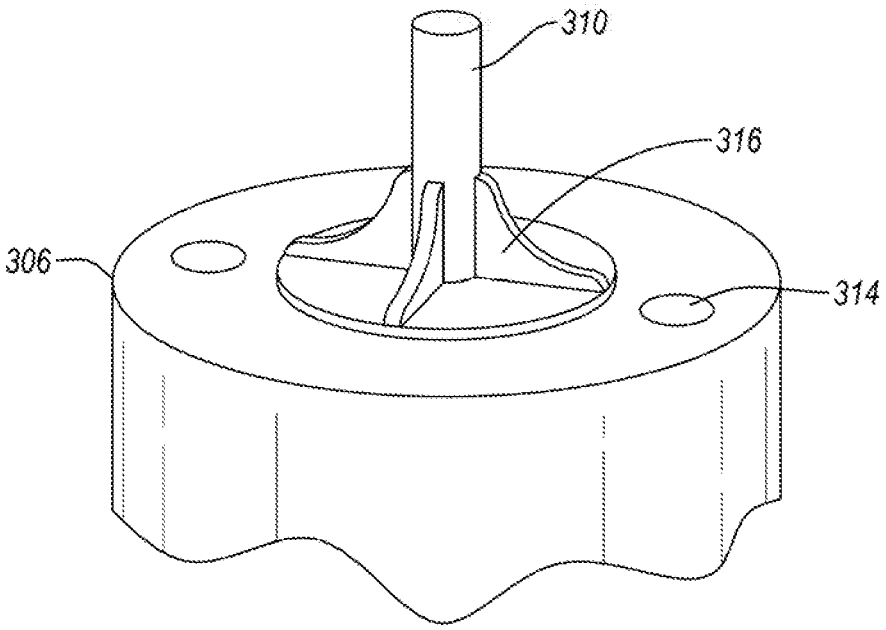
FIG. 3B illustrates a top perspective view of a mixing apparatus according to an implementation of the present disclosure.

FIG. 3A illustrates a top perspective view of a mixing apparatus according to an implementation of the present disclosure. FIG. 3B illustrates a top perspective view of a mixing apparatus according to an implementation of the present disclosure.

Referring to FIGS. 3A-3B, a mixing apparatus 300 includes a main body or housing 302, a first end 304, a second end 306, a lumen or bore 308 extending from the first end 304 to the second end 306. The second end 306 is closed and not open. The second end 306 of the main body 302 has a substantially flat base. A shaft 310 is arranged at an orthogonal configuration relative to the flat base of second end 306. The shaft 310 is configured and sized to be inserted into a receiving portion of a rotational device.

The mixing apparatus 300 also includes one or more vent holes 312 arranged in a circumferential orientation around a base portion of the main body 302. The vents 312 are configured to prevent or minimize a vacuum pressure from accruing when the container is removed or being inserted in the mixing apparatus 300. The vents 312 are sized to permit air to pass through the vents and prevent or minimize a vacuum pressure during insertions or removal of a container. In this implementation, the shaft 310 has an outer diameter of about 10 mm and a length of about 30 mm. Optionally and/or alternatively, vents 314 are arranged on a base portion. The number of vents 312 and 314 may be one to eight or more. The apparatus 300 further includes a 2 degree offset and reinforcement members 316 each of which is described herein.

Figure 4A:
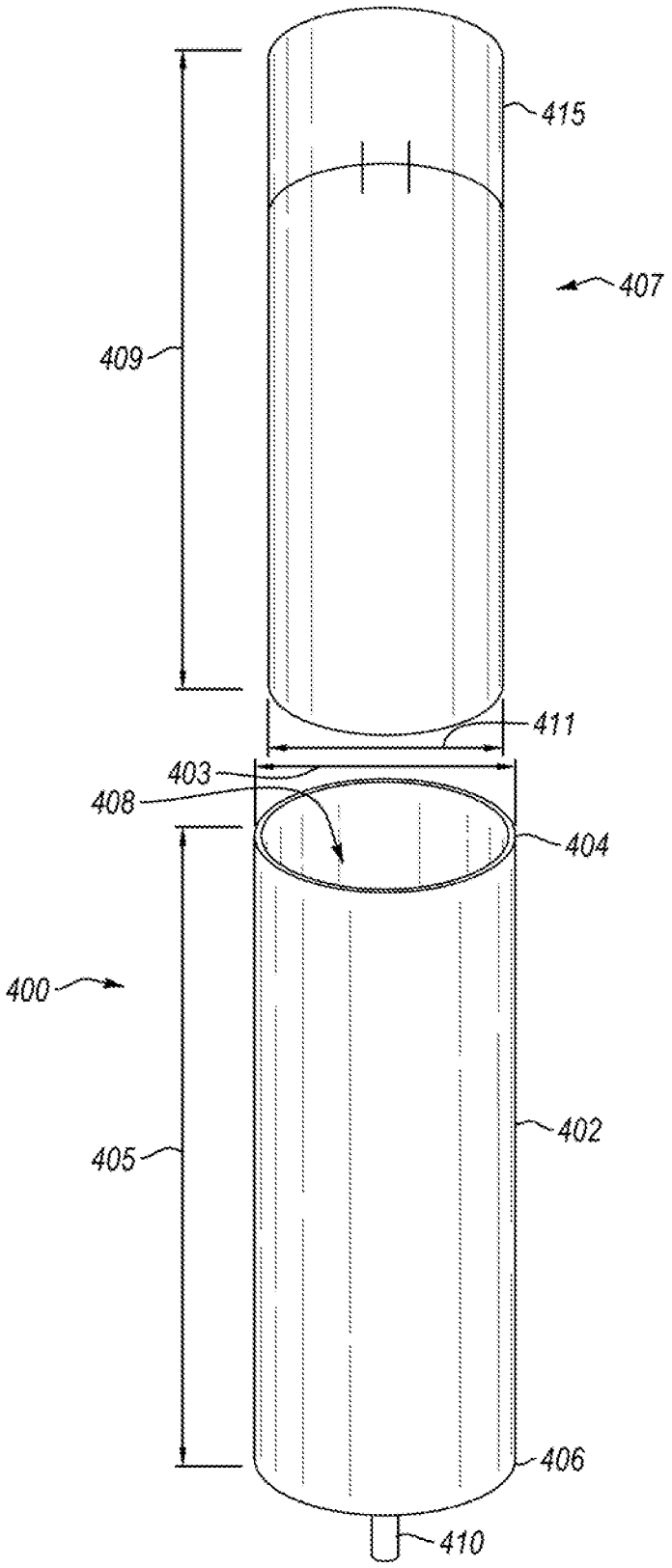
FIG. 4A illustrates a top perspective view of a mixing apparatus according to an implementation of the present disclosure.
Figure 4B:
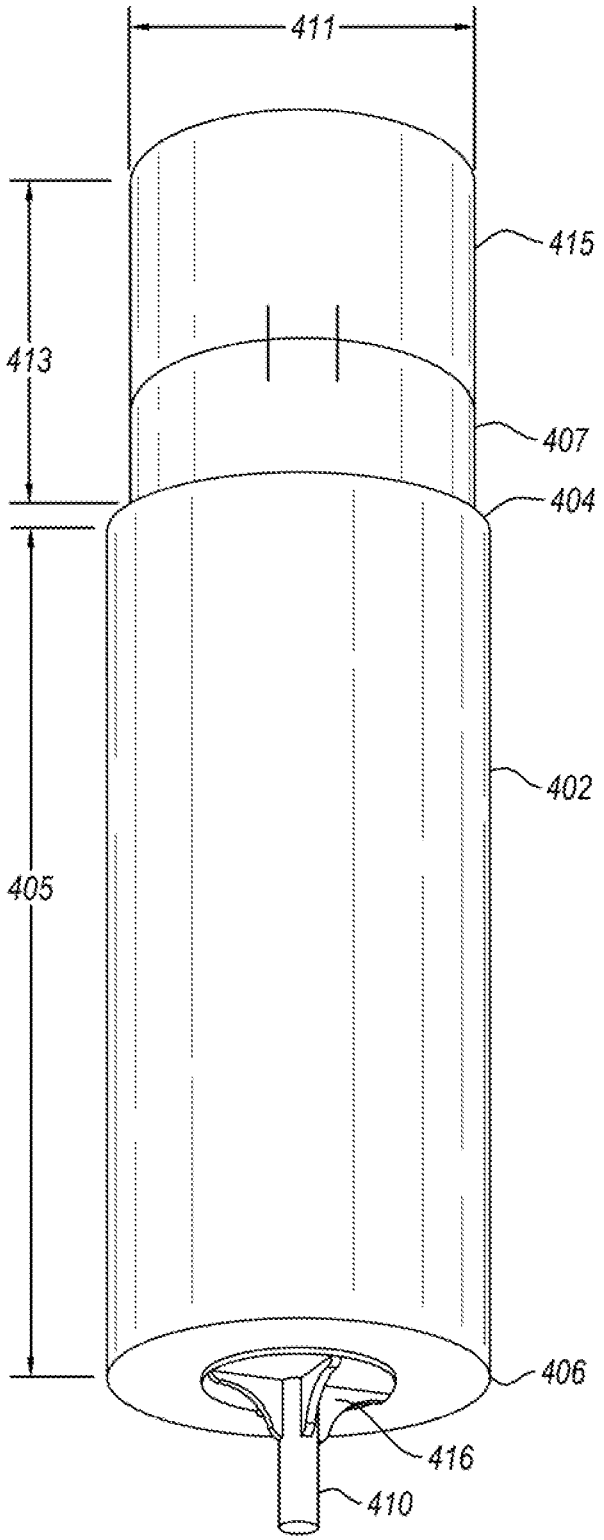
FIG. 4B illustrates a side perspective view of a mixing apparatus and aerosol can in a loaded configuration according to an implementation of the present disclosure.
Figure 4C:
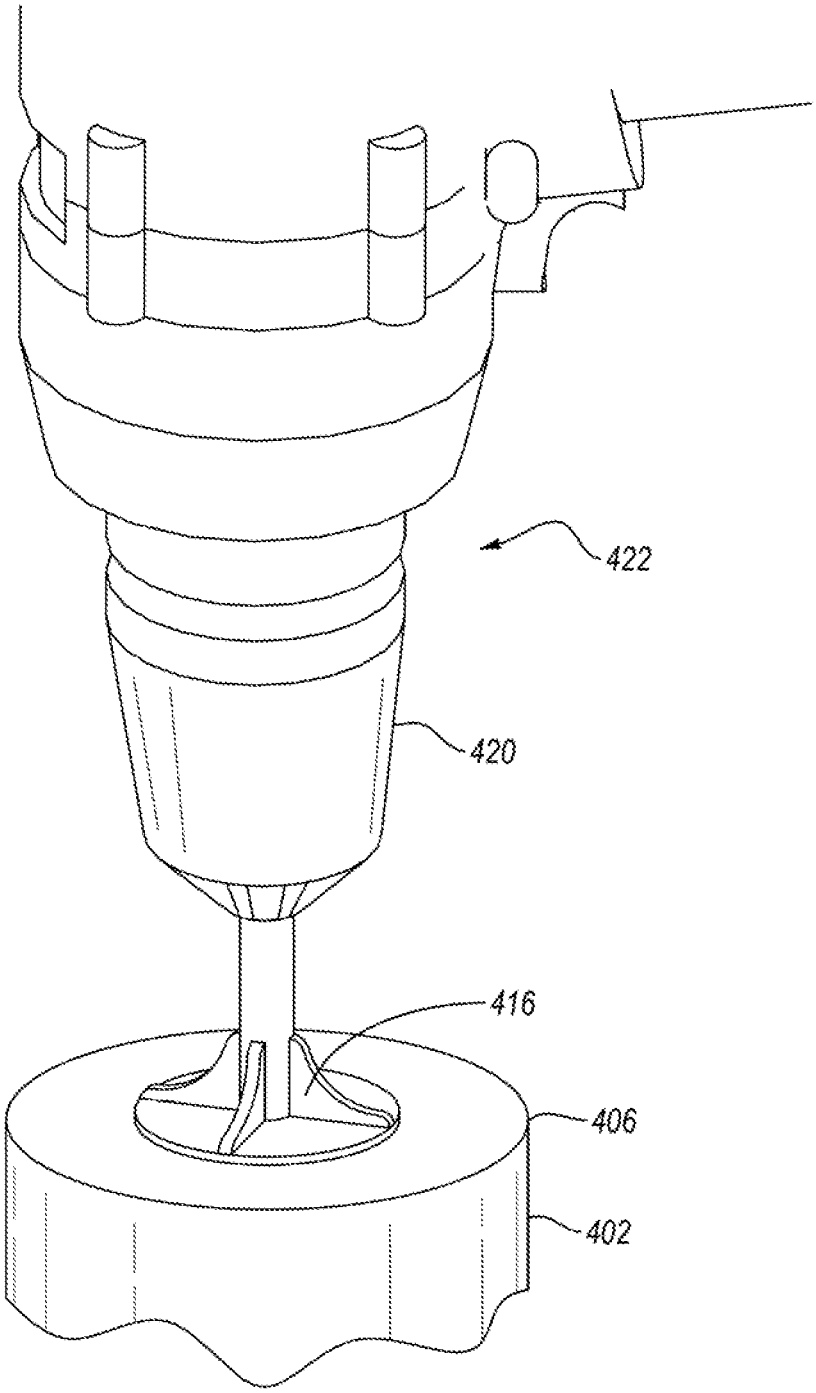
FIG. 4C illustrates a bottom perspective view of a mixing apparatus and rotational device in a connected configuration according to an implementation of the present disclosure.

FIG. 4A illustrates a side perspective view of a mixing apparatus and aerosol can in an unloaded configuration according to an implementation of the present disclosure. FIG. 4B illustrates a side perspective view of a mixing apparatus and aerosol can in a loaded configuration according to an implementation of the present disclosure. FIG. 4C illustrates a bottom perspective view of a mixing apparatus and rotational device in a connected configuration according to an implementation of the present disclosure.

Referring to FIGS. 4A-4C, a mixing apparatus 400 includes a main body or housing 402, a first end 404, a second end 406, a lumen or bore 408 extending from the first end 404 to the closed second end 406. The second end 406 of the main body 402 has a substantially flat base. A shaft 410 is arranged at an orthogonal configuration relative to the flat base of second end 406. The shaft 410 is configured and sized to be inserted into a receiving portion of a rotational device. The receiving portion of the rotational device 422 is a chuck or a specialized type of clamp 420 configured to releasable hold at least a portion of the shaft 410. The chuck or clamp 422 or other attachment mechanism as known in the art is used to hold an object with radial symmetry, e.g., a cylinder.

The housing 402 is configured to hold at least a portion of container (not shown) and the container is arranged at least partially within a bore 408 of the main body 402. The main body 402 may be configured into any geometrical configuration with radial symmetry and in this implementation is configured with a substantial cylindrical geometry. Optionally, the main body has an offset in a range from about 1 degree to about 5 degrees as described herein.

The main body 402 can have a length 405 in a range from about 10 mm to about 250 mm or more. In this implementation, the length 405 is about 140 mm. The main body 402 can have an inside diameter 403 in a range of about 1 mm to about 150 mm at the first end 404. In this implementation, the main body 402 has an inside diameter 403 of about 80 mm at the first end 404.

An aerosol container 407 is used as the container in this implementation. Typical aerosol containers have a length of about 100 mm to about 200 mm or more (with cap 415 where the cap is typically about 30 mm or greater) and an outside diameter in a range from about 5 mm to about 150 mm or greater. The outside diameter 411 is about 70 mm. The length 409 in this implementation is about 200 mm and outside diameter 411 of about 200 mm.

This leaves a total of about 10 mm of extra space between an outside diameter 411 of the can and inside diameter 403 of the main body 402 or about 5 mm on each side. Extra space of about 5 mm or greater allows a user to utilized different diameter containers readily. In one implementation, the total extra space between the inside diameter 403 of the main body 402 and the outside diameter 411 of the container 407 is in a range from about 1 mm to about 15 mm or greater.

Referring to FIG. 4B, the length 413 is about 65 mm, which is the length of the container sticking out from the lumen 408 of mixing apparatus 400 when the mixing container is fully seated in the lumen 408. In another implementation, the length 413 of the container 407 remaining outside the lumen 408 of the main body 402 is about one quarter or less the total length 409 of the container with a cap 415, it is believed leaving this amount length of the container inside and outside the lumen 408 provides adequate support of the main body sidewalls to support the container without physically coupling the container to the main body during operation. It is further believed the forces holding the container in place during operation include a gravitation force and centrifugal force. There is no physical securing device to attach the container to the mixing unit. Optionally, the length 405 of the main body 402 can be greater than the length 409 of the container, equal to or any size less than the container length 409. Optionally, the mixing apparatus can be utilized with a container having no cap or cap 415 removed from the container 407.

In this implementation, four supporting members 416 are used to support the shaft 410. The supporting members 416 are coequally spaced apart from each other in a radial configuration. The shaft 110 and main body are constructed from the same materials.

Figure 5:
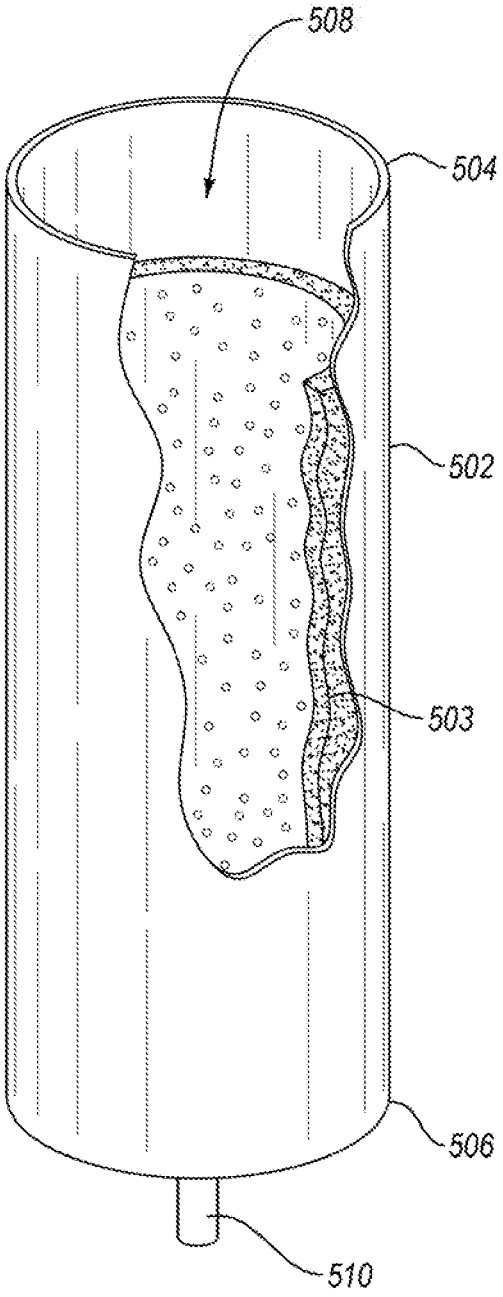
FIG. 5 illustrates a side perspective and partial cross-sectional view of a mixing apparatus according to an implementation of the present disclosure.

FIG. 5 illustrates a side perspective and partial cross-sectional view of a mixing apparatus according to an implementation of the present disclosure.

Referring to FIG. 5, the mixing apparatus 500 includes a main body or housing 502, a first end 504, a second end 506, a lumen or bore 508 extending from the first end 504 to the closed second end 506. The second end 506 of the main body 502 has a substantially flat base. A shaft 510 is arranged at an orthogonal configuration relative to the flat base of second end 506. The shaft 510 is configured and sized to be inserted into a receiving portion of a rotational device. The receiving portion of the rotational device 422 is a chuck or a specialized type of clamp configured to releasable hold at least a portion of the shaft 510. The chuck or clamp or other attachment mechanism as known in the art is used to hold an object with radial symmetry, e.g., a cylinder.

The housing 502 is configured to hold at least a portion of a container (not shown) and the container is arranged at least partially within a bore 508 of the main body 502. The main body 502 may be configured into any geometrical configuration with radial symmetry and in this implementation is configured with a substantial cylindrical geometry. Optionally, the main body has an offset in a range from about 1 degree to about 5 degrees as described herein.

In this implementation, the main body 502 further includes an insert material, coating, or combinations of the same 503. The material of insert material 503 may include one or more of, e.g., rubber, compressible material, non-compressible material, open celled foam material, closed cell foam material, memory foam material, sponge material, or combinations of the same or the like. The coating and/or insert material as an insert material 503 may include a frictional material configured to provide greater frictional forces to permit more rapid rotation of the container during start up and upon turning off the rotational apparatus. The insert material 503 can have a thickness of about 1 mm to about 5 mm or greater and length that is the same of the main body 502 or less than the main body 502. The insert material 503 can be adhered to the inside diameter of the main body 502 with an adhesive material as known in the art.

In this implementation, the insert material 503 has a constant thickness and is continuous throughout its length and circumference. However, the thickness may not be constant throughout a longitudinal axis of the main body and can be tapered, linear increase or decrease, non-linear increase or decrease, or stepped. The inner surface of the insert material 503 may also have a geometric pattern, raise portions, and non-raised portions, e.g., bumps, lines, any geometric shape and combinations of the same, on its surface. The insert material may also be any geometric pattern as one or more insert materials 503, e.g., any number of concentric rings of insert material, e.g., 1 or more. In one implementation, the insert material 503 includes two concentric rings of material one at or near the second end 506 and one at near the first end 504, thereby creating a discontinuity between the two insert materials 503.

The thickness of the insert material can be sized such that an inside diameter of the insert material 503 is about the same dimension, e.g., about 0.001 mm to about 2 mm or greater than an outside diameter of the container or inside diameter can even be less than an outside diameter of the container, thereby creating an interference fit with the container, such that some external force (other than gravity) is required to place or seat the container fully within a lumen 508 of the main bore 508 of the container 502. Also, as described herein, the inside diameter may be less than the outside diameter of the container, thereby creating a space between the outside dimension of the container and inside diameter of the insert 503, e.g., 2 mm or greater, between the outside diameter of the container and inside diameter of the insert material. In such configuration, different containers with different outside dimensions can be utilized with the same mixing apparatus.

Figure 6A:
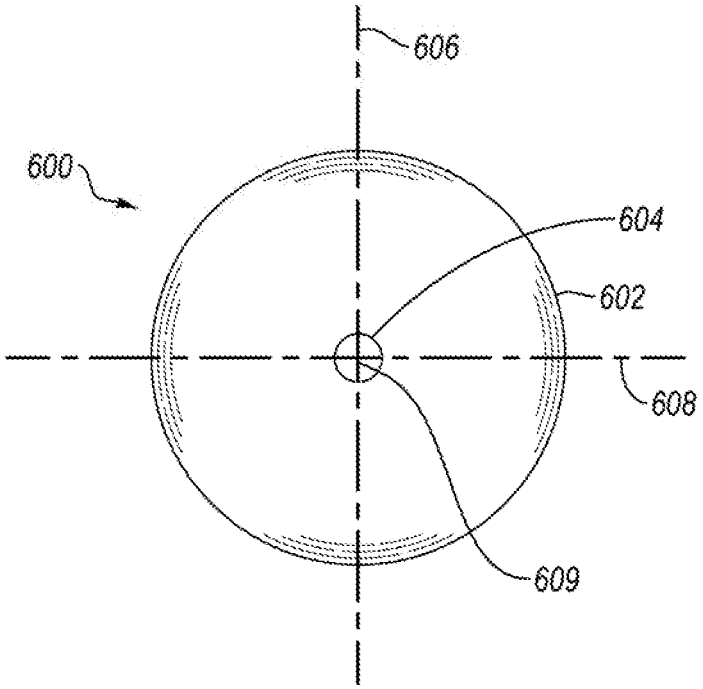
FIG. 6A illustrates a bottom view of a mixing apparatus according to an implementation of the present disclosure.
Figure 6B:
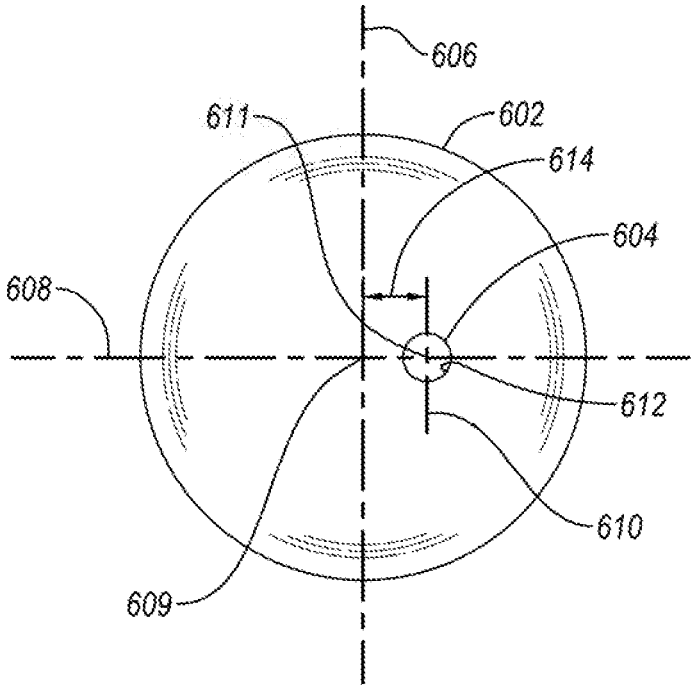
FIG. 6B illustrates a bottom view of a mixing apparatus according to an implementation of the present disclosure.

FIG. 6A illustrates a bottom view of a mixing apparatus according to an implementation of the present disclosure. FIG. 6B illustrates a bottom view of a mixing apparatus according to an implementation of the present disclosure.

Referring to FIG. 6A, illustrating a bottom view of mixing apparatus 600 described herein. As explained herein the mixing apparatus includes a main body or housing 602, a first end, a second end, a lumen or bore extending from the first end to the closed second end. The second end of the main body 502 has a substantially flat base. A shaft 604 is arranged at an orthogonal configuration relative to the flat base of second end. The shaft 604 is configured and sized to be inserted into a receiving portion of a rotational device. The receiving portion of the rotational device is a chuck or a specialized type of clamp configured to releasable hold at least a portion of the shaft 604. The chuck or clamp or other attachment mechanism as known in the art is used to hold an object with radial symmetry, e.g., a cylinder. The main body 602 includes a y-axis 606, x-axis 608 and a center most portion 609 of the main body 602 is at an intersection of y-axis 606 and x-axis 608 is shown in FIG. 6A. In this implementation the shaft 604 has a center that is centered with the center 609 of the main body. That is, there is no offset and the lack of offset allows the mixing apparatus to spin in wobble free configuration.

Referring to FIG. 6B, in this implementation, the shaft 604 is in an offset orientation relative to a center 609 of the main body 602 or other connection mechanism. A center 611 of a shaft 604 is defined by an intersection of an x-axis 612 and y-axis 610 of the shaft 604. In this configuration, the offset 614 is measured from a center 609 of the main body 602 to a center 611 of the shaft 604 or other rotational connection mechanism described herein and is a range from about 0.001 mm to about 8 mm. When an offset 614 is utilized the main body wobbles during operation of the mixing apparatus. The larger the offset 614 the greater the wobble during operation can impart greater agitation to a container during operation of the mixing apparatus. It is believed that using an offset 614 may impart a faster rate of mixing the contents of container than using a mixing apparatus without the offset 614. This may be useful for mixing highly viscous contents in a container, e.g., glue or heavy pigmented products.

Figure 7A:
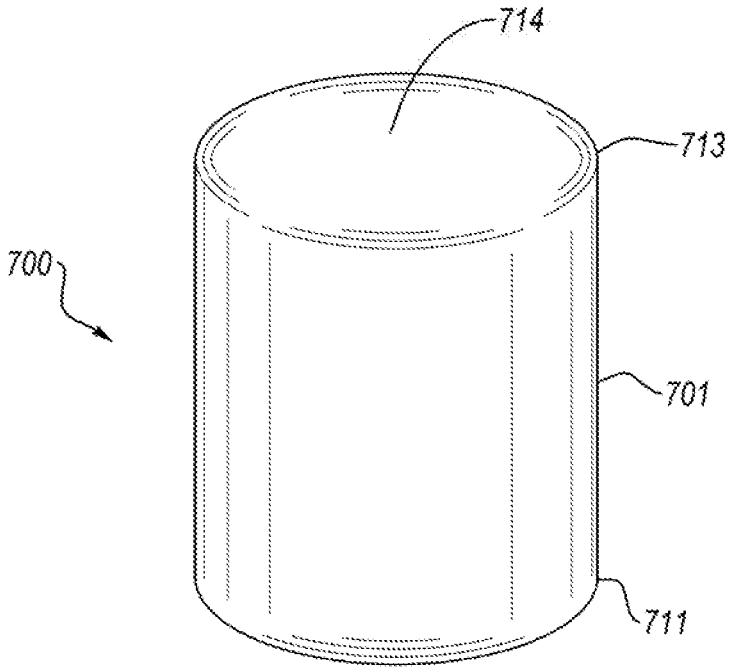
FIG. 7A illustrates a side perspective view of a cap for a mixing apparatus according to an implementation of the present disclosure.
Figure 7B:
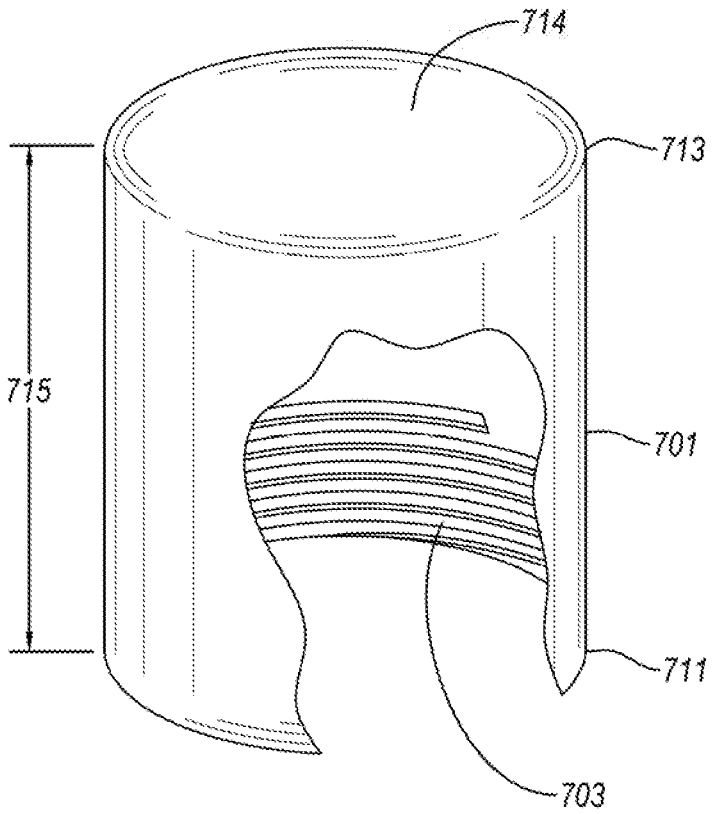
FIG. 7B illustrates a side perspective and partial cross-sectional view of a cap for a mixing apparatus according to an implementation of the present disclosure.
Figure 7C:
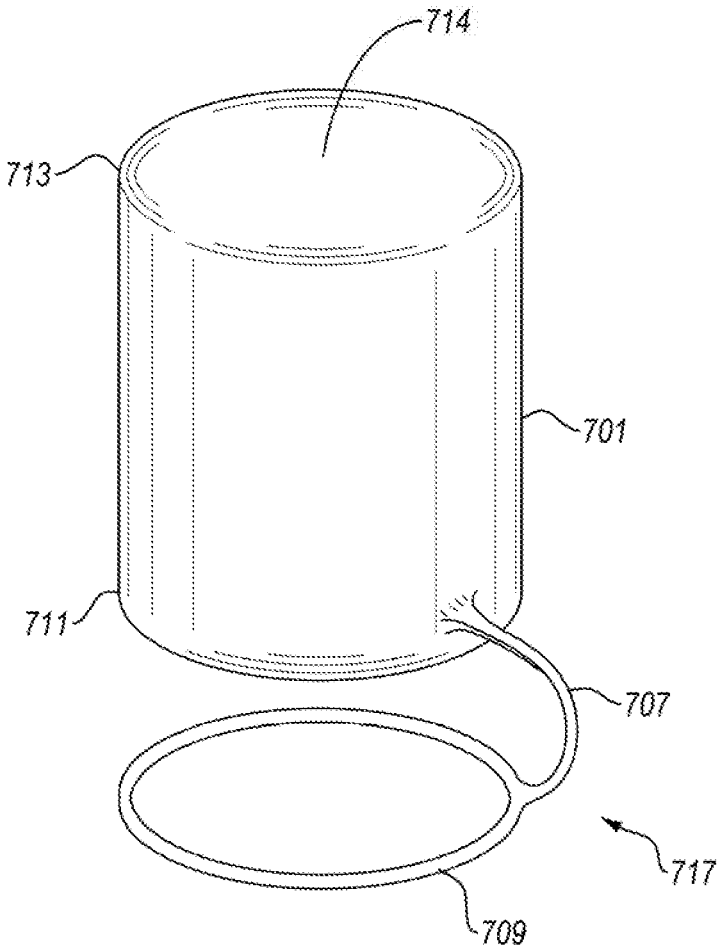
FIG. 7C illustrates a side perspective view of a cap for a mixing apparatus according to an implementation of the present disclosure.
Figure 7D:
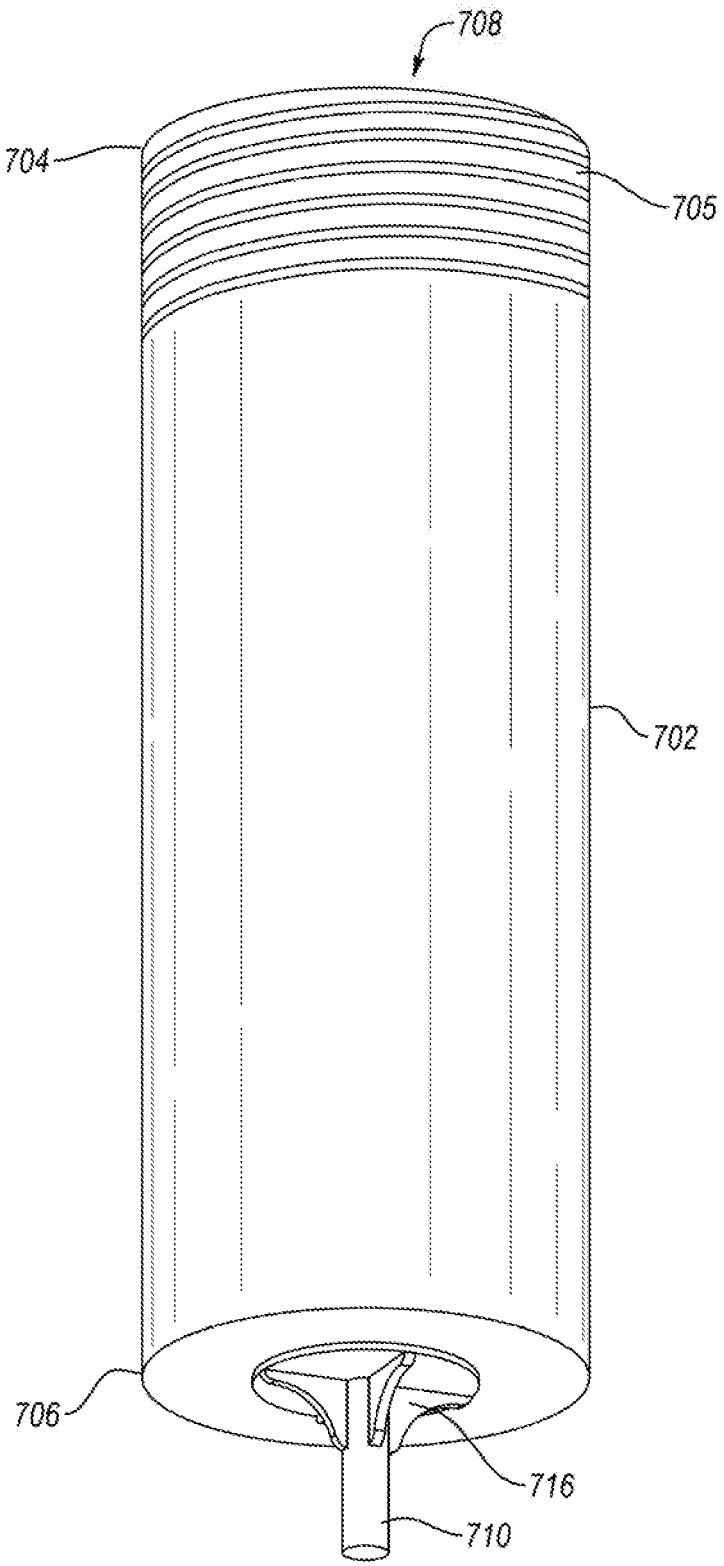
FIG. 7D illustrates a side perspective view of a mixing apparatus according to an implementation of the present disclosure.
Figure 7E:
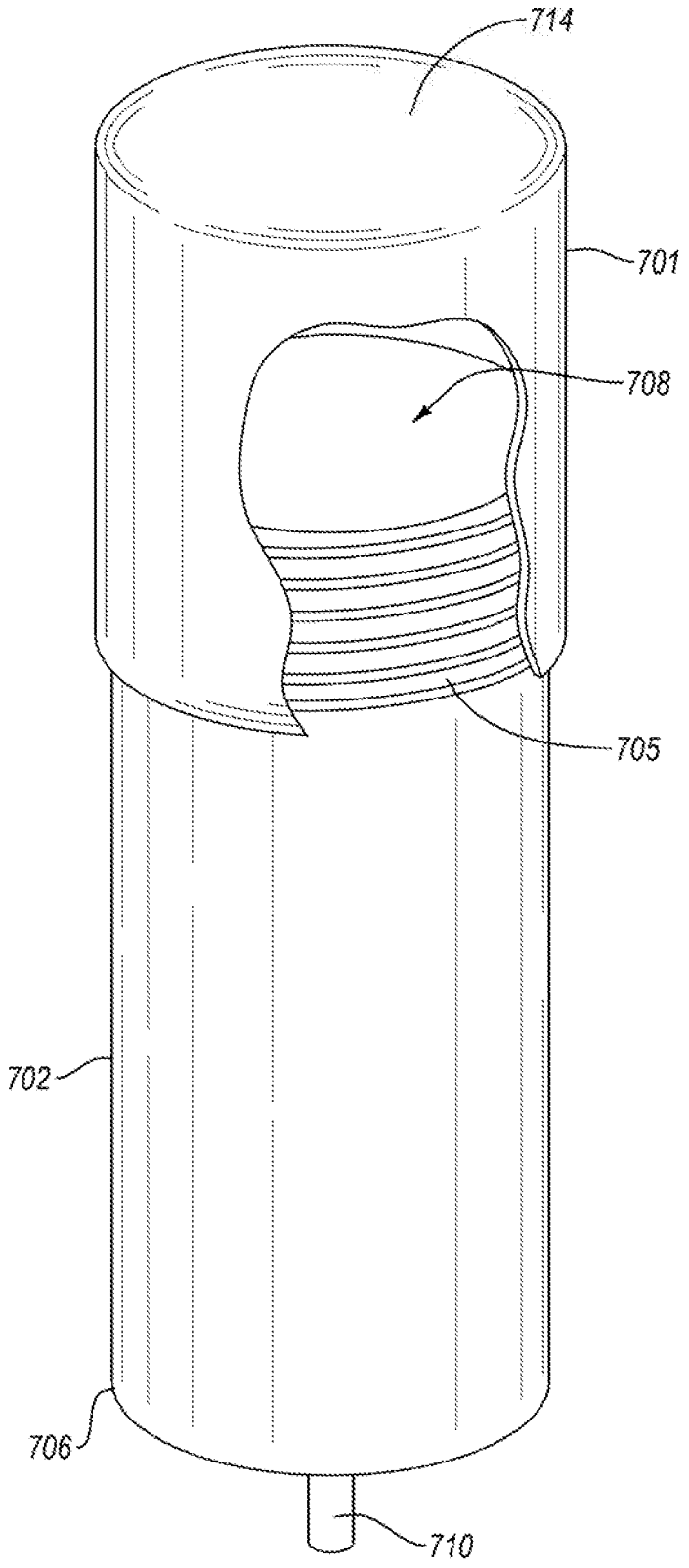
FIG. 7E illustrates a side perspective and partial cross-sectional view of a cap and mixing apparatus according to an implementation of the present disclosure.
Figure 7F:
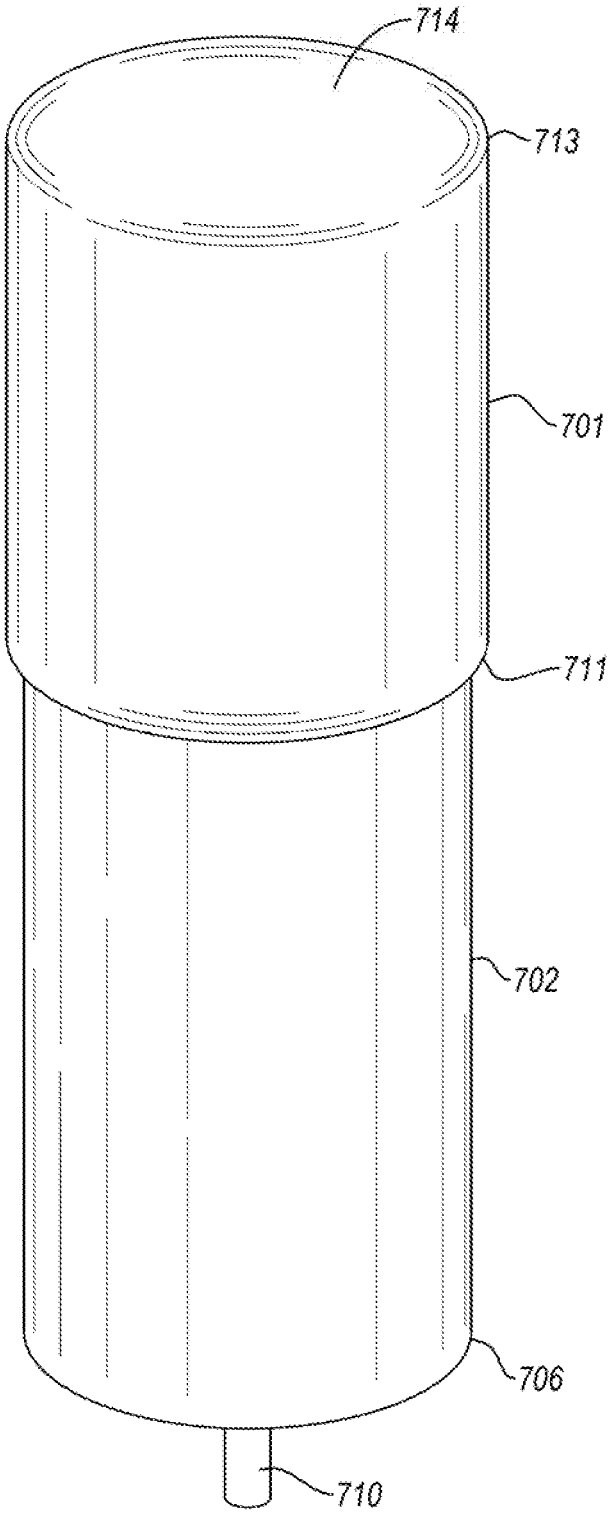
FIG. 7F illustrates a side perspective and partial cross-sectional view of a cap and mixing apparatus according to an implementation of the present disclosure.

FIG. 7A illustrates a side perspective view of a cap for a mixing apparatus according to an implementation of the present disclosure. FIG. 7B illustrates a side perspective and partial cross-sectional view of a cap for a mixing apparatus according to an implementation of the present disclosure. FIG. 7C illustrates a side perspective view of a cap for a mixing apparatus according to an implementation of the present disclosure. FIG. 7D illustrates a side perspective view of a mixing apparatus according to an implementation of the present disclosure. FIG. 7E illustrates a side perspective and partial cross-sectional view of a cap and mixing apparatus according to an implementation of the present disclosure. FIG. 7F illustrates a side perspective and partial cross-sectional view of a cap and mixing apparatus according to an implementation of the present disclosure.

Referring to FIGS. 7A-7F, a cap unit 701 can be added to the top of the mixing apparatus 700. In this implementation, the cap 701 includes diameter configured to fit over an outside diameter of the main body 702 of the mixing apparatus 700. In a preferred embodiment, the inside diameter of the cap 701 is about 1 mm to about 3 mm larger than the outside diameter of the main body 702 and is connected via compression fit. Optionally and/or alternatively, a connection mechanism 703 can be used with a connection 705, e.g., threads, on a main body 702 to releasably attach the cap 701 with threads 703 to the main body 702.

The cap 701 includes a first end of the cap 713 an upper portion of the cap, a second end of the cap 711, the top portion 714 of the cap 701 is concave to add strength to the cap and length 715 sized to cover a portion of the main body 702, e.g., 5 mm or greater of overlap in a preferred embodiment.

Optionally and/or alternatively as shown in FIG. 7C, a retaining mechanism 717 is coupled or releasably coupled to the cap 701 to prevent it from falling off the container. The retaining mechanism 717 includes a retaining ring 709 that has a diameter larger than the outer diameter of the main body 702. The ring 717 prevents the cap from falling off the main body and a cord or line 707 that is connected to the cap 701. The retaining mechanism 717 may be a separate component from the cap 701 or an integral unit or component with the cap 701, e.g., one single piece made via injection molding, laser welded, heat welded, sonic welded combinations of the same or other techniques as known art.

The apparatus 700 includes a main body or housing 702, a first end 704, a second end 706, a lumen or bore 708 extending from the first end 704 to the closed second end 706. The second end 706 of the main body 702 has a substantially flat base. A shaft 710 is arranged at an orthogonal configuration relative to the flat base of second end 706. The shaft 710 or other attachment mechanism described herein is configured and sized to be inserted into a receiving portion of a rotational device. The receiving portion of the rotational device is a chuck or a specialized type of clamp configured to releasable hold at least a portion of the shaft 710. The chuck or clamp or other attachment mechanism as known in the art is used to hold an object with radial symmetry, e.g., a cylinder.

The housing 702 is configured to hold at least a portion of container (not shown) and the container is arranged at least partially within a bore 708 of the main body 702. The main body 702 may be configured into any geometrical configuration with radial symmetry and in this implementation is configured with a substantial cylindrical geometry. Optionally, the main body has an offset in a range from about 1 degree to about 5 degrees as described herein.

In this implementation, four supporting members 716 are used to support the shaft 710. The supporting members 716 are coequally spaced apart from each other in a radial configuration. The shaft 710 and main body are constructed from the same materials.

Figure 8A:
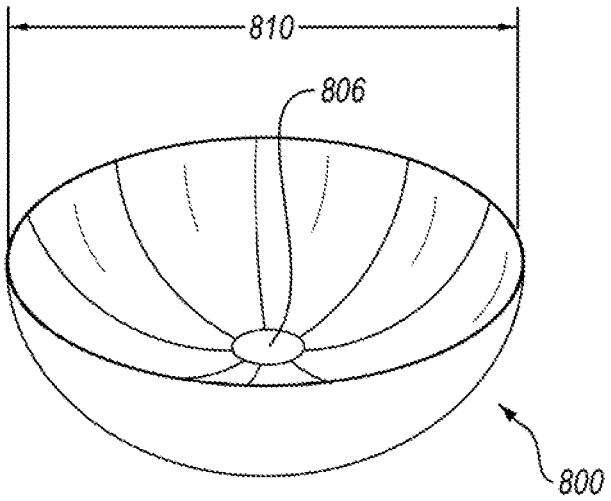
FIG. 8A illustrates a side perspective view of a restraining unit for a mixing apparatus according to an implementation of the present disclosure.
Figure 8B:
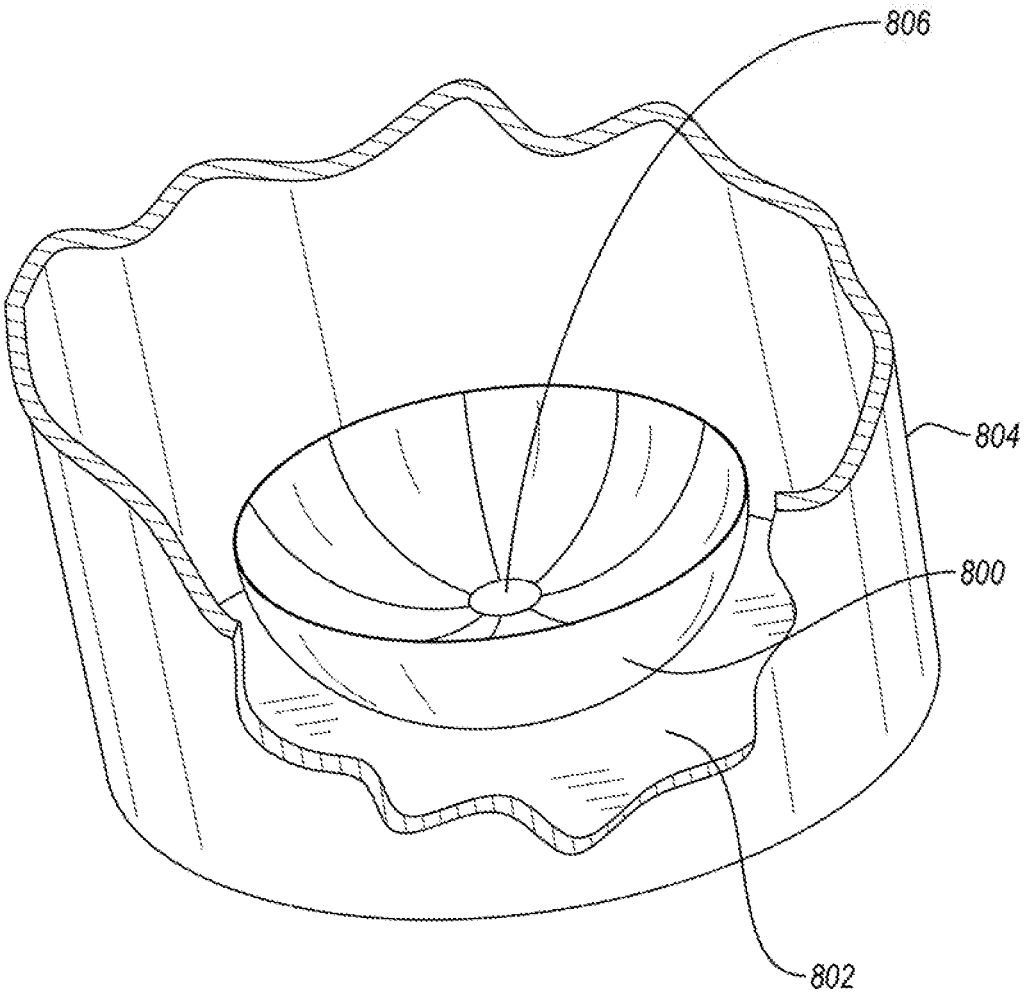
FIG. 8B illustrates a side perspective and partial cross-sectional view of a restraining unit and mixing apparatus according to an implementation of the present disclosure.

FIG. 8A illustrates a side perspective view of a restraining unit for a mixing apparatus according to an implementation of the present disclosure. FIG. 8B illustrates a side perspective and partial cross-sectional view of a restraining unit and mixing apparatus according to an implementation of the present disclosure.

Referring to FIGS. 8A-8B, a suction cup 800 is generally described. The suction cup 800 is arranged and attached to inside portion of a base portion of the main body of the mixing apparatus described herein. The suction cup 800 includes an attachment point 806 at the center of the suction cup to couple to the base of a main body 804 of a mixing apparatus. In one implementation, the suction cup 800 is attached at the center of a mixing unit base 802 with commercial grade adhesives, attachment mechanism, screw, bolt, rivet, or other attachment mechanism and combinations. The diameter 810 of the suction cups 800 is sized so as to be able to attach to the bottom of an aerosol can. In a preferred embodiment, the geometry of the suction cup 800 includes a concave orientation and sized to attach to a bottom surface of a container.

A shaft is arranged at an orthogonal configuration relative to the flat base of the main body 804. The shaft or other attachment mechanism described herein is configured and sized to be inserted into a receiving portion of a rotational device. The receiving portion of the rotational device is a chuck or a specialized type of clamp configured to releasable hold at least a portion of the shaft. The chuck or clamp or other attachment mechanism as known in the art is used to hold an object with radial symmetry, e.g., a cylinder.

Figure 9A:
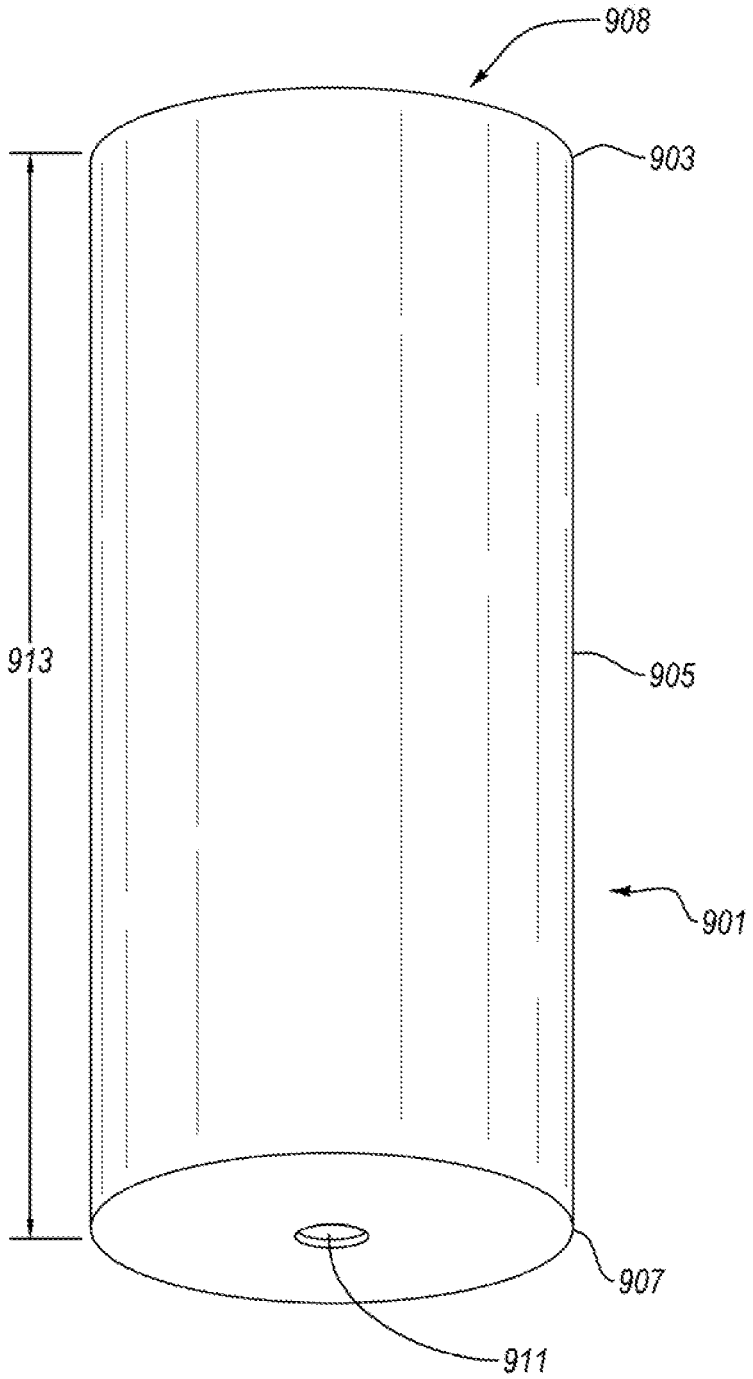
FIG. 9A illustrates a side perspective external unit from a mixing apparatus according to an implementation of the present disclosure.
Figure 9B:
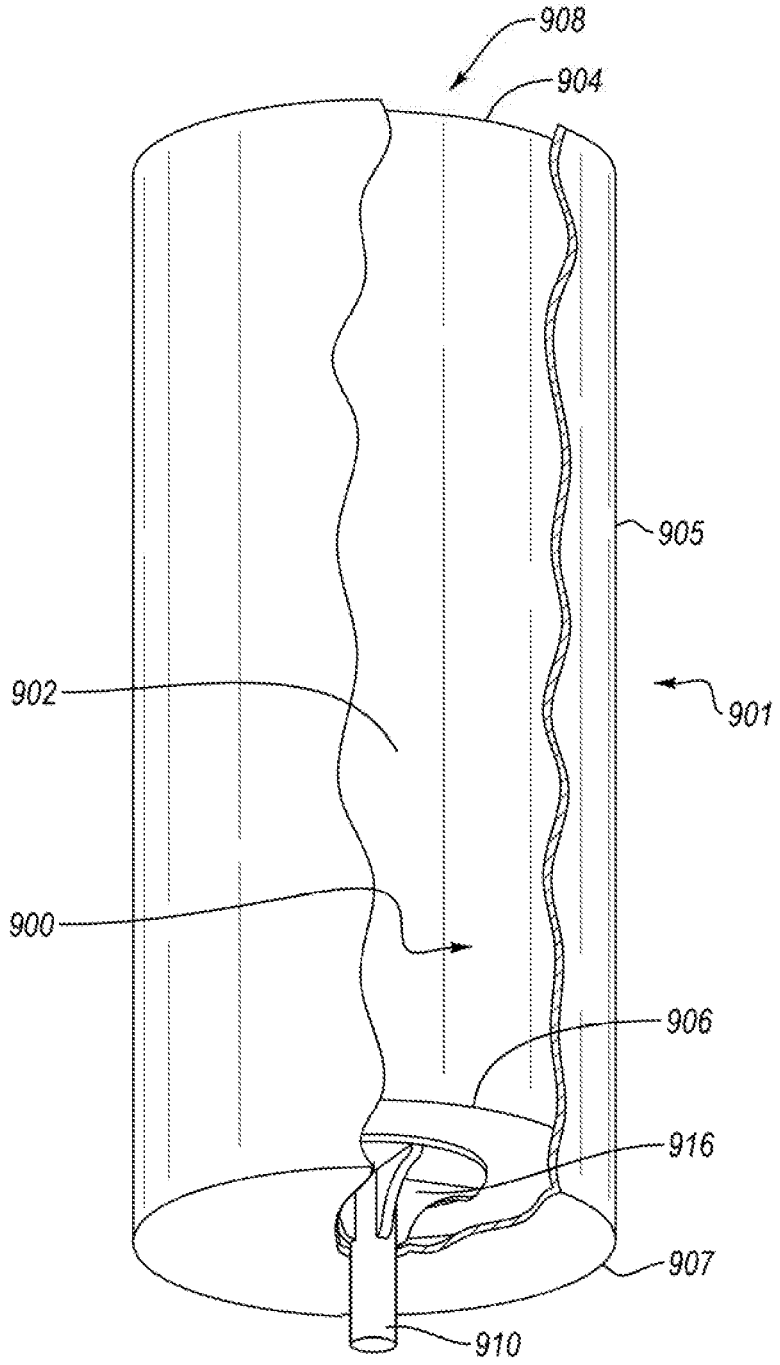
FIG. 9B illustrates a side perspective and partial cross-sectional view of the external unit of FIG. 9A and a mixing apparatus, according to an implementation of the present disclosure.
Figure 9C:
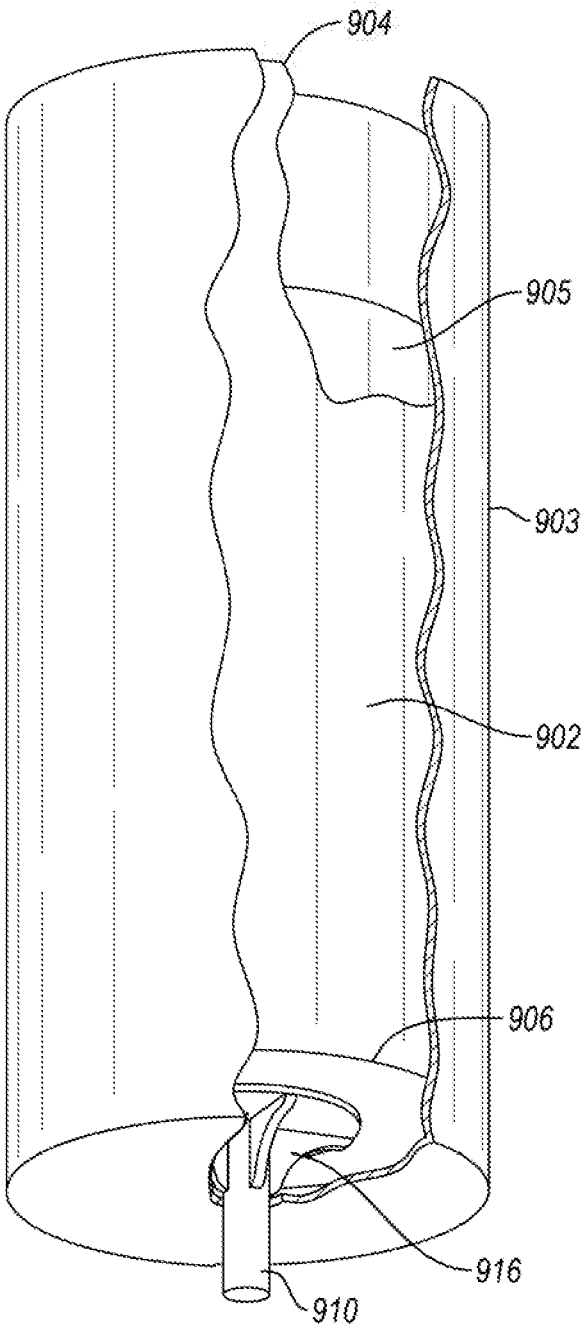
FIG. 9C illustrates a side perspective and partial cross-sectional view of the external unit of FIG. 9A, a mixing apparatus, and aerosol can, according to an implementation of the present disclosure.

FIG. 9A illustrates a side perspective external unit from a mixing apparatus according to an implementation of the present disclosure. FIG. 9B illustrates a side perspective and partial cross-sectional view of the external unit of FIG. 9A and a mixing apparatus, according to an implementation of the present disclosure. FIG. 9C illustrates a side perspective and partial cross-sectional view of the external unit of FIG. 9A, a mixing apparatus, and aerosol can, according to an implementation of the present disclosure.

Referring to FIGS. 9A-9C, a sleeve 901 is generally depicted, the sleeve or cover 901 includes a first open end 903, main body 905, bottom closed end 907, a lumen or bore 909 extending from the open end 903 to the closed end 907. The closed end includes an orifice 911. The sleeve 901 is sized and/or configured to fit over the main body 902 of a mixing apparatus 900 a drive shaft 910 fits though the hole in the bottom of the sleeve 901 and then a rotational device can be attached to the drive shaft 910. The orifice 911 is sized slide over a drive shaft 910 of the mixing apparatus 900. The lumen 908 is sized to receive the main body 902 of the mixing apparatus 900.

The mixing apparatus 900 includes a main body or housing 902, a first end 904, a second end 906, a lumen or bore 908 extending from the first end 904 to the closed second end 906. The second end 906 of the main body 902 has a substantially flat base. A shaft 910 is arranged at an orthogonal configuration relative to the flat base of second end 906.

The shaft 910 is configured and sized to be inserted into a receiving portion of a rotational device. The receiving portion of the rotational device is a chuck or a specialized type of clamp configured to releasable hold at least a portion of the shaft 910. The chuck or clamp or other attachment mechanism as known in the art is used to hold an object with radial symmetry, e.g., a cylinder. The main body 902 is configured to hold at least a portion of a container (not shown) and the container is arranged at least partially within a bore 908 of the main body 902. The main body 902 may be configured into any geometrical configuration with radial symmetry and in this implementation is configured with a substantial cylindrical geometry. Optionally, the main body has an offset in a range from about 1 degree to about 5 degrees as described herein.

In this implementation, four supporting members 916 are used to support the shaft 910. The supporting members 916 are coequally spaced apart from each other in a radial configuration. The shaft 910 and main body are constructed from the same materials.

The sleeve or cover 901 material includes a material such as a thermoplastic material, a rubber material, a cloth material, a fabric material, an open celled foam material, a closed cell foam material, combinations of the same and the like. The sleeve 901 is installed over the main body 902 to aid a user in the handling of the main apparatus while it rotates in a drill. In this implementation, the main body 902 of the mixing apparatus 900 is sized to a length longer than the container, e.g., aerosol spray container and cap 905. A sleeve 901 that is installed over the main apparatus to aid in the handling of the main apparatus while is rotates in a drill. The length 913 of the sleeve is sized to be about the same length of the main body 902 of the mixing apparatus 900. Optionally, the length 913 may be shorter or greater than the length of the main body 902 of the mixing apparatus 900.

Figure 10A:
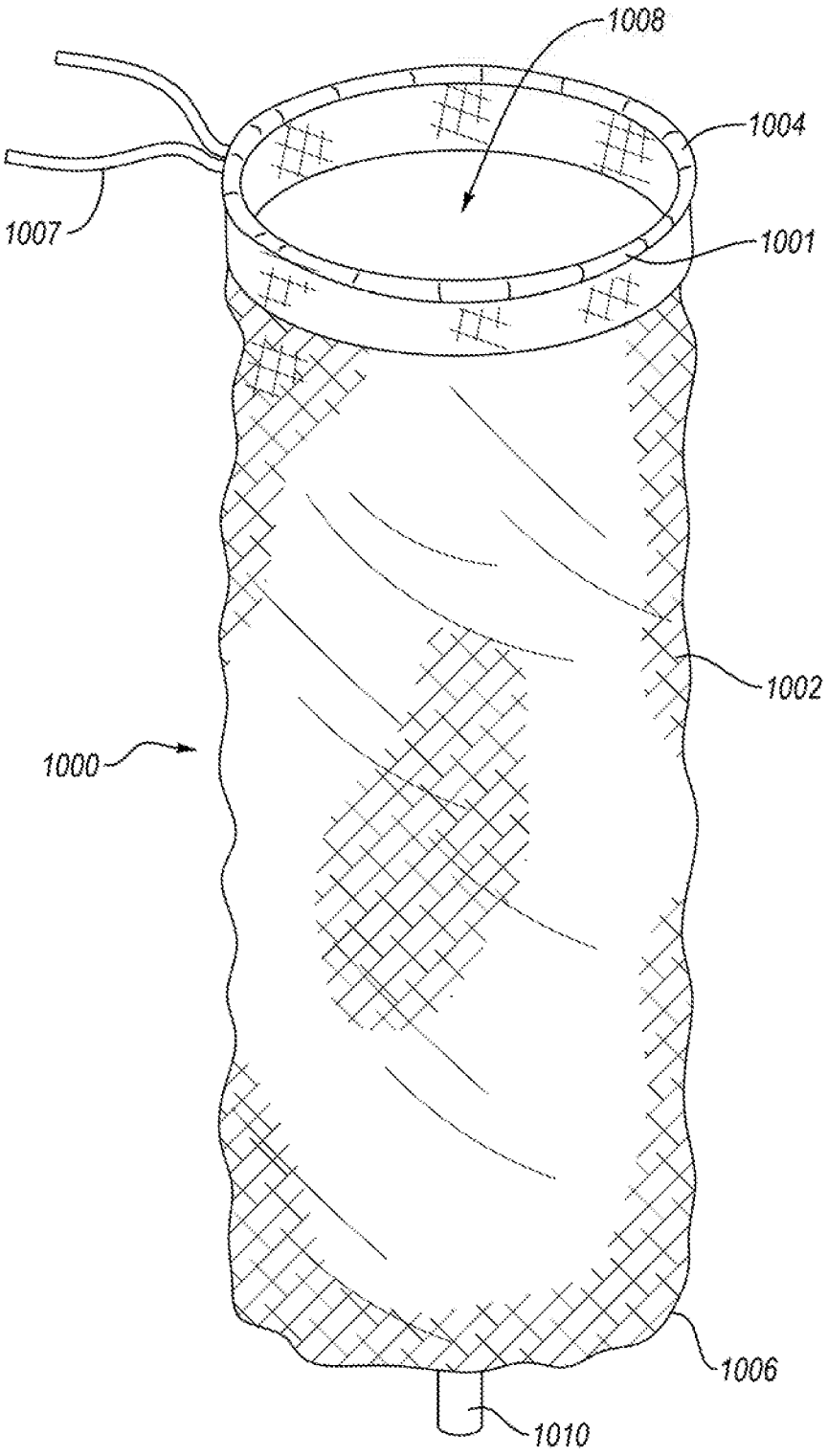
FIG. 10A illustrates a side perspective view of a mixing apparatus according to an implementation of the present disclosure.
Figure 10B:
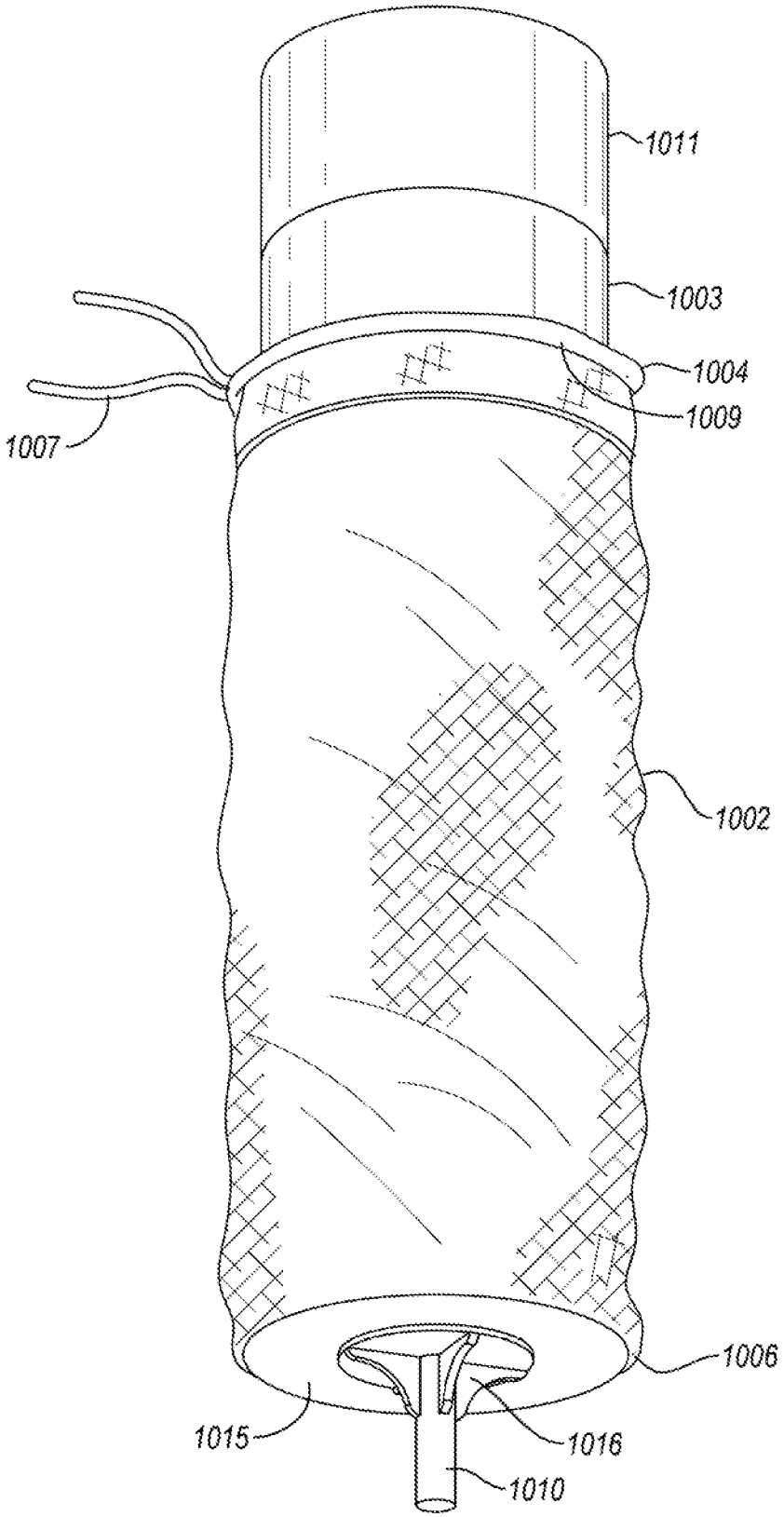
FIG. 10B illustrates a side perspective view of a mixing apparatus and loaded aerosol can in a first configuration according to an implementation of the present disclosure.
Figure 10C:
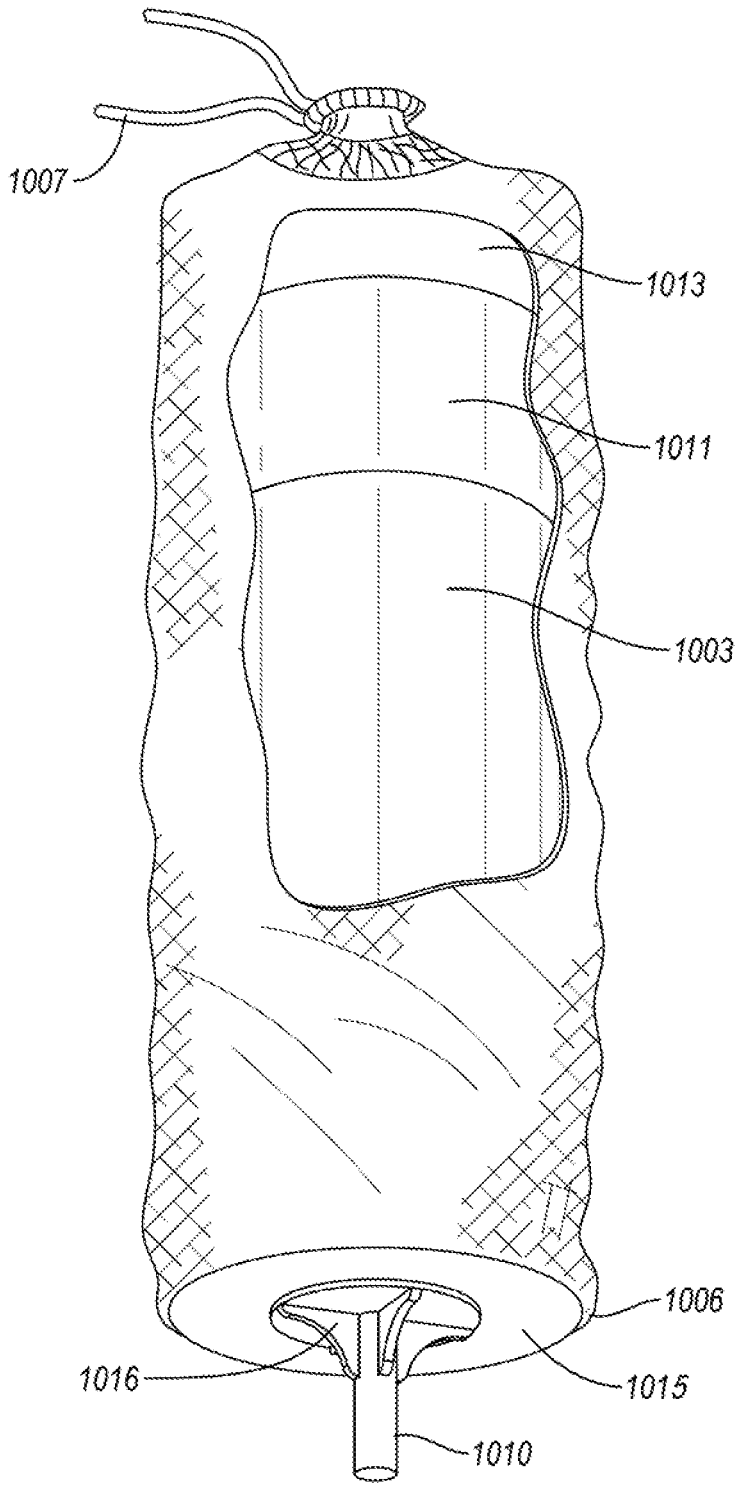
FIG. 10C illustrates a side perspective and partial cross-sectional view of a mixing apparatus and loaded aerosol can according to an implementation of the present disclosure.

FIG. 10A illustrates a side perspective view of a mixing apparatus according to an implementation of the present disclosure. FIG. 10B illustrates a side perspective view of a mixing apparatus and loaded aerosol can in a first configuration according to an implementation of the present disclosure. FIG. 10C illustrates a side perspective and partial cross-sectional view of a mixing apparatus and loaded aerosol can according to an implementation of the present disclosure. FIG. 10D illustrates a side perspective view of a mixing apparatus and loaded aerosol can according to an implementation of the present disclosure.

Referring to FIGS. 10A-10B, mixing unit 1000 has a main body 1002 is at least partially constructed from a flexible material, e.g., fabric material, thermoplastic, composite fabric material, and combinations of the same and the like. In this implementation, the side walls or circumferential portion of the main body 1002 includes the flexible material, e.g., an elastic fabric material. The flexible material of the side walls is attached to a hard base 1015 by adhesive, stitching, mechanical mechanisms, e.g., staples, welding, e.g., sonic welding, heat welding or other techniques known in the art. The elastic fabric self-tightens around a container 1003 when it is inserted into a lumen 1008 of the main body 1002. In a preferred embodiment, a high weave elastic band is used as the material. The higher quality of this fabric allows for more elongation. The inside diameter of the main body 1002 may be slightly equal to or less than an outside diameter of the container as the elastic material can stretch. However, the main body 1002 may also have an inside diameter larger than an outside container.

Optionally and/or alternatively, a first end 1004 of the main body 1002 of the main apparatus 1000 includes pull string 1007 to aid in additional securing of at least a portion material of the main body 1002 around a circumference of a container. In one implementation, the pull string 1007 can be optionally arranged in a lumen 1009 or partial lumen of material of the main body 1002. The pull string 1007 can be utilized to decrease or increase an inside diameter of the main body 1002 at the first end 1004 in area adjacent the pull string 1007. As shown in FIG. 10A, the pull string 1007 runs circumferentially around a top portion of the main body 1002 of the elastic material and is configured to be pulled and tightened around the aerosol can then secured by tying or some other convention releasable clip or mechanism utilized to prevent movement of the pull string 1007.

The mixing apparatus 1000 includes a main body or housing 1002, a first end 1004, a second end 1006, a lumen or bore 1008 extending from the first end 1004 to the closed second end 1006. The second end 1006 of the main body 1002 has a substantially flat base 1015 and can be constructed of a rigid or flexible material. In one implementation, the flexible material of the main body 1002 is attached to the rigid material 1015, e.g., thermoplastic material, metal, alloy, composite and combinations of the same and the like, with techniques known in the art laser welding, heat welding, mechanical mechanism, combinations of the same and the like.

A shaft 1010 is arranged at an orthogonal configuration relative to the flat base 1015 of second end 1006. The shaft 1010 is configured and sized to be inserted into a receiving portion of a rotational device. The receiving portion of the rotational device is a chuck or a specialized type of clamp configured to releasable hold at least a portion of the shaft 1010. The chuck or clamp or other attachment mechanism as known in the art is used to hold an object with radial symmetry, e.g., a cylinder. The main body 1002 is configured to hold at least a portion of container 1003 and the container is arranged at least partially within a bore 1008 of the main body 1002. Optionally, the main body has an offset in a range from about 1 degree to about 5 degrees as described herein.

In this implementation, four supporting members 1016 are used to support the shaft 1010. The supporting members 1016 are coequally spaced apart from each other in a radial configuration. The shaft 1010 and main body are constructed from the same materials.

The draw strings 1007 can be tightened around a circumference of the container 1003 arranged under a cap 1011 of the container to assist in securing an upper body of the aerosol can. However, it is noted, that the container 1003 can still move independently of the main body 1002 during operation of a rotational device.

Referring now to FIG. 10C, the length of the main body 1002 may be larger than a length of the container 1003. In this implementation, a pull string 1007 is configured to substantially close or close a lumen of the main body 1002 leaving a void space 1013 above the container 1003. In this configuration, the length allows full containment of the container 1003.

Figure 11A:
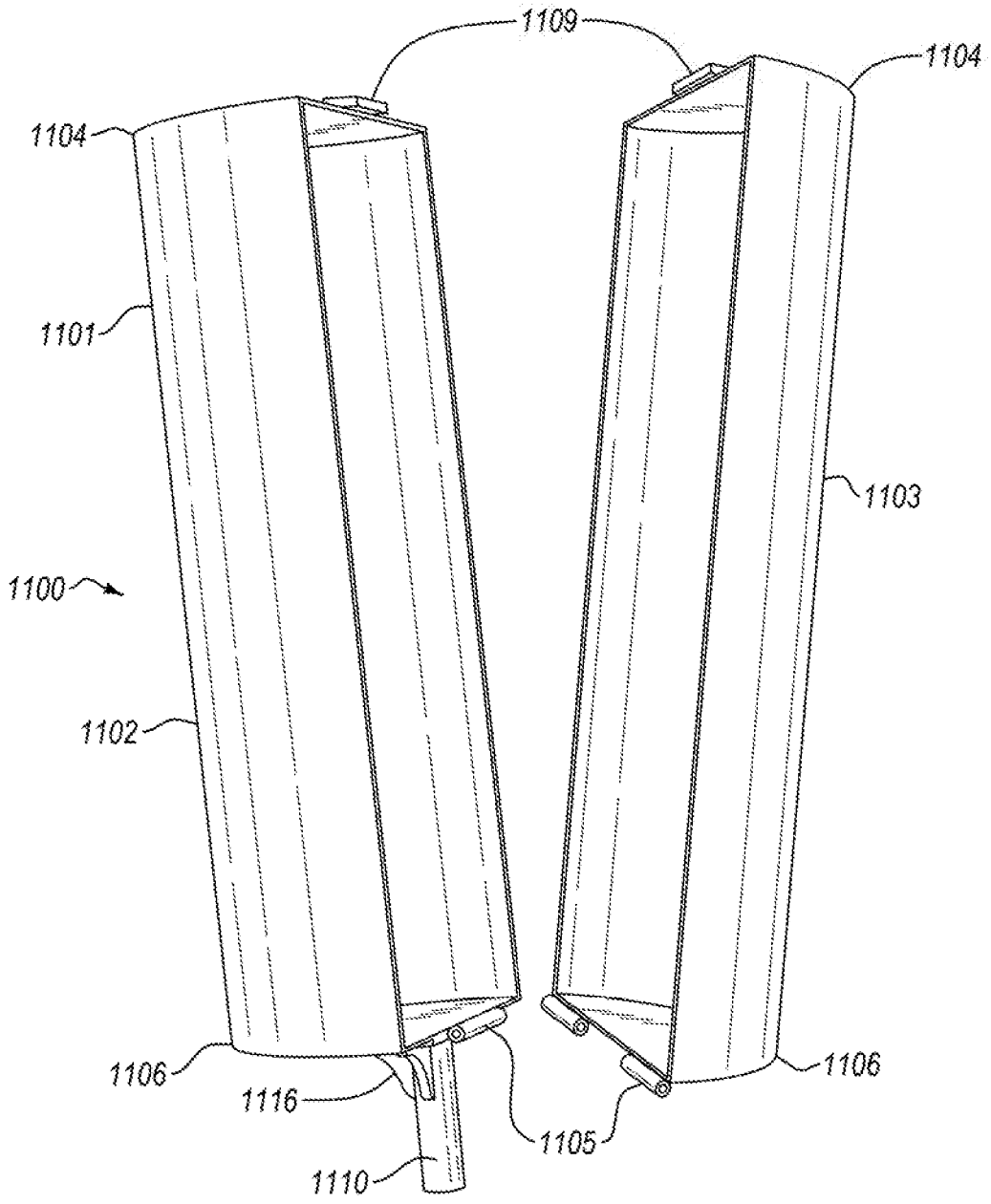
FIG. 11A illustrates a side perspective view of a mixing apparatus according to an implementation of the present disclosure.
Figure 11B:
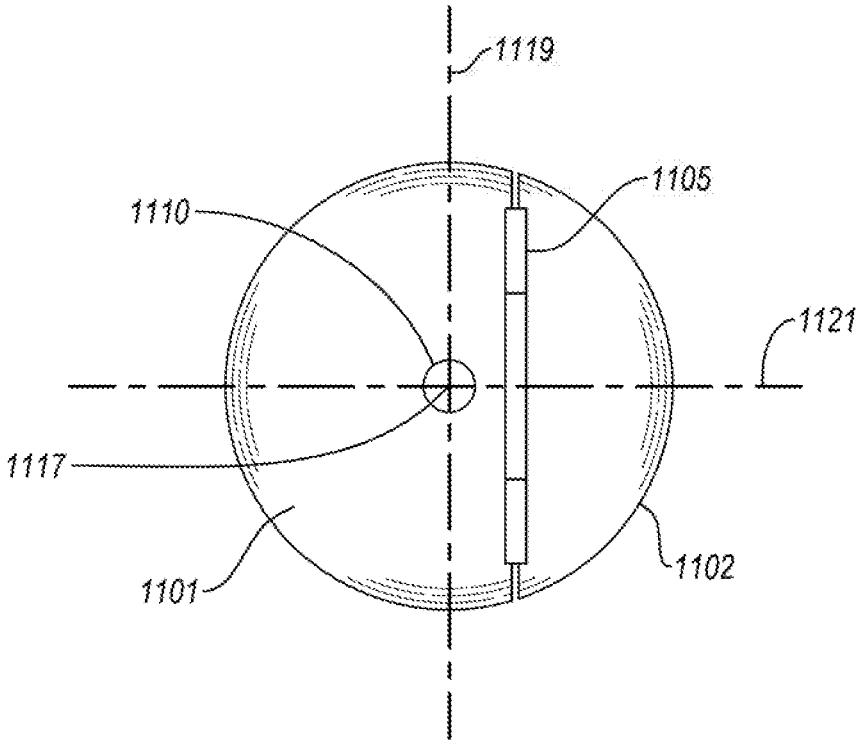
FIG. 11B illustrates a bottom view of the mixing apparatus of FIG. 11A, according to an implementation of the present disclosure.

FIG. 11A illustrates a side perspective view of a mixing apparatus according to an implementation of the present disclosure. FIG. 11B illustrates a bottom view of the mixing apparatus of FIG. 11A, according to an implementation of the present disclosure.

Figure 11C:
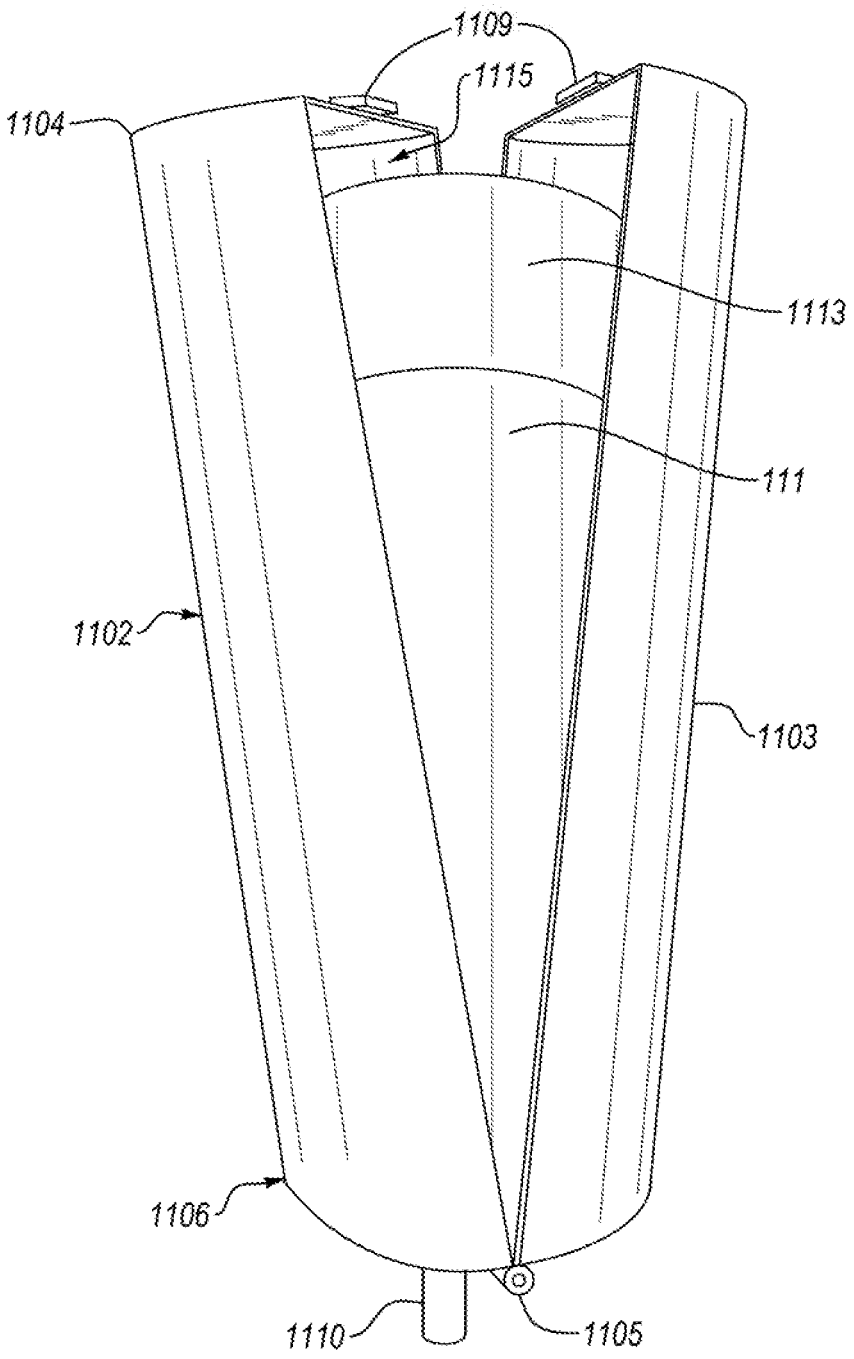
FIG. 11C illustrates a side view of the mixing apparatus of FIG. 11A with an aerosol, according to an implementation of the present disclosure.
Figure 11D:
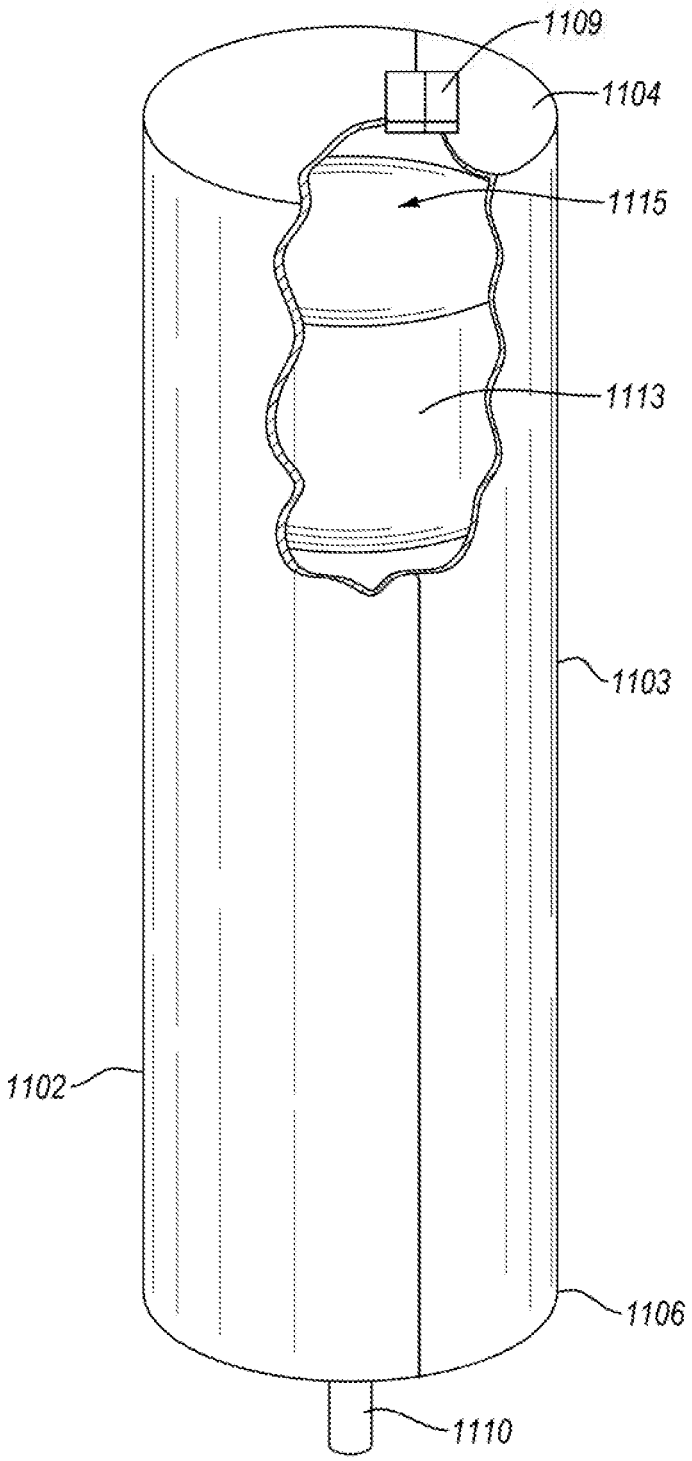
FIG. 11D illustrates a side perspective and partial cross-sectional view of the mixing apparatus of FIG. 11A with an aerosol, according to an implementation of the present disclosure.
Figure 11E:
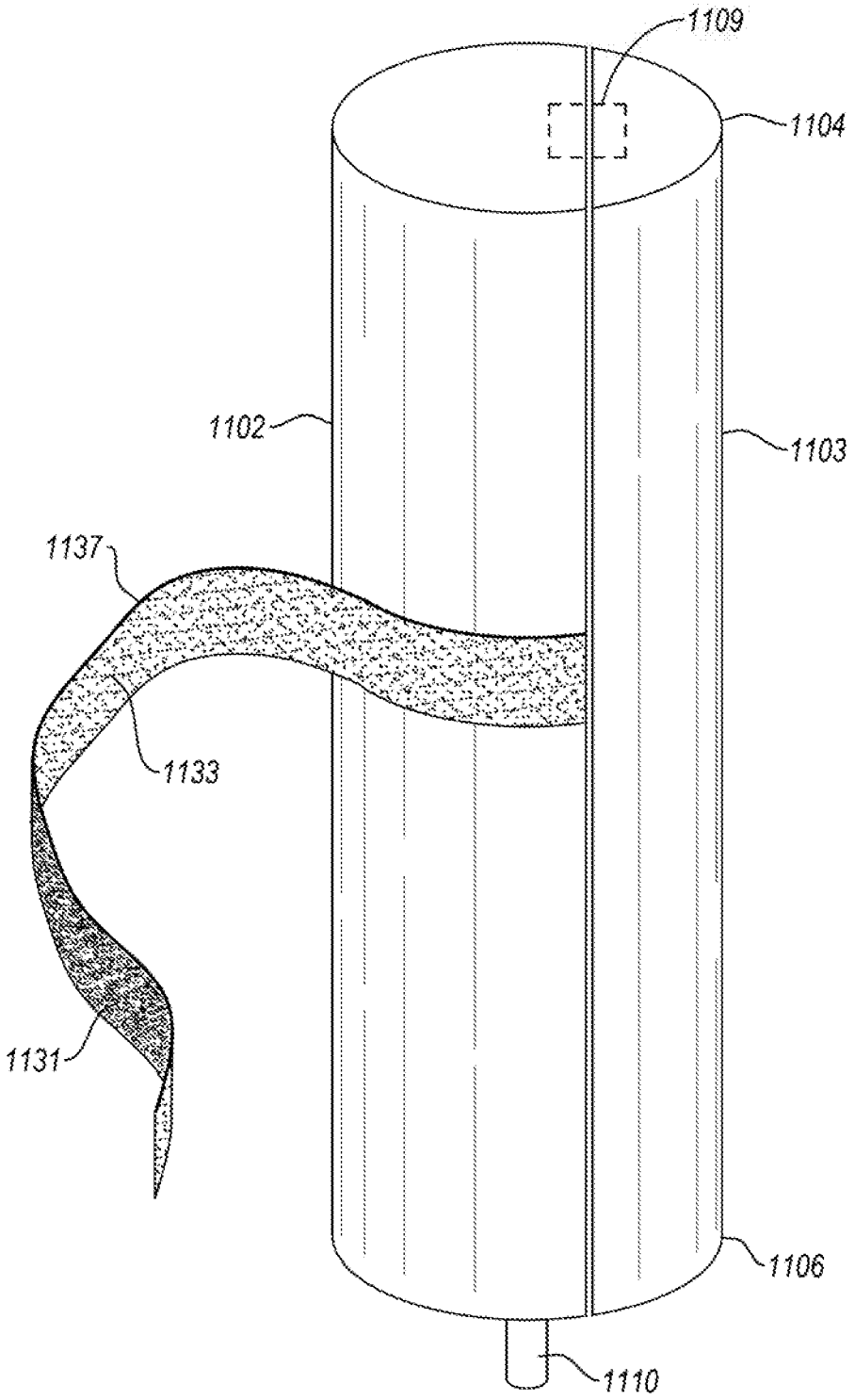
FIG. 11E illustrates a side perspective view of the mixing apparatus of FIG. 11A, according to an implementation of the present disclosure.

FIG. 11C illustrates a side view of the mixing apparatus of FIG. 11A with an aerosol can in a partial open configuration, according to an implementation of the present disclosure. FIG. 11D illustrates a side perspective and partial cross-sectional view of the mixing apparatus of FIG. 11A with an aerosol can in closed configuration, according to an implementation of the present disclosure. FIG. 11E illustrates a side perspective view of the mixing apparatus of FIG. 11A, according to an implementation of the present disclosure.

Figure 11F:
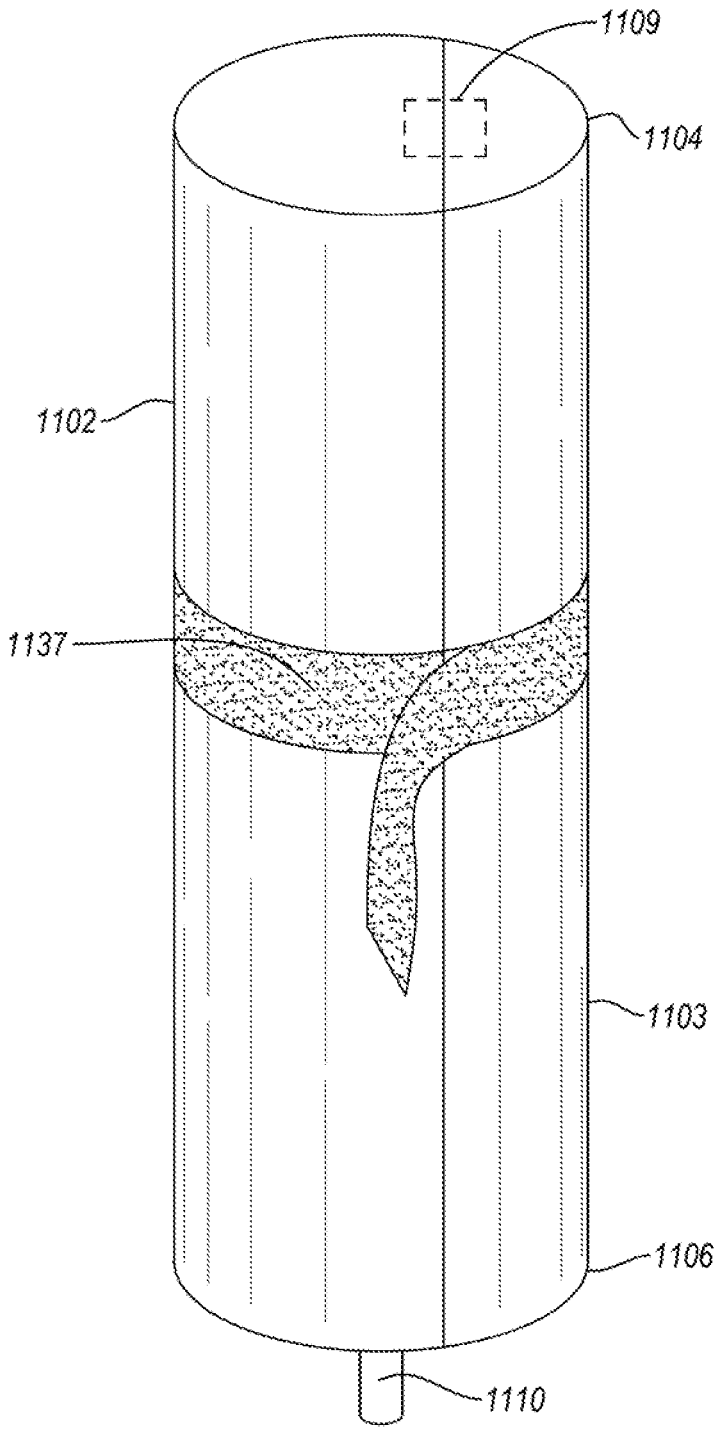
FIG. 11F illustrates a side perspective view of the mixing apparatus of FIG. 11A, according to an implementation of the present disclosure.

FIG. 11F illustrates a side perspective view of the mixing apparatus of FIG. 11A, according to an implementation of the present disclosure.

Referring to FIGS. 11A-11E, the mixing apparatus 1100 includes a main body or housing 1102, a first end 1104, and a second end 1106. The second end 1106 of the main body 1102 has a substantially flat base. A shaft 1110 is arranged at an orthogonal configuration relative to the flat base of second end 1106. The shaft 1110 is configured and sized to be inserted into a receiving portion of a rotational device. The receiving portion of the rotational device is a chuck or a specialized type of clamp configured to releasable hold at least a portion of the shaft 1110. The chuck or clamp or other attachment mechanism as known in the art is used to hold an object with radial symmetry, e.g., a cylinder.

The main body 1102 has a clam shell design having a first half 1101 of the main body 1102 and a second half 1103 of the main body 1101, e.g., split cylinder that opens and closes, so a container is able to be arranged into the mixing apparatus 1100 when in a closed configuration as shown in FIG. 11D. A mechanism, e.g., hinge mechanism 1105 or other suitable mechanism known in art, movably couples the first half 1101 of the main body 1102 to the second half 1103 of the main body 1102 in order to allow the first half 1101 and second half 1103 to move from a closed position shown in FIG. 11D to an open position shown in FIG. 11C. A closing mechanism 1109, e.g., clip or other latch, is used to secure the first half 1101 to the second half 1103 when in a closed position. This closing mechanism 1109 is strong enough to remain closed during rotation of the main body any RPM described herein. In this implementation, the container is an aerosol can 1111 having a cap 1113.

The first half 1101 and second half 1103 of the main body 1102 may be configured into any geometrical configuration as described herein, e.g., cylinder, oval, square, triangle, diamond, hexagon, pentagon, combinations of the same and the like. In closed configuration a void space 1115 is formed and the container can rotate or move independently of the main body 1102 as described herein.

Referring to FIG. 11B, the first half 1101 is larger than the second half 1103 in order to accommodate a drive shaft 1110 without an offset as described herein. The drive shaft 1110 is arranged at center 1117 of the y-axis 1119 and x-axis 1121 of the main body 1102 of the apparatus 1100. When the apparatus 1110 is closed, the top of the cylinder is fully enclosed to prevent the container from falling out of the main body. Alternatively, the first half 1101 and second half 1103 of the main body 1103 is split down the center to make two equal halves.

Referring now to FIG. 11E-11F, optionally and/or alternatively, a retaining strap 1137 having a first side 1133 and second side 1131 are arranged around an outside circumference of the main body 1102. The retaining strap 1137 can have an attachment mechanism to secure it to itself and/or the container, e.g., Velcro strap, buckle, combinations of the same or the like. One end 1132 of the strap can be permanently affixed or attached to one half of the main body 1102. In operation, the strap 1117 can wrap around the cylinder of the apparatus securing the two halves together so they make a complete enclosure that holds the container. In this implementation, a first side 1119 of the strap 1117 is the hook side of Velcro and a second side 1131 of the strap 1137 is loop side of the Velcro strap, or vice versa.

Figure 12A:
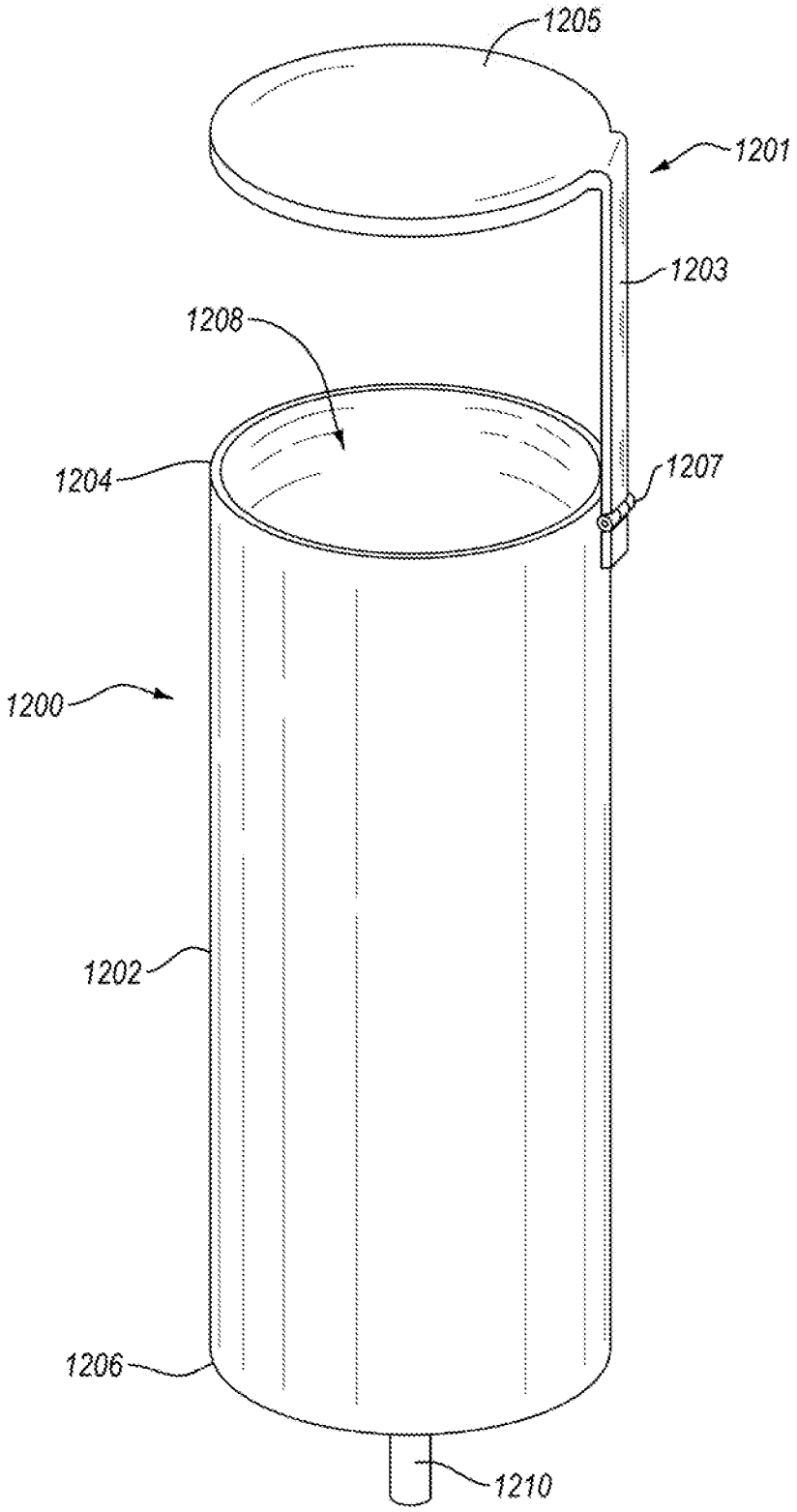
FIG. 12A illustrates a side perspective view of a mixing apparatus in a first configuration according to an implementation of the present disclosure.
Figure 12B:
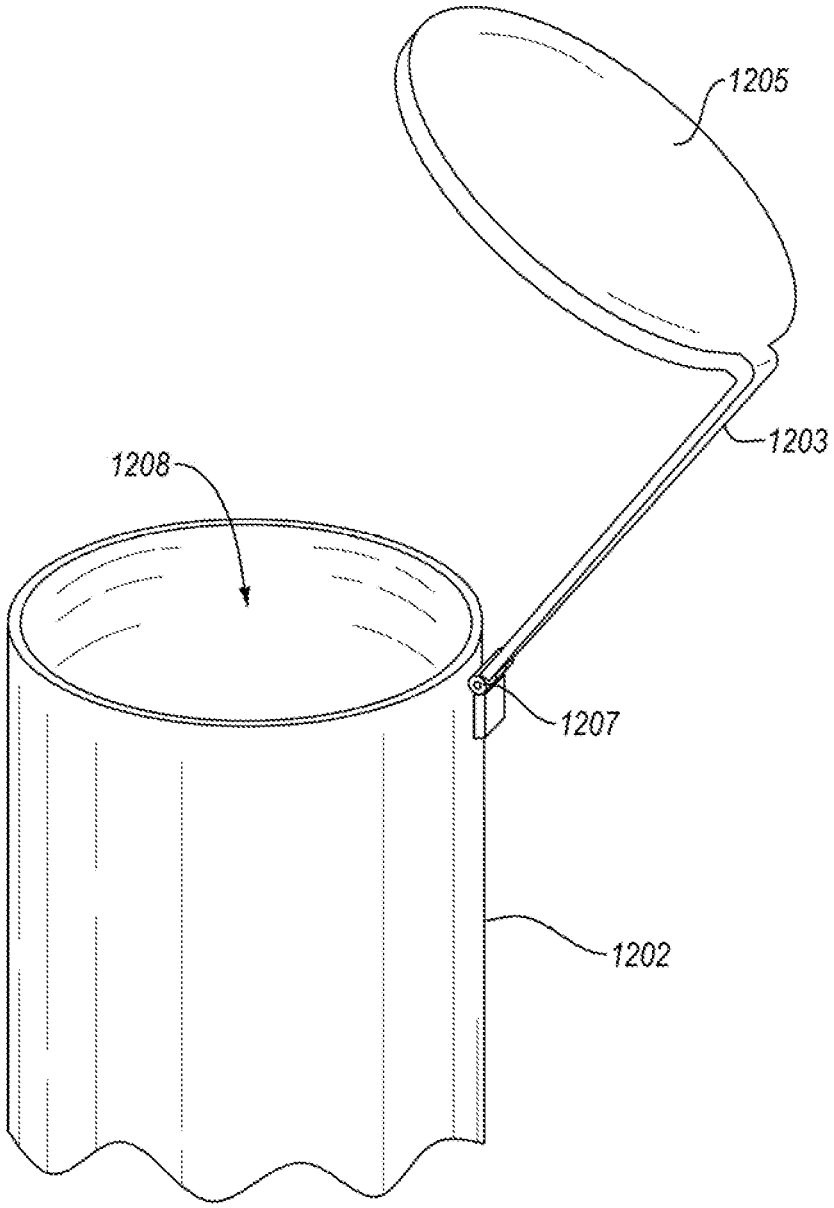
FIG. 12B illustrates a cross-sectional view of the mixing apparatus of FIG. 12A in a second configuration, according to an implementation of the present disclosure.
Figure 12C:
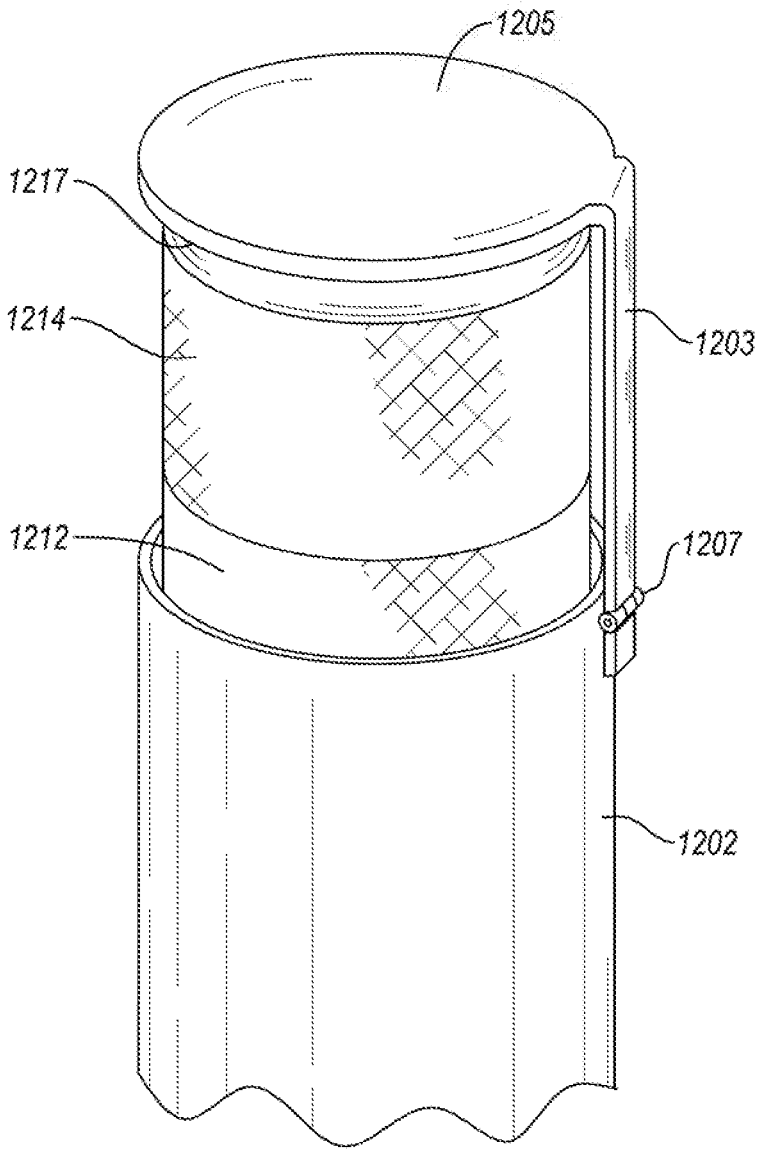
FIG. 12C illustrates a cross-sectional view of the mixing apparatus of FIG. 12A with a container, according to an implementation of the present disclosure.
Figure 12D:
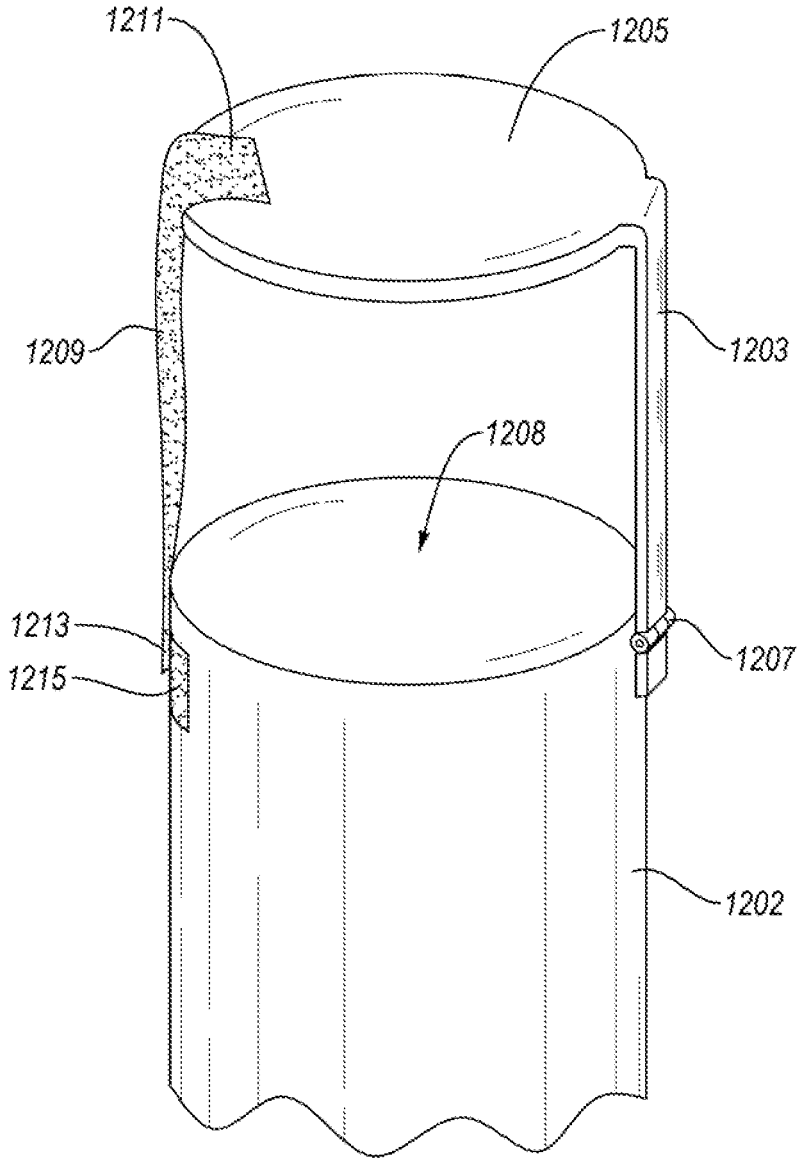
FIG. 12D illustrates a cross-sectional view of the mixing apparatus of FIG. 12A, according to an implementation of the present disclosure.

FIG. 12A illustrates a side perspective view of a mixing apparatus in a first configuration according to an implementation of the present disclosure. FIG. 12B illustrates a cross-sectional view of the mixing apparatus of FIG. 12A in a second configuration, according to an implementation of the present disclosure. FIG. 12C illustrates a cross-sectional view of the mixing apparatus of FIG. 12A with a container, according to an implementation of the present disclosure. FIG. 12D illustrates a cross-sectional view of the mixing apparatus of FIG. 12A, according to an implementation of the present disclosure.

Referring to FIGS. 12A-12D, the mixing apparatus 1200 includes a main body or housing 1202, a first end 1204, a second end 1206, a lumen or bore 1208 extending from the first end 1204 to the closed second end 1206. The second end 1206 of the main body 1202 has a substantially flat base. A shaft 1210 is arranged at an orthogonal configuration relative to the flat base of second end 1206. The shaft 1210 is configured and sized to be inserted into a receiving portion of a rotational device. The receiving portion of the rotational device (not shown) includes a chuck or a specialized type of clamp configured to releasable hold at least a portion of the shaft 1210. The chuck or clamp or other attachment mechanism as known in the art is used to hold an object with radial symmetry, e.g., a cylinder.

The housing 1202 is configured to hold at least a portion of container (not shown) and the container is arranged at least partially within a bore 1208 of the main body 1202. The main body 1202 may be configured into any geometrical configuration with radial symmetry and in this implementation is configured with a substantial cylindrical geometry. Optionally, the main body has an offset in a range from about 1 degree to about 5 degrees as described herein. In this implementation, supporting members (not shown) as described herein are used to support the shaft 1210. The supporting members (not shown) are coequally spaced apart from each other in a radial configuration.

A levered arm unit 1201 is attached to a portion of the main body 1202. The levered arm unit 1201 is utilized as cap or partial closure to cover a container. In this implementation, the levered arm unit 1201 includes an extension portion 1203 and top portion 1205. The cap portion is sized to cover at least a portion of the lumen 1208. In one implementation, the size of the top portion 1205 has a diameter substantially equal an insider diameter of the main body at a first end 1204. The main body may also include an offset has described herein.

Levered arm unit 1201 is attached to the main body 1202 with a mechanism 1207 that allows the levered arm unit 1201 to rotate from a closed position to an open position or about 180 degrees, e.g., hinge mechanism or spring hinge mechanism as known in the art. The spring hinge mechanism is configured to keep the levered arm unit 1201 in a closed configuration as shown in FIGS. 12A and 12C. An open or loading configuration is shown in FIG. 12B.

Referring now to FIGS. 12A and 12B, a loading configuration is utilized to load a container, e.g., aerosol can 1212 and cap 1214. When using a spring hinge mechanism force is applied to rotate the configured to allow an extension portion to rotate to about 45 degrees or greater about the mechanism 1207. A container is placed in the lumen 1208 of the main body and the extension portion 1203 is released. A void space 1217 is created above a top portion of the container and bottom portion of the cap 1214 to allow the container to move independently as described herein.

The spring mechanism 1207 allows the extension portion 1203 to return to the closed position shown in FIG. 12C without additional external force. The lever arm unit 1201 may be constructed with a single mold and may be any material described herein with reference to the main body.

Referring now to FIG. 12D, optionally and/or alternatively a securing strap 1209 can be utilized. Typically, the securing strap includes a first end 1211 and second end 1213. The securing strap is affixed permanently or releasably with an adhesive or mechanical mechanism, e.g., rivet, screw, snap, Velcro, or combination of the same or the like to a first surface of the cap 1205. The second end 1212 is releasably attached to securing point 1215 with a securing mechanism, e.g., Velcro, snap, combination of the same or the like to secure the lever arm unit.

Figure 13A:
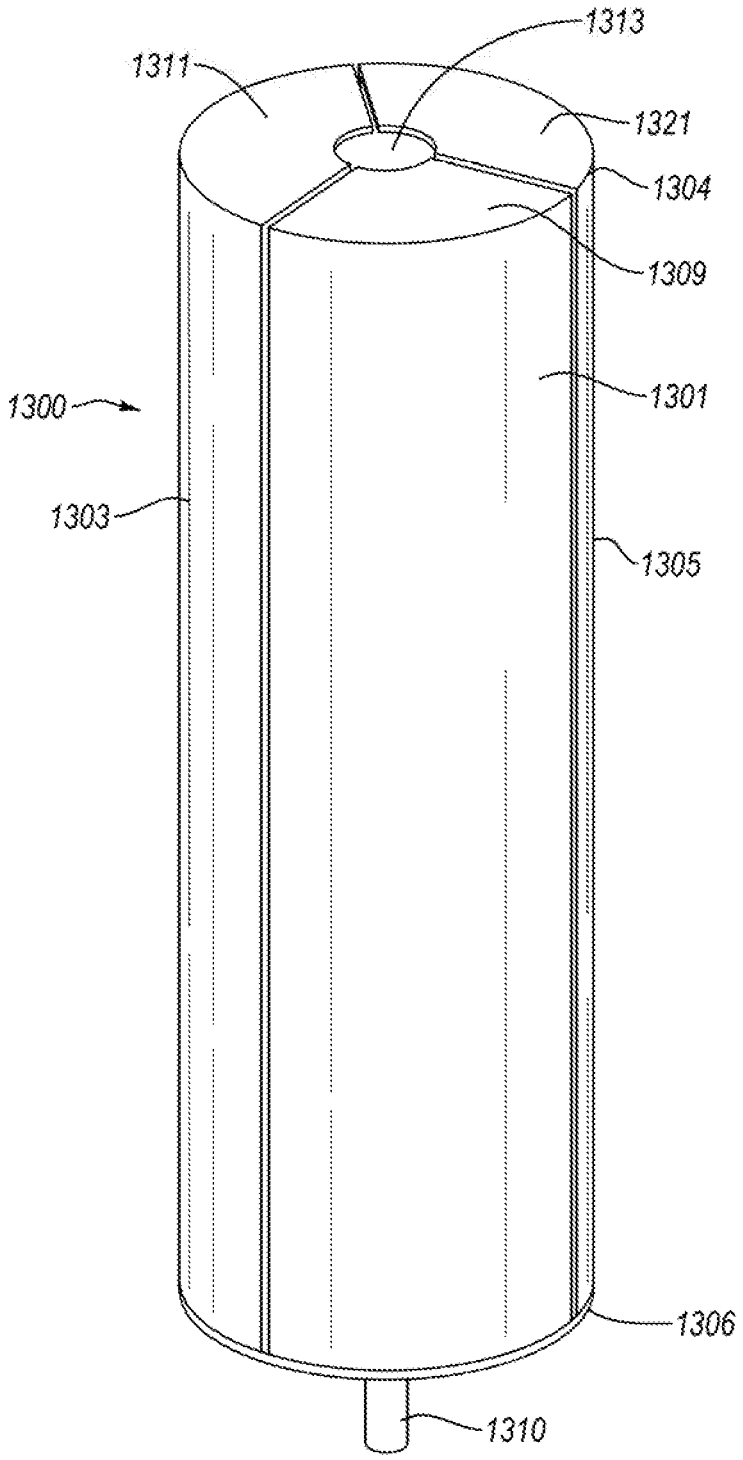
FIG. 13A illustrates a side perspective view of a mixing apparatus according to an implementation of the present disclosure.
Figure 13B:
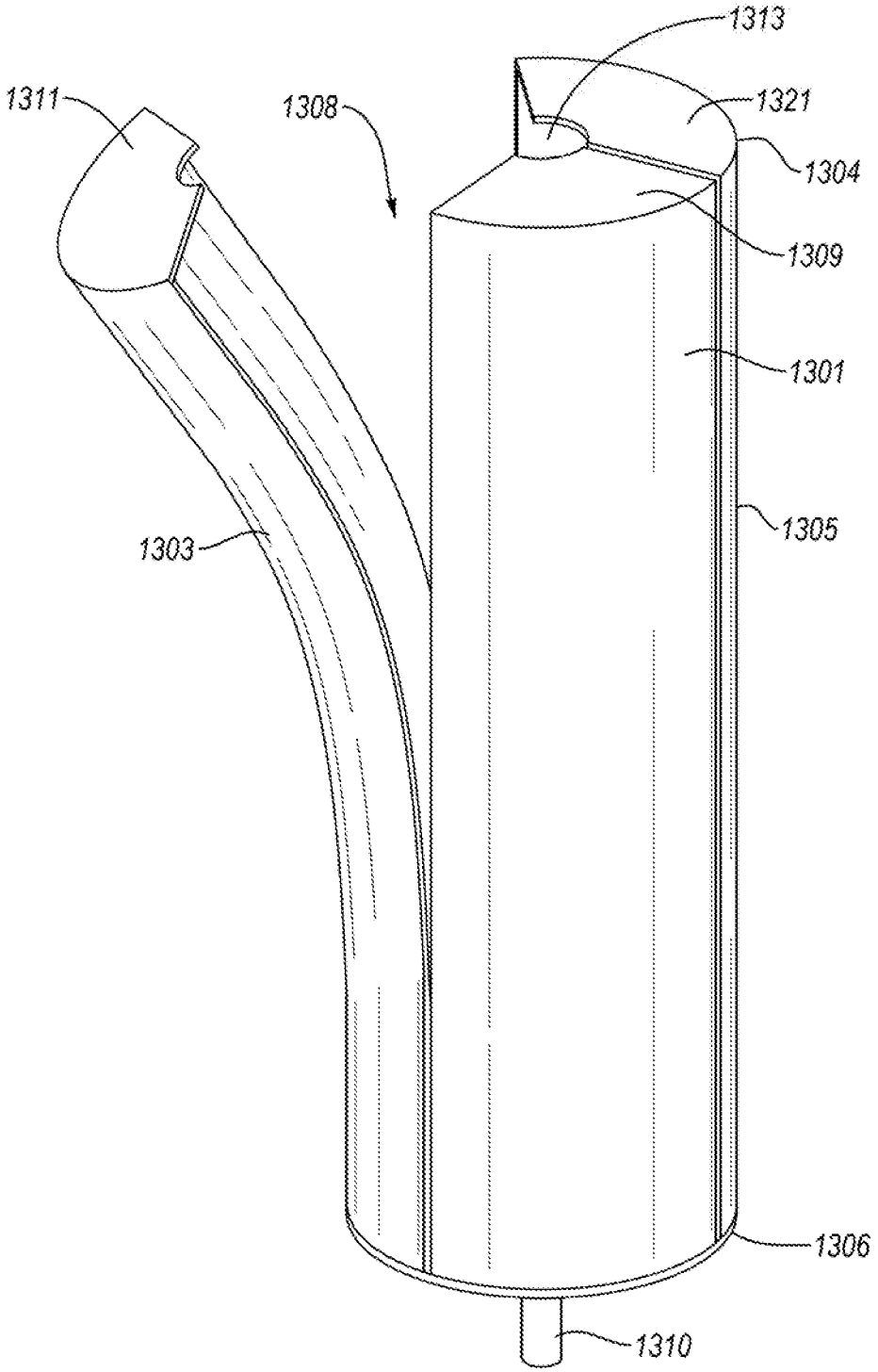
FIG. 13B illustrates a side perspective view of the mixing apparatus of FIG. 13A in first loading configuration, according to an implementation of the present disclosure.
Figure 13C:
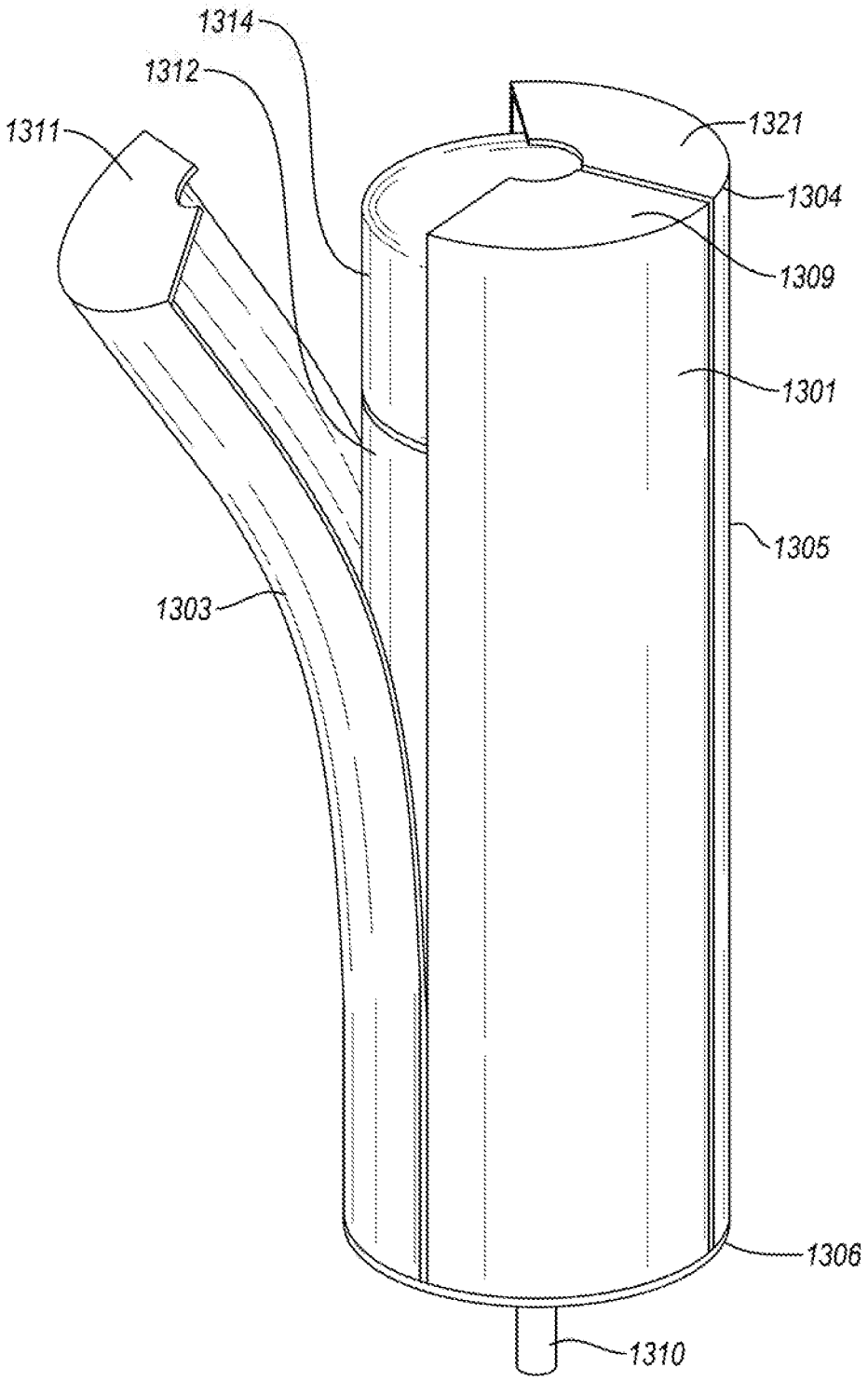
FIG. 13C illustrates a side perspective view of the mixing apparatus of FIG. 13A in first loading configuration with a container loaded, according to an implementation of the present disclosure.

FIG. 13A illustrates a side perspective view of a mixing apparatus according to an implementation of the present disclosure. FIG. 13B illustrates a side perspective view of the mixing apparatus of FIG. 13A in first loading configuration, according to an implementation of the present disclosure. FIG. 13C illustrates a side perspective view of the mixing apparatus of FIG. 13A in first loading configuration with a container loaded, according to an implementation of the present disclosure.

Referring to FIGS. 13A-13C, the mixing apparatus 1300 includes a main body in cylindrical configuration split into three equal side sections, a first section 1301 having a first top portion 1309, a second section 1303 having a second top portion 1311, and a third section 1305 having a top portion 1321. An opening 1313 is formed at the top of the main body when in the closed position in order to assist a user in moving one or more of the three sections from a first position to a second by allowing a user to place a finger or some other device in the opening 1313. Optionally and/or alternately the mixing apparatus can include more than three sections, e.g., four to eight sections or more.

The main body 1300 extends from a first end 1304 to a second end 1306 and the second end 1306 has a substantially flat base. A shaft 1310 is arranged at an orthogonal configuration relative to the flat base of second end 1306. The shaft 1310 is configured and sized to be inserted into a receiving portion of a rotational device. The receiving portion of the rotational device is a chuck or a specialized type of clamp configured to releasable hold at least a portion of the shaft 1310. The chuck or clamp or other attachment mechanism as known in the art is used to hold an object with radial symmetry, e.g., a cylinder.

The main body including the first section 1301, second section 1303, and third section 1305 are constructed from a memory thermoplastic material. The memory thermoplastic material is configured in a preformed configuration orientation shown in FIG. 13A, which is the lowest energy state. Force is required to bend, twist and/or open one or more the sections, e.g., section 1303 as shown in FIG. 13B. In this open configuration a container, e.g., aerosol can 1312 and cap 1314 is added to a lumen or bore 1308 of the main body. The memory material is strong enough to remain in a closed position during operation. Also, in closed configuration a void space is formed between a top surface of the cap 1314 and inner surface of the top region of the three sections, so the container can rotate or move independently of the main body as described herein. Optionally and/or alternatively, a retaining strap or sleeve as described herein at FIGS. 11E and 9A, respectively, can be utilized to secure the three sections together.

Figure 14A:
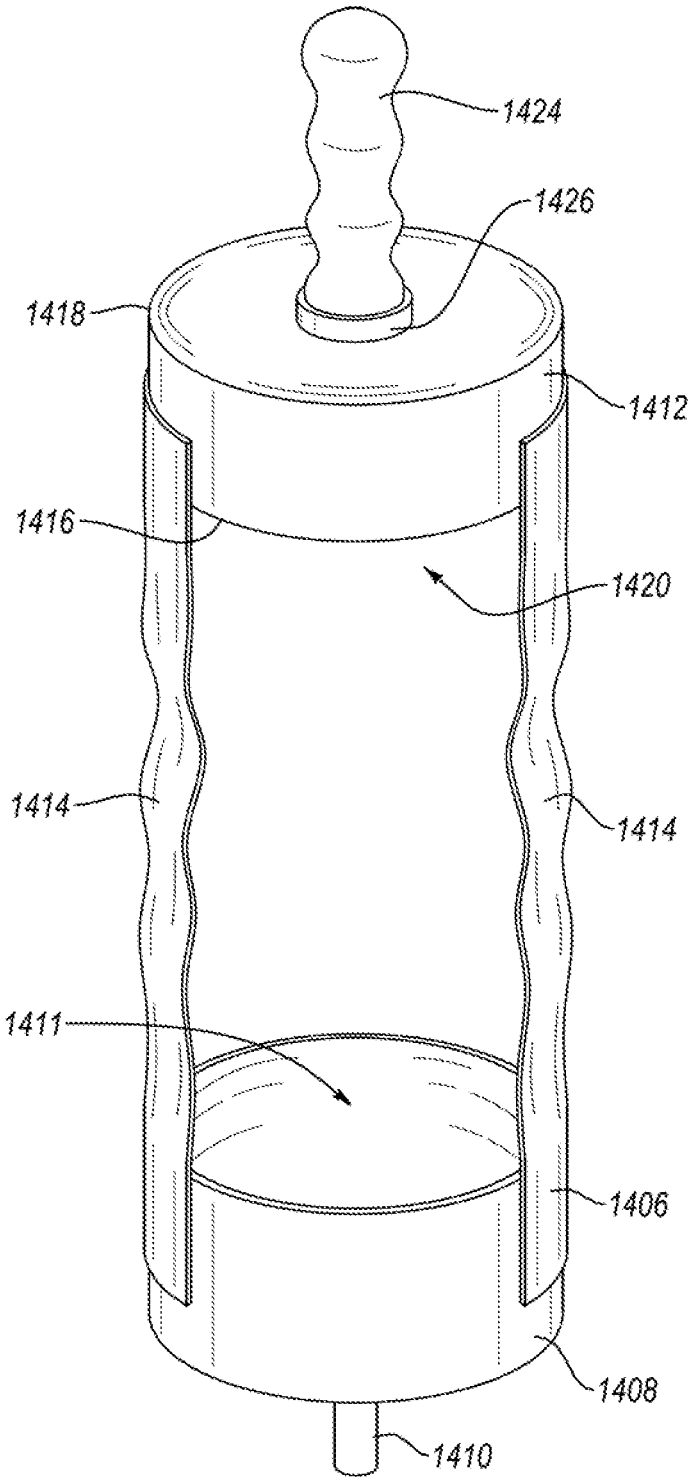
FIG. 14A illustrates a side perspective view of a mixing apparatus in a first orientation according to an implementation of the present disclosure.
Figure 14B:
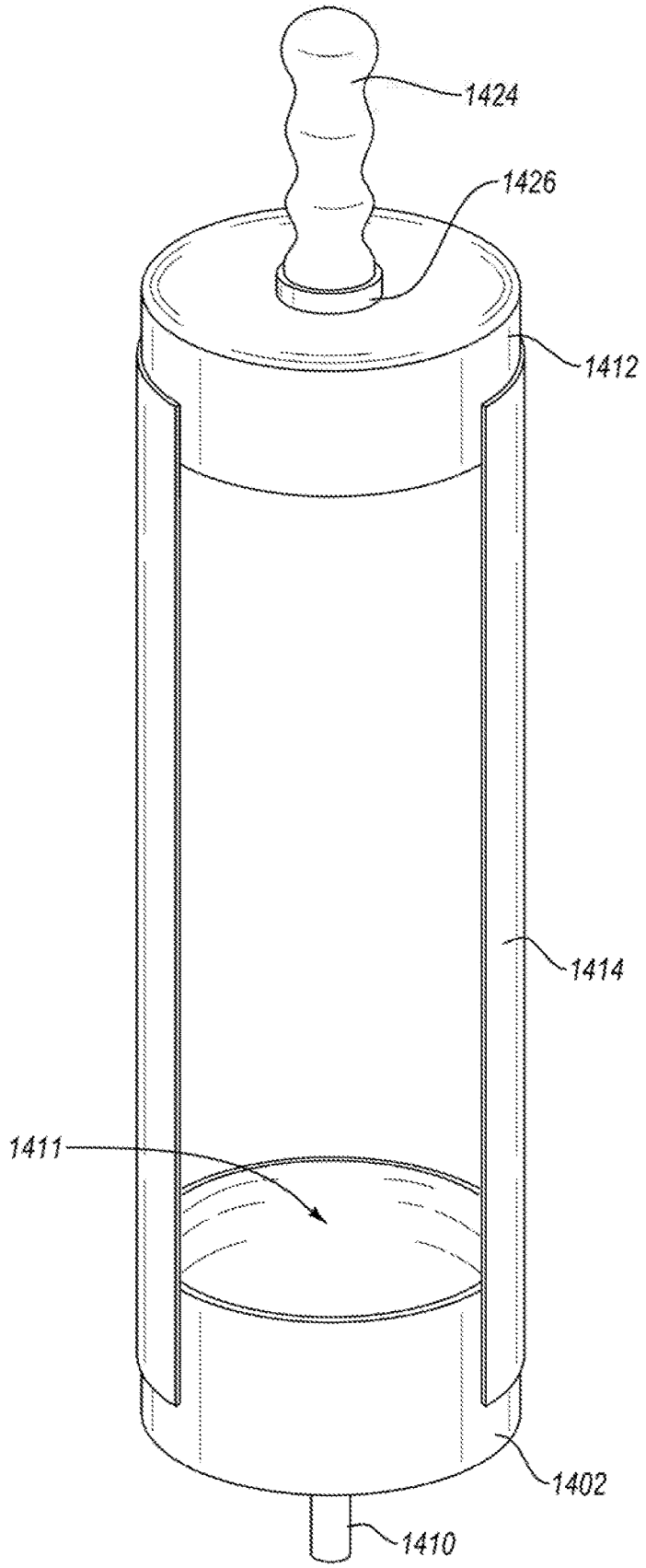
FIG. 14B illustrates a side perspective and partial cross-sectional view of the mixing apparatus of FIG. 14A in a second orientation, according to an implementation of the present disclosure.
Figure 14C:
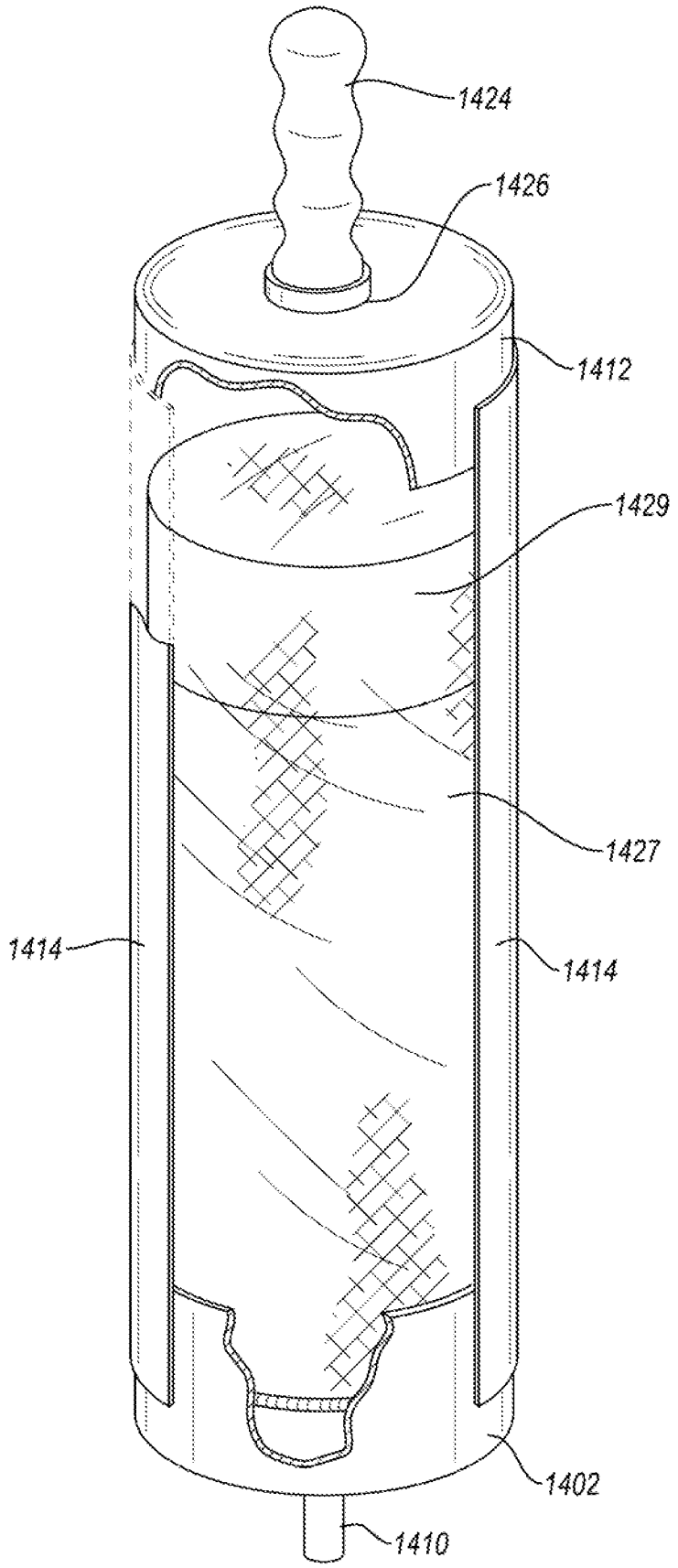
FIG. 14C illustrates a side perspective and partial cross-sectional view of the mixing apparatus of FIG. 14A with an aerosol can, according to an implementation of the present disclosure.

FIG. 14A illustrates a side perspective view of a mixing apparatus in a first orientation according to an implementation of the present disclosure. FIG. 14B illustrates a side perspective and partial cross-sectional view of the mixing apparatus of FIG. 14A in a second orientation, according to an implementation of the present disclosure. FIG. 14C illustrates a side perspective and partial cross-sectional view of the mixing apparatus of FIG. 14A with an aerosol can, according to an implementation of the present disclosure.

Referring to FIGS. 14A-14C, the mixing apparatus 1400 includes a first end portion 1402 having an open first end 1406, a closed second end 1408 and a lumen or bore 1411 extending from the open first end 1406 to the closed second end 1408. A second end portion 1412 is connected to first end portion 1402 by one or connection straps 1414 and in this configuration three connection straps 1414. The second end portion 1412 includes an open first end 1416, a closed second end 1418 and a lumen 1420 extending from the open first end 1416 to the closed second end 1418. The second first end includes a top region 1422 and a handle attached optionally with a bearing 1426 to allow the handle to rotate. A bearing 1426 does not have to be used and the handle can be directly attached and not rotate in another implementation.

The connection straps are elastic and configured to be stretched from a first position to a second position. FIG. 14A is in a non-loaded configuration where the straps. Referring now to 14B the elastic bands 1414 are stretched to a second position to allow a container, e.g., aerosol can 1427 and cap 1429 shown in FIG. 14C to be inserted and held at least partially with in the lumen 1410 and 1420. Optionally, the length of the elastic band are sized to allow the container to rotate independently as described herein by leaving a void space between the top of the cap 1424 and the top region 1422.

A shaft 1410 is arranged at an orthogonal configuration relative to the flat base of first end portion 1402. The shaft 1410 is configured and sized to be inserted into a receiving portion of a rotational device. The receiving portion of the rotational device (not shown) includes a chuck or a specialized type of clamp configured to releasable hold at least a portion of the shaft 1410. The chuck or clamp or other attachment mechanism as known in the art is used to hold an object with radial symmetry, e.g., a cylinder. Also, in this embodiment, the elastic bands 1414 are coequally spaced apart from each other in a radial configuration.

Figure 15A:
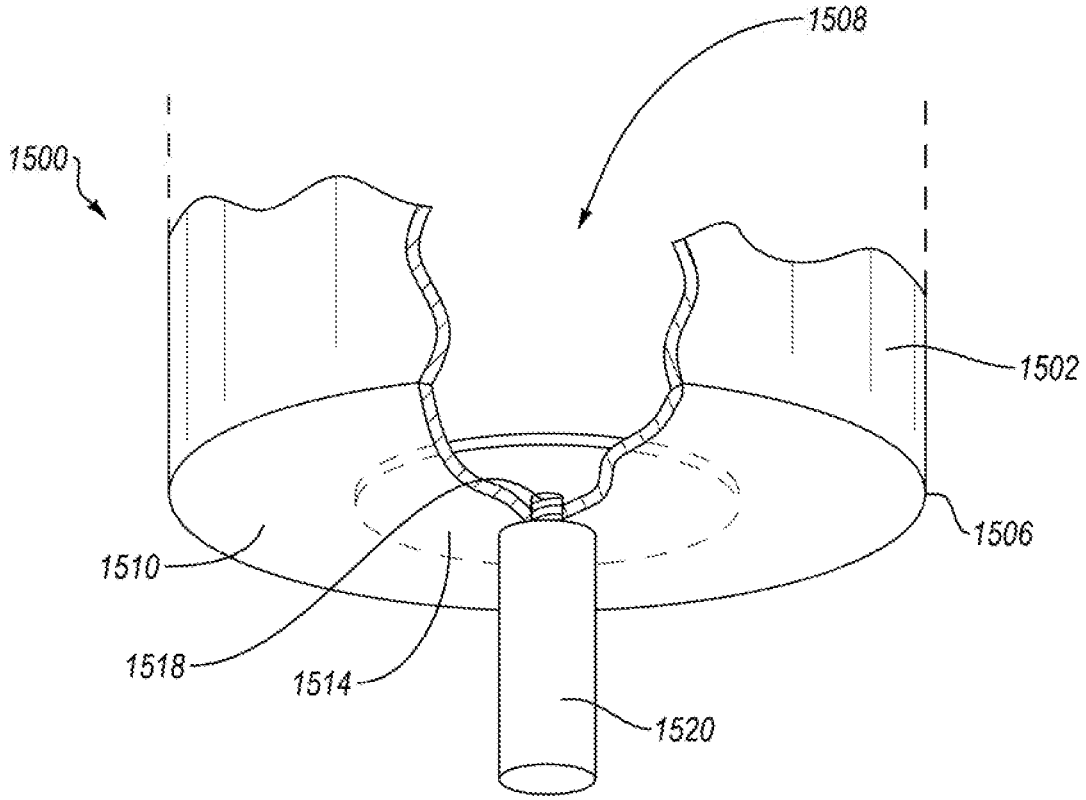
FIG. 15A illustrates a bottom perspective and partial cross-sectional view of a mixing apparatus and shaft, according to an implementation of the present disclosure.
Figure 15B:
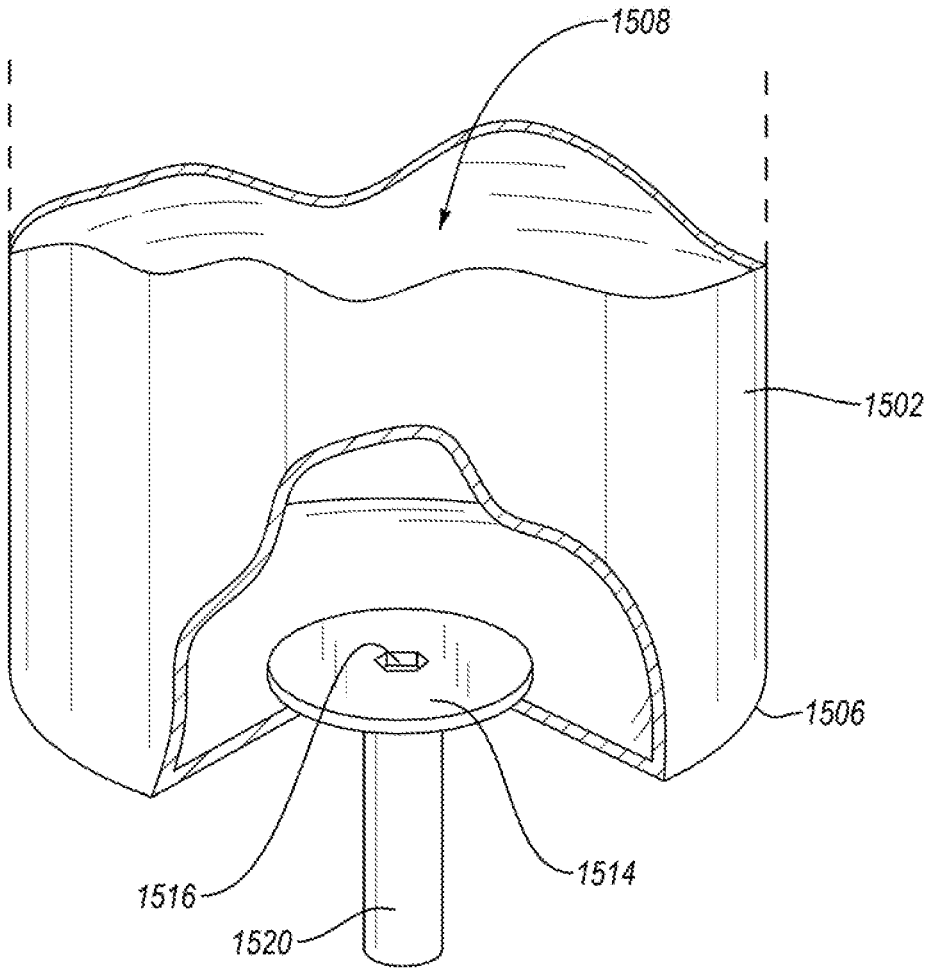
FIG. 15B illustrates a bottom perspective and partial cross-sectional view of the mixing apparatus and shaft of FIG. 15A, according to an implementation of the present disclosure.
Figure 15C:
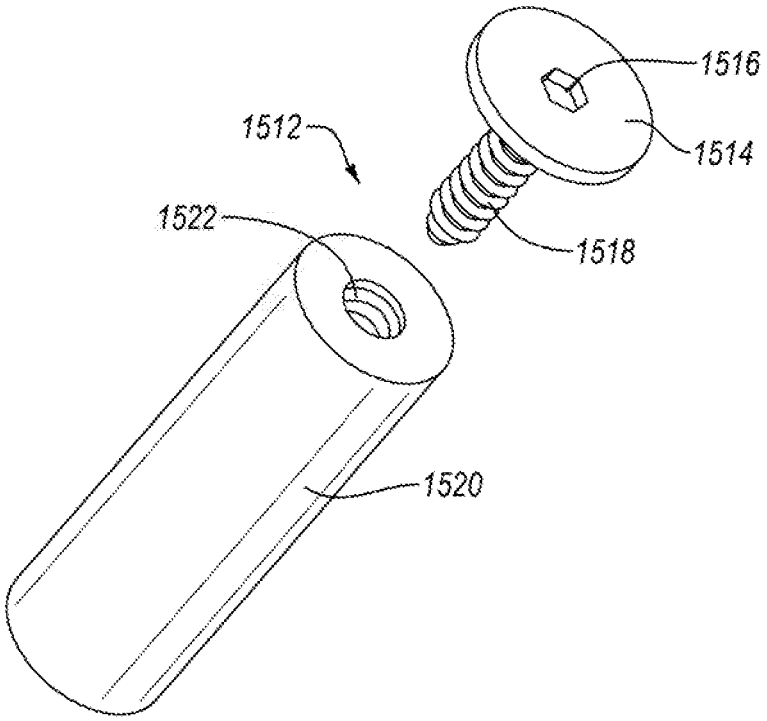
FIG. 15C illustrates a top perspective disassembled view of a shaft of the mixing apparatus of FIG. 15A, according to an implementation of the present disclosure.

FIG. 15A illustrates a bottom perspective and partial cross-sectional view of a mixing apparatus and shaft, according to an implementation of the present disclosure. FIG. 15B illustrates a bottom perspective and partial cross-sectional view of the mixing apparatus and shaft of FIG. 15A, according to an implementation of the present disclosure. FIG. 15C illustrates a top perspective disassembled view of shaft of the mixing apparatus of FIG. 15A, according to an implementation of the present disclosure.

Referring to FIGS. 15A-15C, illustrating another implementation of shaft for use with a mixing apparatus 1500. The mixing apparatus 1500 includes a main body 1502 or housing, a first end (not shown, but described herein), a second end 1506, a lumen or bore 1508 extending from the first end to the closed second end 1506. The second end 1506 of the main body 1502 has a substantially flat base 1510.

A shaft unit 1512 includes a base portion 1514 having a flat head portion with a screw head 1516 and a threaded section 1518. The screw head type may be any screw head type as known in the art, e.g., cross, Philips, frearson, mortorq, hex and the like. The shaft unit 1512 further includes a mandrel 1520 with a threaded lumen 1522 configured to receive the thread section 1518. The shaft material may any material described herein. The dimensions of the shaft are described herein. The base portion 1514 is flat and has a diameter less than an inside diameter of the main body at the second end 1506.

The threaded section 1518 is arranged through an orifice (not shown) in a bottom of the main body and into a mandrel 1520 as shown in FIG. 15B. The base portion 1514 is tightened to a torque of 1 ft pounds to about 10 ft pounds or greater and optionally an adhesive, e.g., thread glue and/or locking washer can also be utilized to prevent losing of the base portion from the mandrel 1520. The orifice may be offset as described herein or centered along a central axis of the main body 1502. The mandrel 1520 is configured and sized to be inserted into a receiving portion of a rotational device. The receiving portion of the rotational device is a chuck or a specialized type of clamp configured to releasable hold at least a portion of the mandrel 1520. The chuck or clamp or other attachment mechanism as known in the art is used to hold an object with radial symmetry, e.g., a cylinder.

The main body 1502 is configured to hold at least a portion of container (not shown) and the container is arranged at least partially within a bore 1508 of the main body 1502. The main body 1502 may be configured into any geometrical configuration with radial symmetry and in this implementation is configured with a substantial cylindrical geometry. Optionally, the main body has an offset in a range from about 1 degree to about 5 degrees as described herein.

Figure 16A:
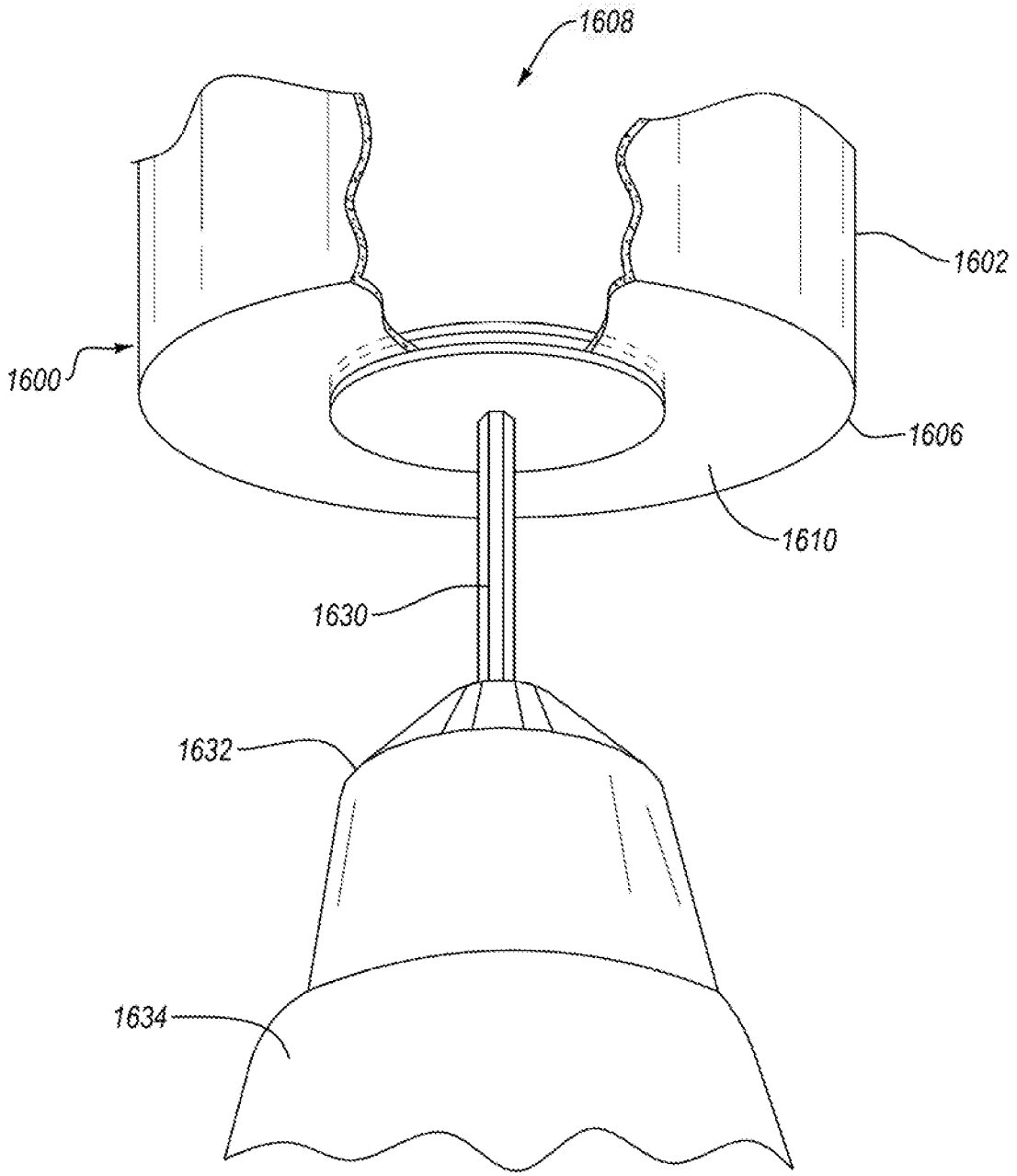
FIG. 16A illustrates a bottom perspective and partial cross-sectional view of a mixing apparatus and shaft, according to an implementation of the present disclosure.
Figure 16B:
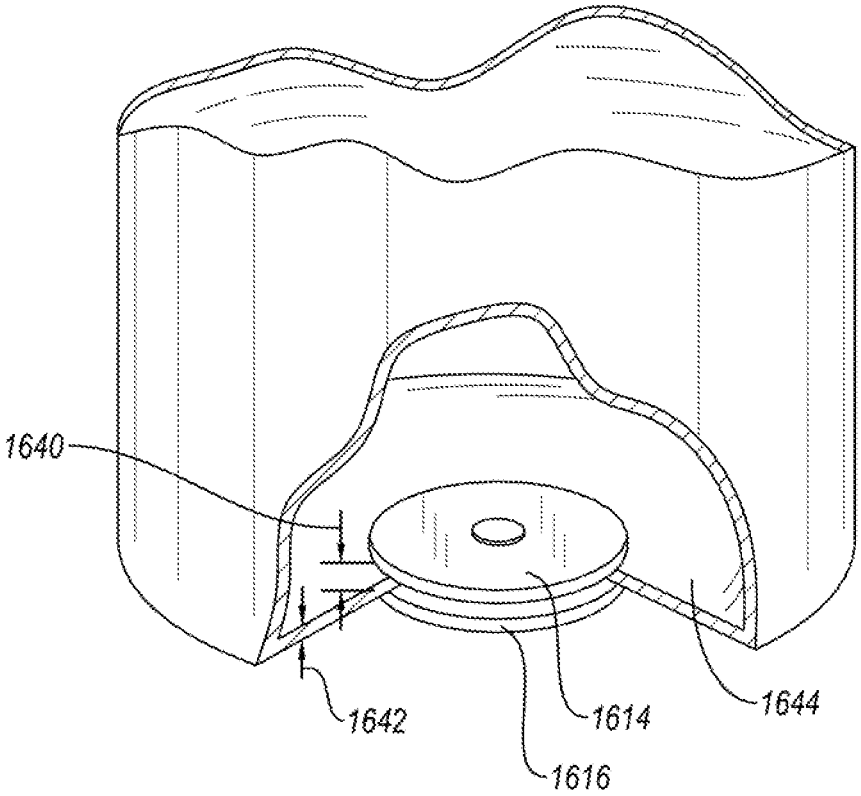
FIG. 16B illustrates a bottom perspective and partial cross-sectional view of the mixing apparatus and shaft of FIG. 16A, according to an implementation of the present disclosure.
Figure 16C:
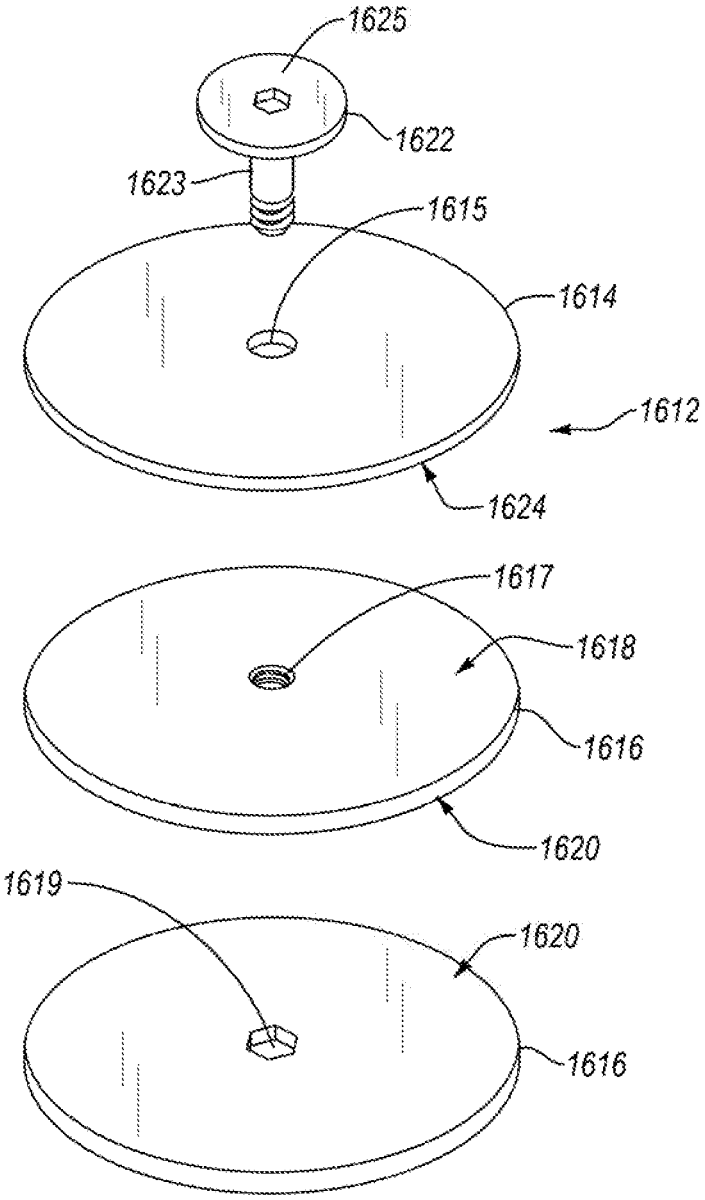
FIG. 16C illustrates a top perspective disassembled view of a shaft of the mixing apparatus of FIG. 16A, according to an implementation of the present disclosure.

FIG. 16A illustrates a bottom perspective and partial cross-sectional view of a mixing apparatus and shaft, according to an implementation of the present disclosure. FIG. 16B illustrates a bottom perspective and partial cross-sectional view of the mixing apparatus and shaft of FIG. 16A, according to an implementation of the present disclosure. FIG. 16C illustrates a top perspective disassembled view of shaft of the mixing apparatus of FIG. 16A, according to an implementation of the present disclosure.

Referring to FIGS. 16A-16C, illustrating another implementation of a rotational mechanism 1612 that can be optional in any of the implementations described herein. In this implementation, the mixing apparatus 1600 includes a main body 1602 or housing, a first end (not shown, but described herein), a second end 1606, a lumen or bore 1608 extending from the first open end to the closed second end 1606. The second end 1606 of the main body 1602 has a substantially flat base 1610.

The main body 1602 is configured to hold at least a portion of a container (not shown) and the container is arranged at least partially within a bore 1608 of the main body 1602. The main body 1602 may be configured into any geometrical configuration with radial symmetry and in this implementation is configured with a substantial cylindrical geometry. Optionally, the main body has an offset in a range from about 1 degree to about 5 degrees as described herein.

Referring now to FIG. 16C, the rotational mechanism 1612 includes an inner plate 1614, an outer plate 1616 and connection mechanism 1622. The inner plate 1614 includes an orifice 1615 through the outer plate 1616 sized to receive a connection mechanism 1622, e.g., screw, bolt, rivet or the like as known in the art. The inner plate 1614 includes a first side 1626 and second side 1624. In this implementation, the connection mechanism 1622 includes a screw head 1625 as described herein and thread portion 1623. The second plate 1616 includes a threaded hole 1617 on a first side 1618 and a receiving hole 1619 on the second surface 1620. The threaded hole 1617 is configured to receive the threaded portion 1623 of the connection mechanism 1622. The threaded hole 1617 does not entirely go through a complete thickness of the second plate 1616. The receiving hole 1619 has a depth and geometric configuration to receive a spindle 1630 as shown in FIG. 16A. The spindle 1630 can have any geometric shape with radial symmetrically, e.g., circle, cylinder, oval, square, triangle, diamond, pentagon, hexagon, heptagon, octagon, nonagon, combinations of the same and the like. Alternatively, the threaded hole 1617 may be an extension spindle (not shown) with threads or other connection mechanism that extends orthogonally from the surface of the plate 1615. The extension spindle (not shown) is configured to be coupled to a lumen (not shown) of the connection mechanism 1622. More specifically, in this alternative, the connection mechanism 1622 does not include a threaded portion but includes a lumen with threads or other connection to mechanism to engage the connection mechanism of the extension spindle (now shown).

The first plate 1614 and second plate 1616 can have any geometric shape with radial symmetry, e.g., circle, cylinder, oval, square, triangle, diamond, pentagon, hexagon, heptagon, octagon, nonagon, combinations of the same and the like. The first plate 1614 and second plate 1616 can also have different geometric shapes. The thickness of the first plate 1614 can be greater or less then the thickness of the second plate 1616. The thickness of the first plate 1614 and the second plate 1616 can be in range from 0.1 mm to about 15 mm or greater.

As shown in FIG. 16A, the first plate 1614 is arranged above an inner bottom surface 1644 of main body 1602. The connection mechanism 1622 is arranged through the orifice 1615 and into a threaded hole 1617 and tightened to a torque of 0.5 ft pounds to about 10 ft pounds or greater and optionally an adhesive, e.g., thread glue and/or locking washer can also be utilized to attach the first plate 1614 to the second plate 1616. The connection mechanism 1622, threaded hole 1617 and thickness of the first plate 1614 and 1616 are sized to allow a gap or distance 1640 between an inner surface 1624 of the first plate 1614 and inner surface 1618 of the second plate 1616 greater than a wall thickness 1642 of the main body 1602 when permanently attached to each other. This gap 1640 allows the first plate 1614 and the second plate 1616 to rotate with no or little friction on each adjacent wall of the main body. Optionally and/or alternatively, an anti-frictional coating or layer may be formed on an inner surface 1624 of the first plate 1614 and/or inner surface of the 1618 of the second plate. The anti-frictional coating or layer is material, e.g., polytetrafluorethylene or other material, configured to minimize friction. Optionally and/or alternatively, the gap may also be lubricated with a lubricous material, e.g., oil, graphite and the like to mitigate friction.

The spindle 1630 is utilized as a shaft and configured and sized to be inserted into a receiving portion of a rotational device 1634. The receiving portion of the rotational device is a chuck or a specialized type of clamp 1632 configured to releasable hold at least a portion of the spindle 1630. The spindle 1630 is removable from the receiving hole 1619 or permanently attached to the receiving hole, e.g., welding, adhesive and the like. The chuck or clamp or other attachment mechanism as known in the art is used to hold an object with radial symmetry, e.g., spindle 1630.

Optionally and/or alternatively, the rotational mechanism 1612 includes the second plate 1616 only without the first plate 1614. In this implementation, an inner surface 1618 of the second plate 1616 is attached or coupled to an external bottom portion 1610 of the main body 1602. The inner surface can have one or more protrusions sized to fit within a portion of the side wall of the main body 1602. The second plate 1616 is attached with an adhesive and/or connection mechanism, e.g., rivet, bolt, screw. When using a screw one or more threaded holes 1617 are utilized. The threaded holes may extend out of the second plate or not extend through the second plate 1616 as described herein.

Figure 17A:
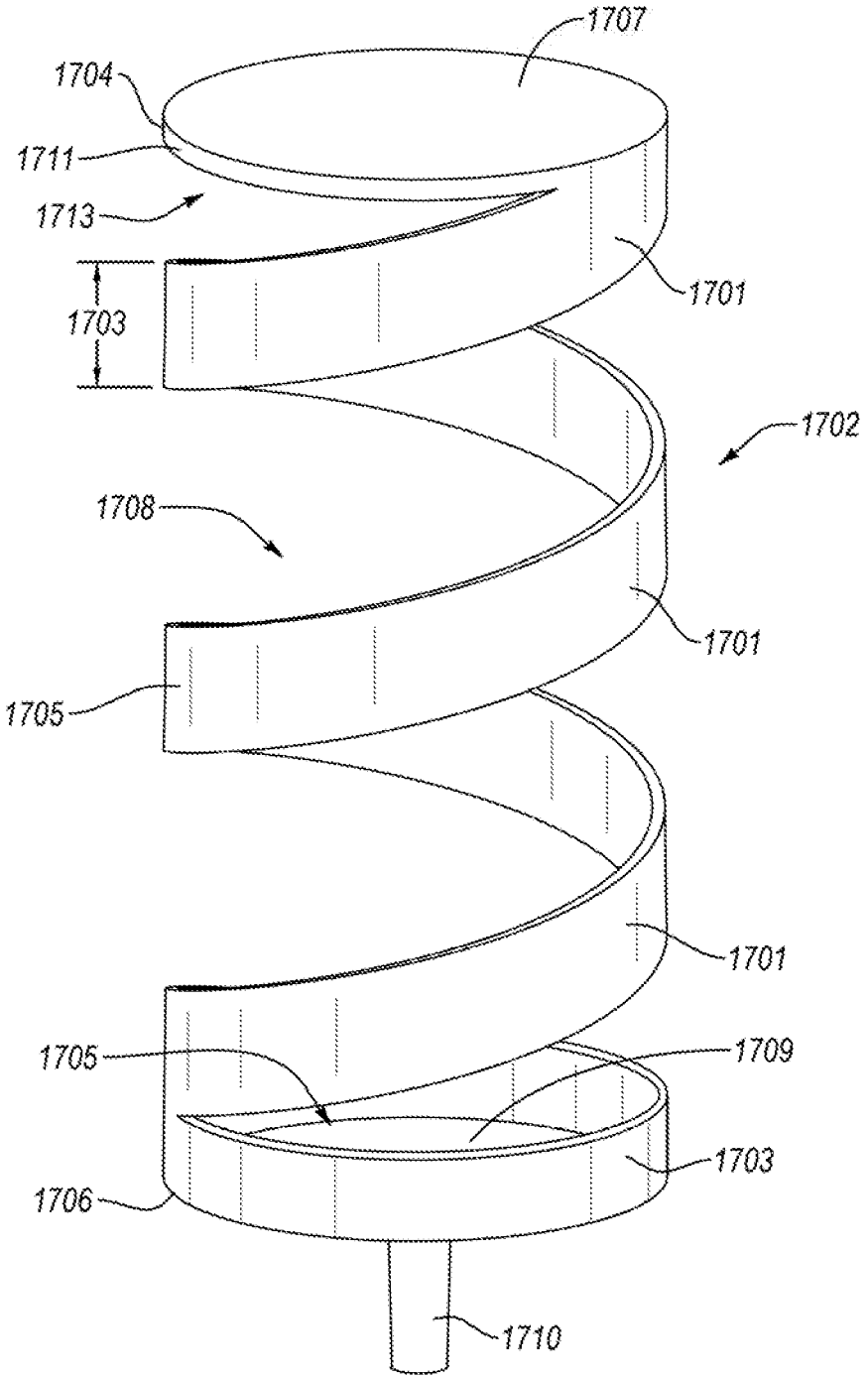
FIG. 17A illustrates a side perspective view of a mixing apparatus according to an implementation of the present disclosure.
Figure 17B:
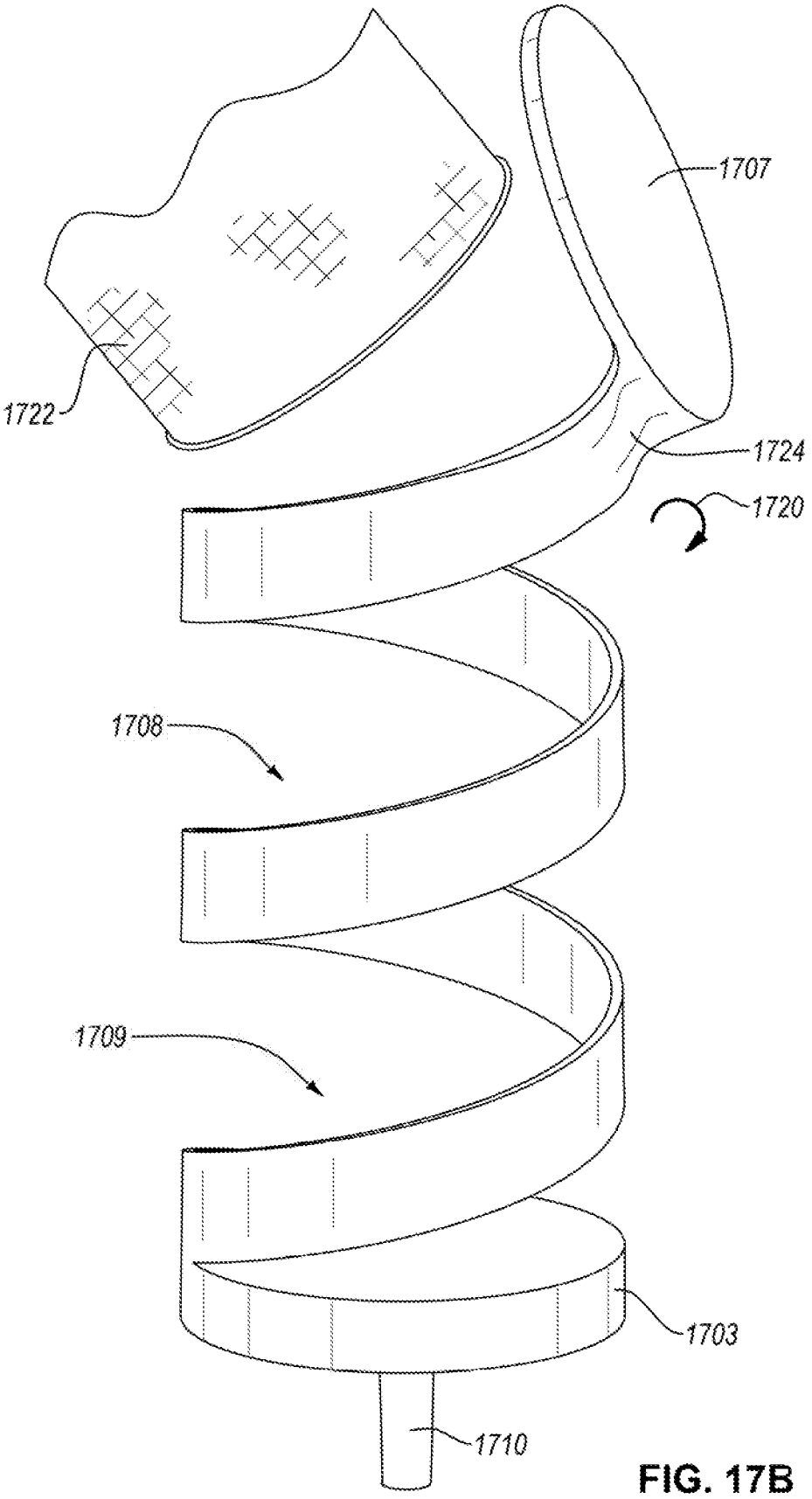
FIG. 17B illustrates a side perspective view of the mixing apparatus of FIG. 17A in a second configuration, according to an implementation of the present disclosure.
Figure 17C:
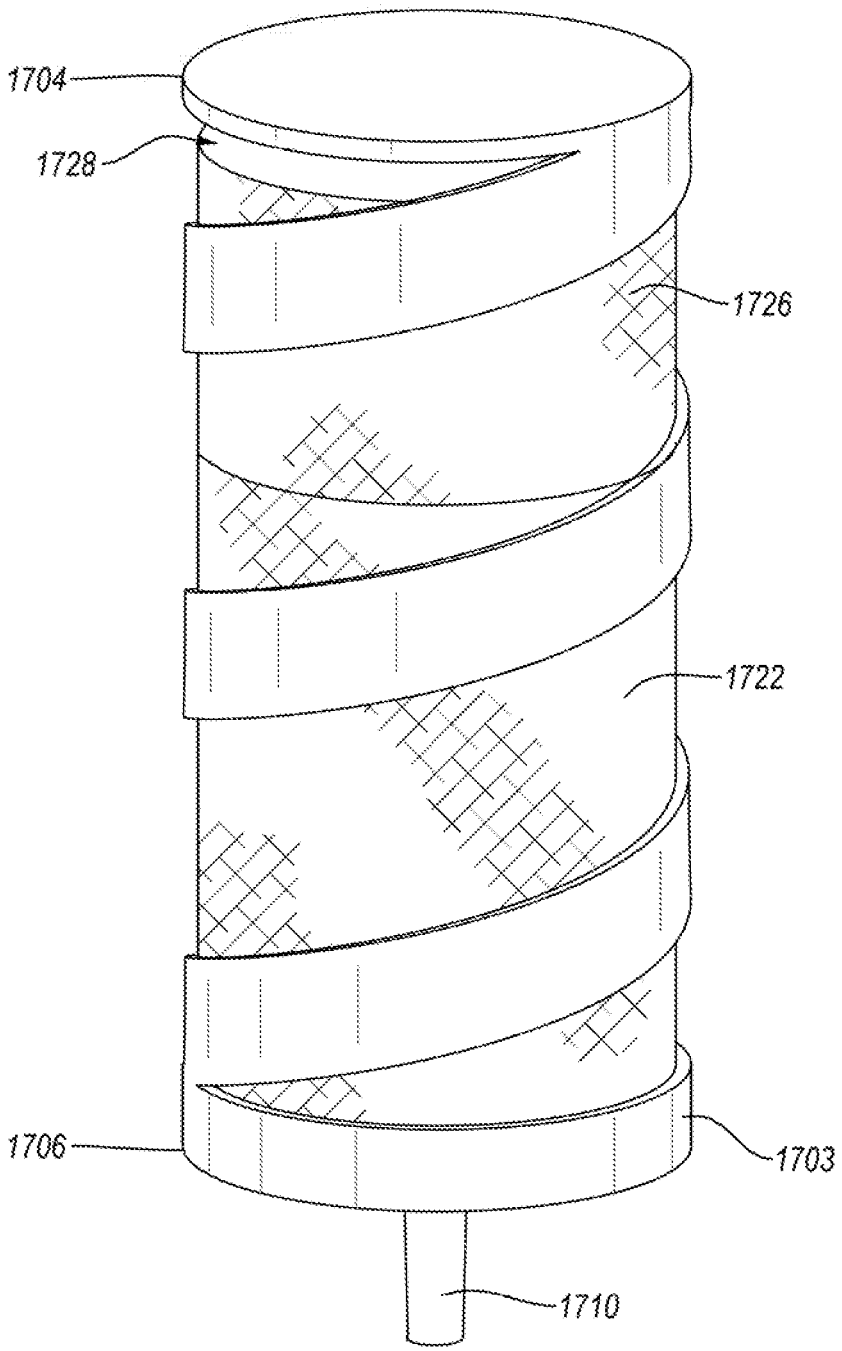
FIG. 17C illustrates a side perspective view of the mixing apparatus of FIG. 17A in a third configuration with an aerosol can, according to an implementation of the present disclosure.

FIG. 17A illustrates a side perspective view of a mixing apparatus according to an implementation of the present disclosure. FIG. 17B illustrates a side perspective view of the mixing apparatus of FIG. 17A in a second configuration, according to an implementation of the present disclosure. FIG. 17C illustrates a side perspective view of the mixing apparatus of FIG. 17A in a third configuration with an aerosol can, according to an implementation of the present disclosure.

FIGS. 17A-17C, the mixing apparatus 1700 includes a main body 1702 in helical cylindrical configuration with one or more windings 1701 having constant inner diameter and pitch. The main body 1702 includes a closed first end 1704, a closed second end 1706, and a lumen 1708 created in a space inside or internal dimension of the helix extending from the first end 1704 to the second end 1706. The closed first end 1704 includes a top portion The helix includes a main member 1705 having a thickness 1703 extending as a curve into three-dimensional space from the first end 1704 to the second end 1706 having one more complete helix turns. In this implementation, the number of turns is about 2. The inside diameter of the main body 1702 may vary, e.g., taper and the pitch may vary. The pitch is the height of one complete helix turn.

Optionally, the second end 1706 includes a sidewall 1703 circumferentially surrounding and extending to the first end 1704 from a base portion 1709. A minor cup or lumen 1705 is created by the side wall.

Optionally, the first end 1704 includes a side wall 1711 circumferentially surrounding and extending from the first end 1704 to the second end 1706. A minor cup or lumen 1713 is created by the side wall 1711 extending from the sidewall 1711 to the closed first end 1704 and top portion 1707.

A shaft 1710 is arranged at an orthogonal configuration relative to the flat base of second end 1706. The shaft 1710 is configured and sized to be inserted into a receiving portion of a rotational device. The receiving portion of the rotational device is a chuck or a specialized type of clamp configured to releasable hold at least a portion of the shaft 1710. The chuck or clamp or other attachment mechanism as known in the art is used to hold an object with radial symmetry, e.g., a cylinder.

The main member 1705 of the main body 1702 is constructed from a memory thermoplastic material and/or pliable material configured to move from first position to second position without breaking as shown in FIG. 17B. The memory thermoplastic material is configured in a preformed configuration orientation shown in FIG. 17A, which is the lowest energy state. An external force 1720 is required to bend, twist and/or open one or more the sections of the main member 1705, e.g., as shown in FIG. 13B. In this implementation the main member 1705 is bent or rotated at a portion 1724 to move the top portion 1707 from a closed orientation to an open orientation to allow for placement of container 1722 into a lumen 1708 as shown in FIG. 17B and FIG. 17C. The memory material of the main member 1705 is strong enough to remain in a closed position during operation and also strong enough to return to a closed position after application of the external force has been released. Also, in closed configuration a void space 1728 is formed between a top surface of the cap 1726 of the container 1722 and inner surface of the top portion 1707, so the container can rotate or move independently of the main body as described herein. Optionally and/or alternatively, a retaining strap as described herein can be utilized to secure the three sections together. The top portion 1707 may be a diameter substantially the same as the diameter of the helix or smaller than a diameter of the helix.

Figure 18A:
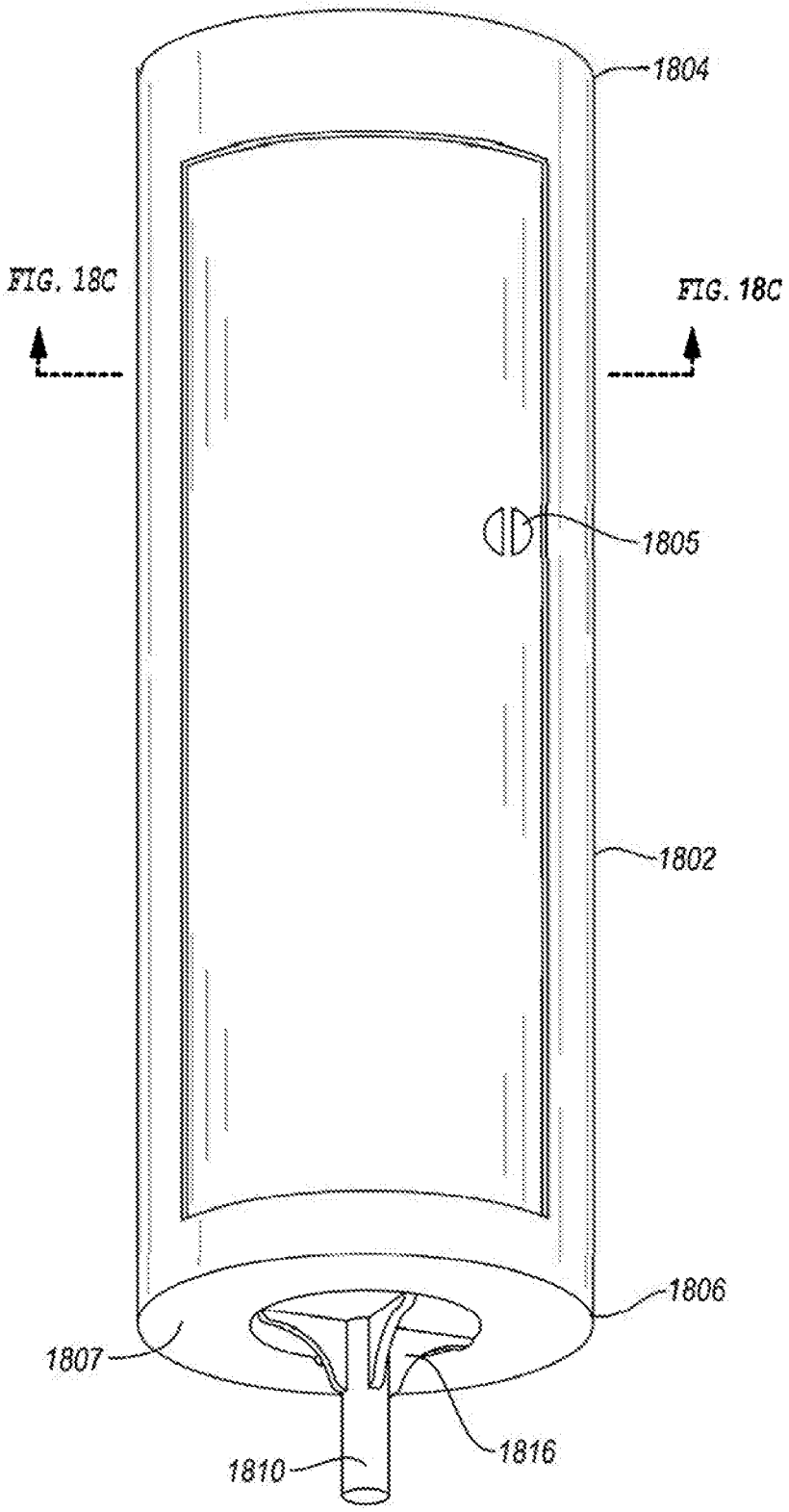
FIG. 18A illustrates a side perspective view of a mixing apparatus in a closed configuration, according to an implementation of the present disclosure.
Figure 18B:
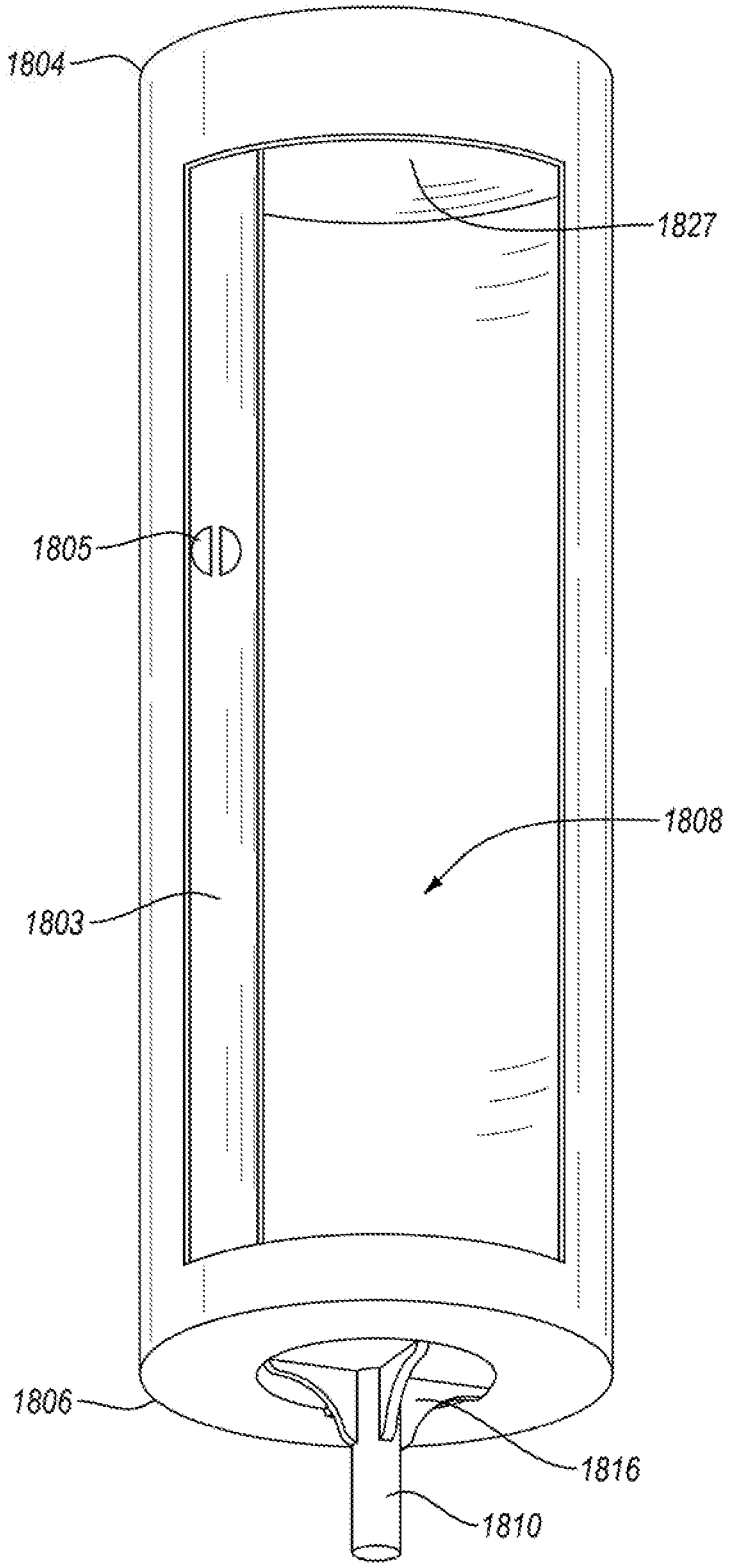
FIG. 18B illustrates a side perspective view of the mixing apparatus of FIG. 18A in an open configuration, according to an implementation of the present disclosure.
Figure 18C:
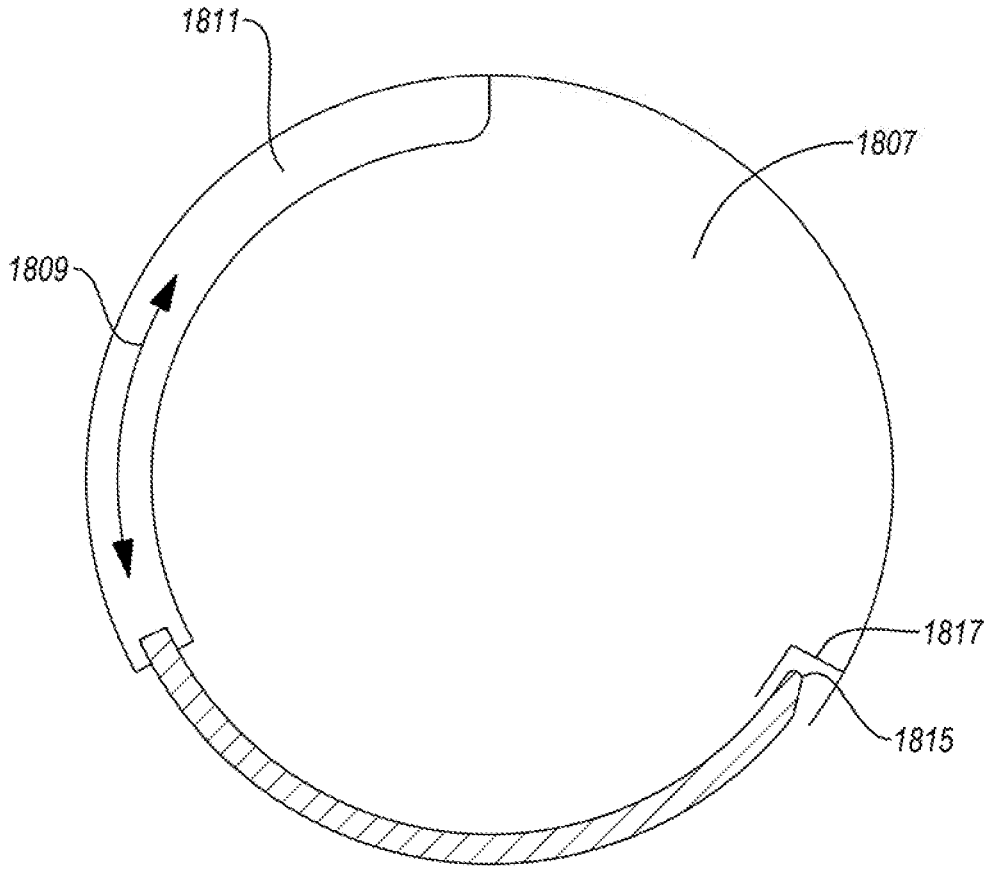
FIG. 18C illustrates a cross-sectional view of the mixing apparatus of FIG. 18A along line FIG. 18C to FIG. 18C in a closed configuration, according to an implementation of the present disclosure.

FIG. 18A illustrates a side perspective view of a mixing apparatus in a closed configuration, according to an implementation of the present disclosure. FIG. 18B illustrates a side perspective view of the mixing apparatus of FIG. 18A in an open configuration, according to an implementation of the present disclosure. FIG. 18C illustrates a cross-sectional view of the mixing apparatus of FIG. 18A along line A to A' in a closed configuration, according to an implementation of the present disclosure. FIG. 18C illustrates a cross-sectional view of the mixing apparatus of FIG. 18A along line A to A' in a partially open configuration, according to an implementation of the present disclosure. FIG. 18E illustrates a side perspective view of the mixing apparatus of FIG. 18A in an open configuration with a container, according to an implementation of the present disclosure.

FIGS. 18A-18E, a mixing apparatus 1800 includes a main body or housing 1802, a first closed end 1804, a second closed end 1806, a lumen or bore 1808 extending from the first closed end 1804 to the second closed end 1806. The second closed end 1806 of the main body 1802 has a substantially flat base 1807. A shaft 1810 is arranged at an orthogonal configuration relative to the flat base of second end 1806. The shaft 1810 is configured and sized to be inserted into a receiving portion of a rotational device.

The receiving portion of the rotational device is a chuck or a specialized type of clamp configured to releasable hold at least a portion of the shaft 1810. The chuck or clamp as known in the art is used to hold an object with radial symmetry, e.g., a cylinder.

The lumen 1808 of the main body 1802 is configured to hold at least a portion of container 1820 and cap 1822 for the container is arranged at least partially within a bore 1808 of the main body 1802. The main body 1802 further includes a door 1803 movable from a closed orientation shown in FIG. 18A to an open orientation shown in FIG. 18B. Optionally, the door may include a handle region 1805, e.g., recess or protrusion.

In this implementation, the main body 1802 has a substantial cylindrical configuration without an offset. In this configuration a container and in the open orientation of the door 1803 a container with or without a cap can be easily inserted into the lumen or bore 1808. The lumen is bigger than the container to allow for multiple sized containers and has dimensions described herein.

In this implementation, four supporting members 1816 are used to support the shaft 1810. The supporting members 1816 are coequally spaced apart from each other in a radial configuration. The number of supporting members 1816 may be increased or decreased. The supporting members 1816 also add weight to a bottom portion of the housing 1802. The supporting members 1816 add strength and rigidity to the shaft 1810. The shaft 1810 may also be reinforced with various materials including, e.g., metals, composites, thermoplastics, alloys, combinations of the same and the like.

Figure 18D:
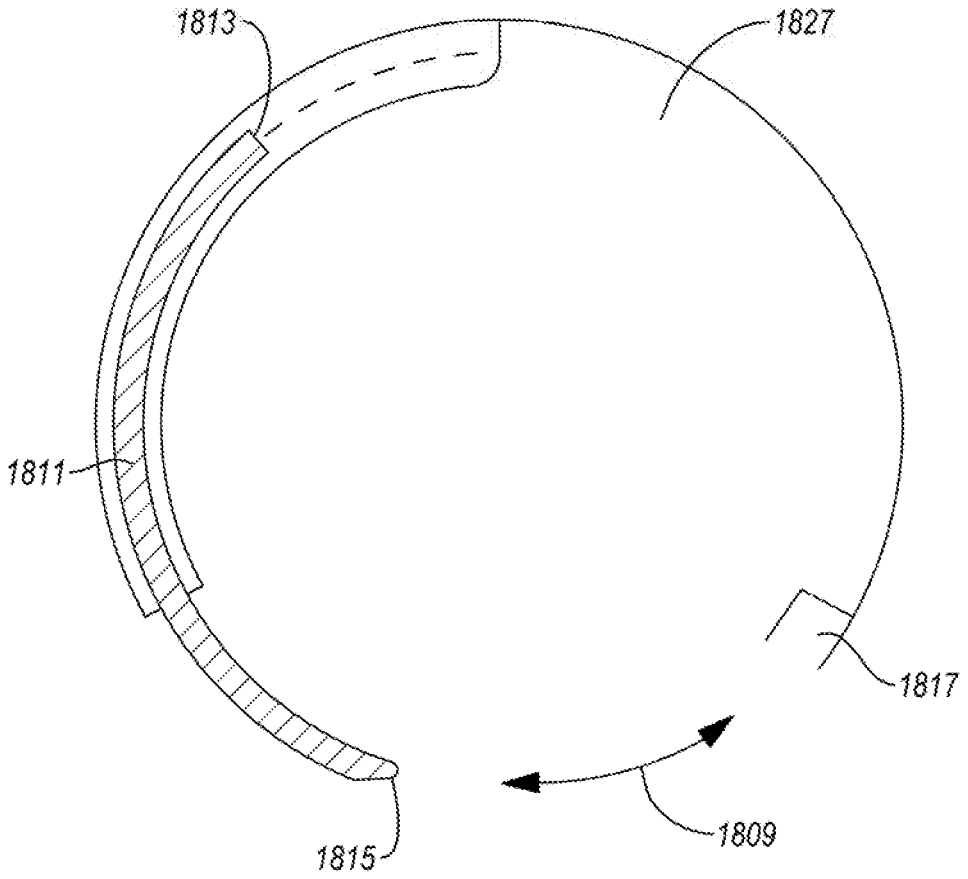
FIG. 18D illustrates a cross-sectional view of the mixing apparatus of FIG. 18A similar to FIG. 18C but in a partially open configuration, according to an implementation of the present disclosure.
Figure 18E:
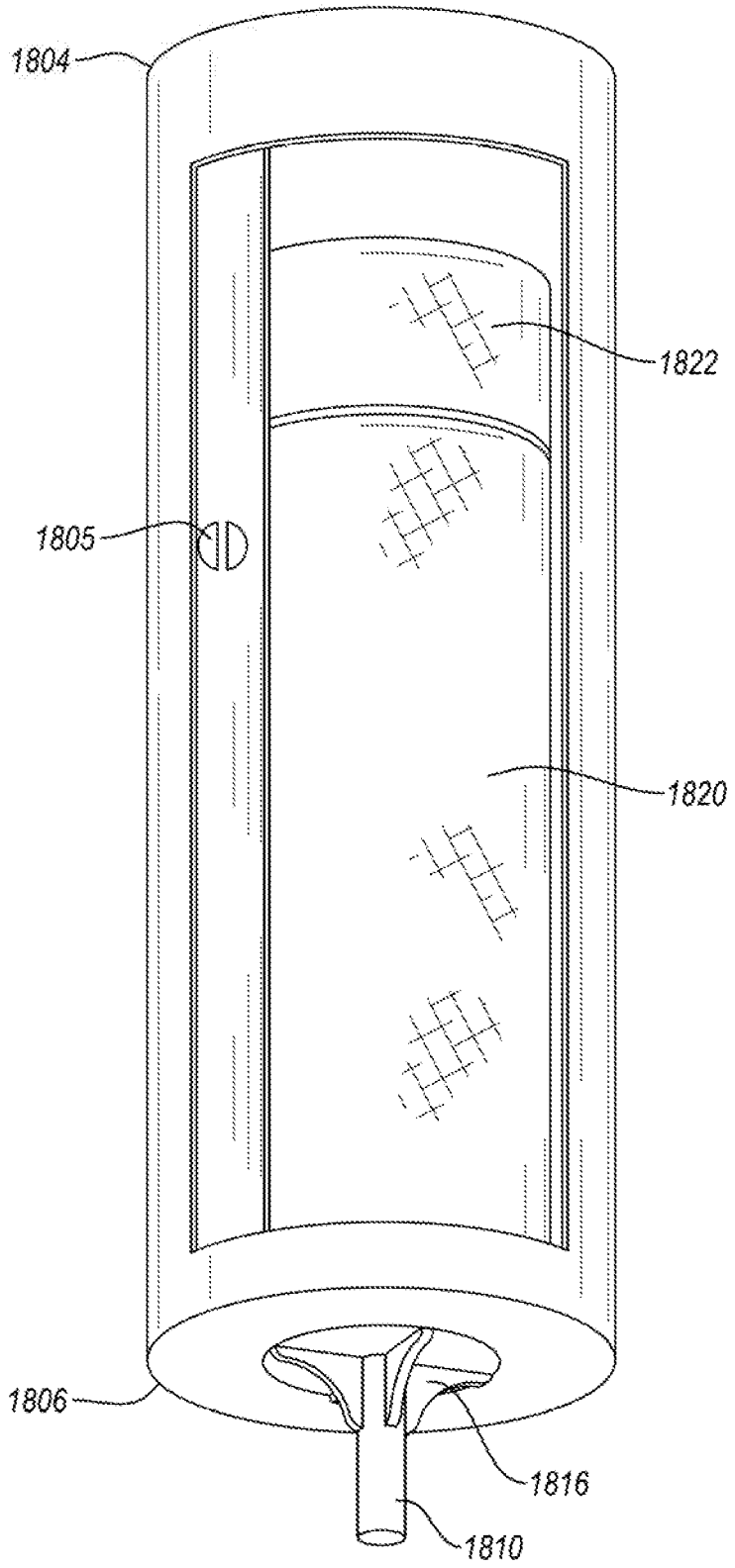
FIG. 18E illustrates a side perspective view of the mixing apparatus of FIG. 18A in an open configuration with a container, according to an implementation of the present disclosure.

Referring to FIGS. 18C and 18D, the closed first end 1804 includes an inner surface 1827. The door 1803 can move from a first position to a second position as indicated by arrow 1809. The door 1803 is arranged at least partially and optionally within an interior channel 1811. The door 1803 has first end 1813 extending to a second end 1815. The main body 1802 and/or door also has a locking mechanism 1817, e.g., tab or other protrusion, configured to releasably lock at least a second end 1815 of the door in closed position. The tap or protrusion can releasably extend and releasably couple a portion of the second end to an interior portion of the main body with a recess and/or another protrusion. Optionally and/or alternatively, a retaining strap as described herein can be utilized to further secure the apparatus.

Figure 19A:
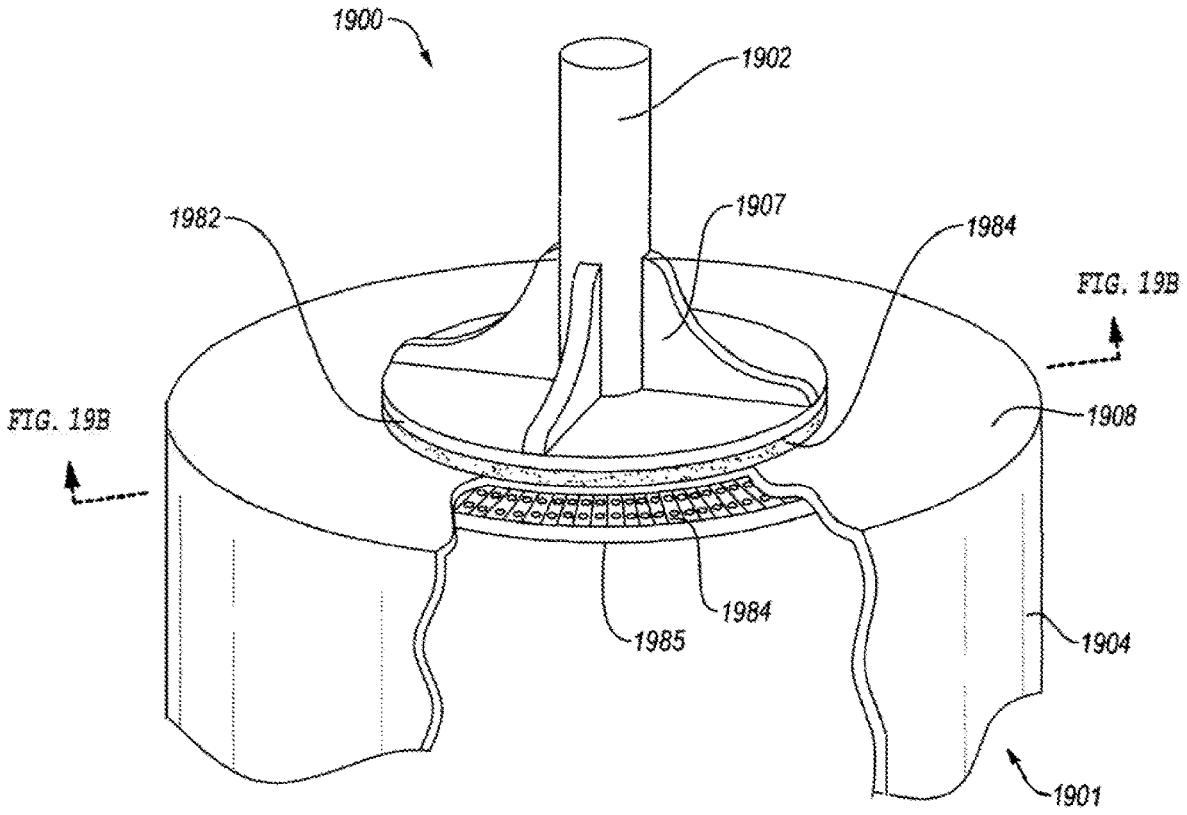
FIG. 19A illustrates a bottom perspective partial cross-sectional view of a mixing apparatus according to an implementation of the present disclosure.
Figure 19B:
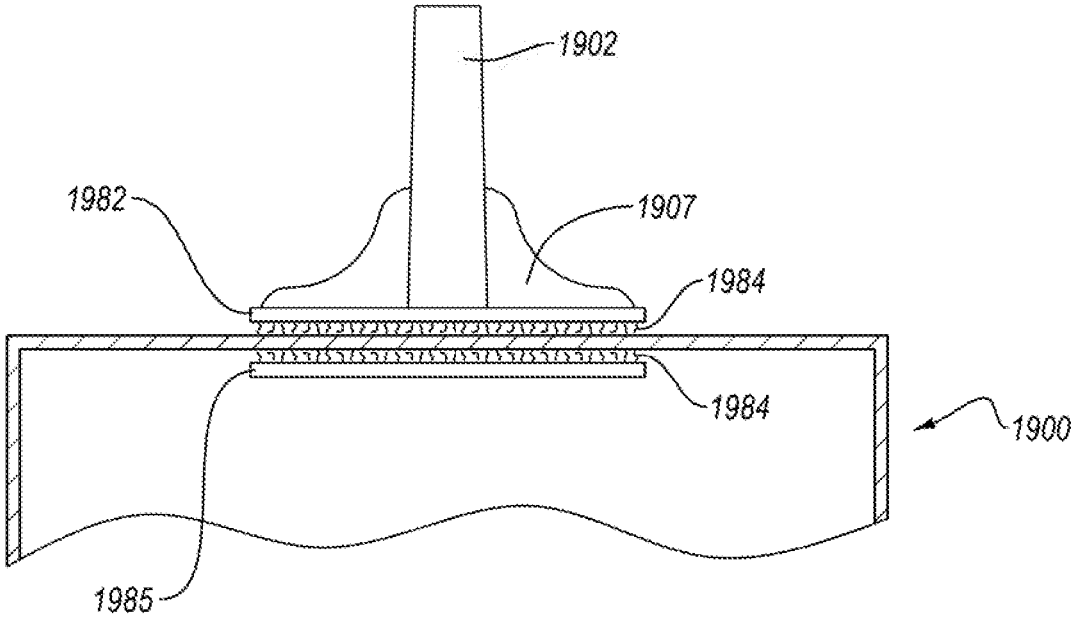
FIG. 19B illustrates a cross-sectional view along line 19B-19B in FIG. 19A of a mixing apparatus according to an implementation of the present disclosure.

FIG. 19A illustrates a bottom perspective partial cross-sectional view of a mixing apparatus according to an implementation of the present disclosure. FIG. 19B illustrates a cross-sectional view along line A to A' of a mixing apparatus according to an implementation of the present disclosure.

Referring to FIG. 19A-19B, a clutch 1900 is shown. The shaft 1902 is configured to be installed into a drill chuck and also configured as described herein. The drive shaft 1902 is molded into the lower clutch shaft. A side wall 1904 of the main apparatus 1901 is shown. A bottom 1908 of the apparatus includes a flat base. The bracing ribs 1907 molded into the bottom of the apparatus are configured to add strength to the bottom of the apparatus and shaft 1902 as described herein. The lower disc 1985 is located on the bottom outside of the apparatus. A friction clutch upper disc 1983 is located on the apparatus. An outer edge 1982 of the friction clutch disc and an inner friction surface 1984 of the face of the friction clutch disk is also shown. The base 1908 and drive shaft 1902 are designed with a safety friction clutch for the main apparatus 1904 for attaching into the chuck of a drill. The apparatus has a flat base 1908 that has a drive shaft 1902 that is molded separately from the main apparatus 1904 in order to be used as a friction clutch. The supporting ribs 1907 and drive shaft 1902 are integrated into the manufacturing process as a single unit. This clutch is designed with bracing ribs 1907 to add strength to the drive shaft. The inner clutch plate 1985 that is inside the main apparatus. The clutch plates, 1985 and 1982 are connected as a single piece that will rotate together at the same time in the same direction. As the drive shaft 1902 is spun in a drill the clutch 1985 and 1987 with the friction surface 1984 will grasp onto the main apparatus 1904 so it will spin. If the rotation of the drill becomes faster than required the friction surface of the clutch 1985 will slip against the main apparatus 1904 causing the main apparatus to slow down. The friction clutch will also fully disengage and slip if the user grabs onto the main apparatus while it is spinning to prevent injury. Alternatively, other clutch designs may be utilized.

Figure 20:
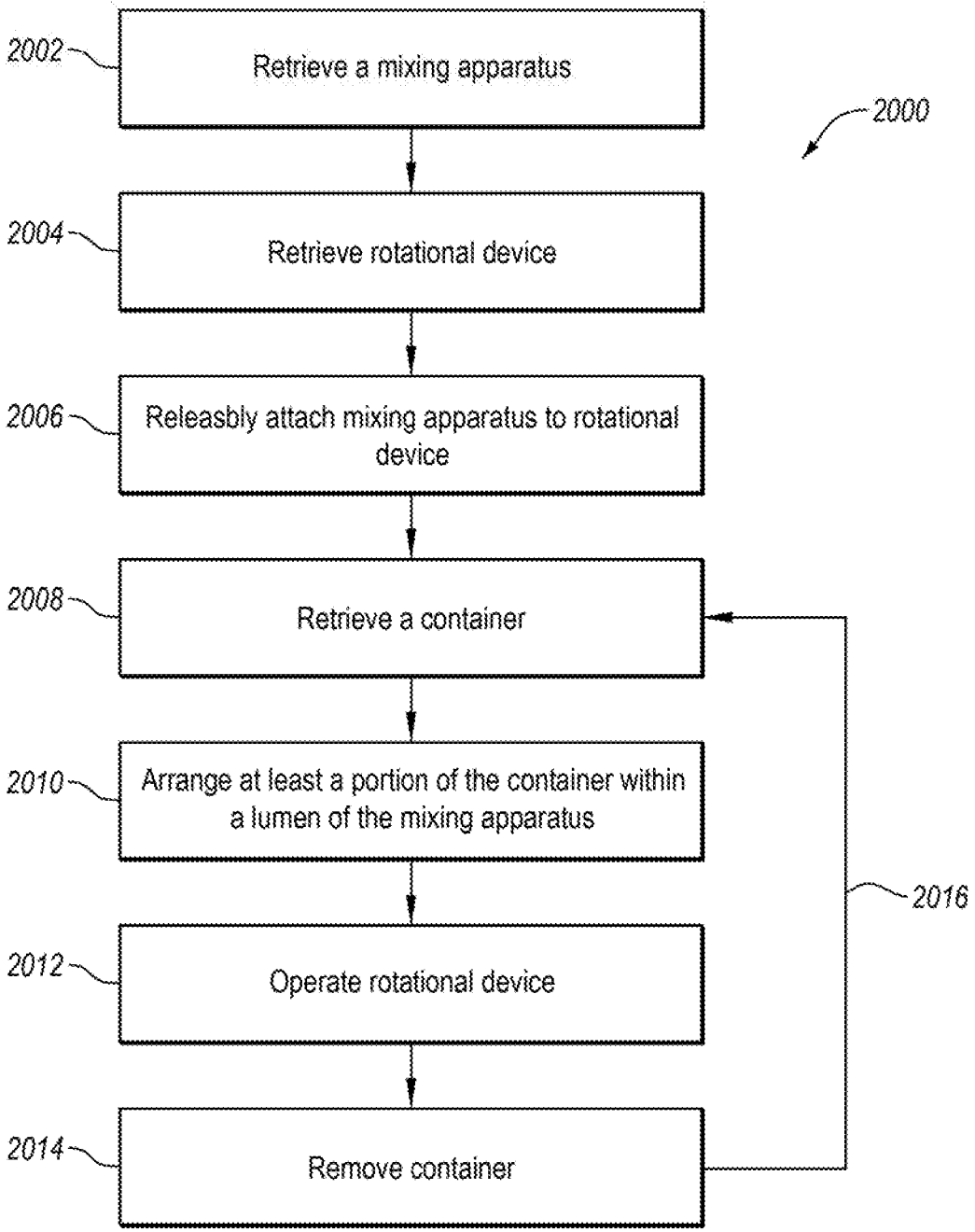
FIG. 20 illustrates a method of operating the mixing apparatus according to an implementation of the invention.

FIG. 20 illustrates a method of operating the mixing apparatus according to an implementation of the invention.

Referring to FIG. 20, the method is depicted with reference to number 2000 for mixing contents of a container. In this implementation, the method 2000 includes retrieving a mixing apparatus in step 2002. The mixing apparatus may include any mixing apparatus described herein and combinations of same. In step 2004, a rotational device is retrieved. In step 2008, the rotational device is releasably attached to the mixing apparatus. However, the rotational device and mixing apparatus may be one integral unit and not releasable attached.

In another implementation, in step 2008, a shaft from the mixing apparatus is inserted into a receiving portion of a rotational device. The receiving portion of the rotational device is a chuck or a specialized type of clamp configured to releasable releasably hold at least a portion of the shaft.

In another implementation, in step 2008, when using a mixing apparatus that does not include a shaft, e.g., as described with reference to FIGS. 16A-16C, a first end of a spindle is inserted into a receiving portion of a rotational device. Again, the receiving portion of the rotational device is a chuck or a specialized type of clamp configured to releasable hold at least a portion of the shaft. A second opposite end of the spindle is inserted into a receiving portion of a plate.

In step 2010, a container is arranged into a lumen or bore of the mixing apparatus. In this implementation, the container is arranged such that a base portion touches a bottom portion of the mixing apparatus. The container is not attached to the mixing apparatus as described herein.

Since the mixing apparatus and/or housing has no attachment mechanism or means for the container to couple or releasably attach the container to the housing, the container can rotate at a different rotational velocity as compared to the main body during operation for at least an amount of time. The container rotates as it is in contact with at least one of a portion of an inner wall or bottom of the mixing apparatus during operation. Frictional forces, centrifugal forces and/or other forces cause the container to rotate as the main body rotates. However, typically, the container rotates at a lower rotational velocity even after a startup time as compared to the main body. The startup time is about three seconds or less depending on the RPM of the rotation device. A lower RPM, e.g., 100 RPM or less, there may be no startup time and the container and main body rotate always at the same velocity. At a higher RPM, e.g., 1500 or greater, a startup time of about two seconds or less, e.g., five tenths of a second, the container and main body rotate at different velocities. In addition, an angle of rotation may also affect the startup time. The angle of rotation is described herein. In addition, when turning off the rotational device the container may continue to rotate even though the main body has stopped rotation.

In one implementation, since the container is not attached, secured, or coupled to the main body of the mixing apparatus or another portion of the mixing apparatus. There is also no mechanism to provide a compression force to secure or attach any portion of the container to the main body. The container can rotate freely in the main body; therefore, a user can stop or slow the rotation of the container by holding or cradling a portion of the container and the main body continues to rotate.

In one implementation, the rotation device is configured to rotate in a range from about 1 RPM to about 1500 RPM or greater. In one implementation, the RPM for mixing a typical aerosol can or paint container, is in a range from about 700 RPM to about 1300 RPM or greater.

Optionally, a user may rotate the main body about a central axis at an angle of rotation from about 0 degrees to about 360 degrees. When using an angle of rotation from about 0 degrees to about 180 degrees a user does not need to cradle or hold any portion of the container. At about 0 degrees and about 180 degrees the central axis is substantially parallel with a floor that a user is standing on.

A user can also rotate the main body from about 180 degrees to about 360 degrees while cradling at least a portion of the container during operation with a user's hand in order to prevent the container from falling out of the lumen due to gravity. In this implementation, a user will start operation (step 2012) of the rotational device while simultaneously cradling or holding a portion of the container to prevent it from falling out of the lumen. The container can move along the central axis as controlled by the user; this movement can occur during rotation of the main body or not during rotation of the main body.

In a preferred embodiment, the angle of rotation is about 25 degrees to about 35 degrees or 155 degrees to about 165 degrees as it allows the container to be in substantially constant contact with a wall and bottom of the mixing apparatus.

Optionally and/or alternatively, the rotation device may be not hand held, but is fixed position and stationary position that does not require a user to hold the rotation device. The rotational device is also at a fixed rotational angle or variable rotational angle. This type of rotational device allows for hands free operation. Moreover, during operation multiple containers can be utilized with or without turning off the rotational device during operation. By way of illustrative implementation, a first container is added to a mixing apparatus at about a 90 degree angle with a fixed rotation device. The rotation device is activated for a first period of the time. The user can remove the first container without turning off the rotational device and then add a second rotational device and repeat any number of times. A fixed rotational device also permits longer period of mixing to avoid user fatigue.

In step 2012 a user can operate the rotation device, e.g., drill, in a clock-wise or counter clock-wise rotation. After a predetermined time, the container is removed in step 2014. During step 2014 the rotational device rotating the main body may still be in operation, may be slowed to a predetermined RPM, or turned off. Optionally, in step 2016, the process is repeated.

Particular example implementations of the subject matter have been described. As will be apparent to those skilled in the art, other implementations, alterations, and permutations of the particular implementations are considered to be within the scope of the disclosure and the following claims. Features of the various implementations are also combinable. While operations are depicted in the drawings or claims in a particular order, this should not be understood as requiring that such operations be performed in the particular order shown or in sequential order, or that all illustrated operations be performed (some operations may be considered optional), to achieve desirable results.

While this disclosure contains many specific implementation details, these should not be construed as limitations on the scope of any invention or on the scope of what may be claimed, but rather as descriptions of features that may be specific to particular implementations of particular inventions. Certain features that are described in the context of separate implementations can also be implemented, in combination, in a single implementation.

Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Accordingly, the previously described example implementations do not necessarily define or constrain this disclosure. Other changes, substitutions, and alterations are also possible within the scope of this disclosure.

To avoid unnecessarily obscuring the present disclosure, the preceding description may omit a number of known structures and devices. This omission is not to be construed as a limitation of the scopes of the claims. Specific details are set forth to provide an understanding of the present disclosure. It should however be appreciated that the present disclosure may be practiced in a variety of ways beyond the specific detail set forth herein.

Also, while the flowcharts have been discussed and illustrated in relation to a particular sequence of events, it should be appreciated that changes, additions, and omissions to this sequence can occur without materially affecting the operation of the disclosed embodiments, configuration, and aspects. A number of variations and modifications of the disclosure can be used. It would be possible to provide for some features of the disclosure without providing others.

Moreover, though the description has included a description of one or more aspects, implementations, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A method of using a mixing apparatus for mixing contents of a container, comprising the steps of:

providing a mixing apparatus having a main body having an open first end, a closed second end, and a longitudinally extending bore extending from the open first end to the closed second end, wherein the longitudinally extending bore is configured to receive at least a portion of the container, wherein the container is not attached to any portion of the main body and the container is configured to rotate freely and independently of the main body during an operation of a rotational device, and a shaft extending from the closed second end and the shaft is orientated orthogonally from the closed second end; and attaching a portion of the shaft to the rotational device;

arranging a portion of the container into the longitudinally extending bore of the main body; and operating the rotational device to rotate the main body and the container, wherein the main body rotates at a first angular velocity during a first period time of operation of the rotational device and the container rotates at a second angular velocity during the first period of time wherein the first angular velocity is greater than the second angular velocity of the container for at least a portion of the first period of time.

2. The method of claim 1, wherein the container is an aerosol can.

3. The method of claim 1, wherein the longitudinally extending bore of the main body has a height extending from the closed second end to the open first end that is less than the height of the container.

4. The method of claim 3, wherein the height of the longitudinally extending bore extending from the closed second end is in a range from about 10 mm to about 150 mm or greater.

5. The method of claim 3, wherein the main body has an inside diameter that is greater than an outside diameter of the container.

6. The method of claim 3, wherein the operating the rotational device step comprising operating the rotational device at revolutions per minute (RPM) in a range from about 100 RPM to about 2000 RPM or greater.

7. The method of claim 3, wherein the main body comprises an orange color.

8. A method of mixing an aerosol container with a mixing apparatus, comprising the steps of:

providing a mixing apparatus with a main body including an open first end, a closed second end, a wall extending circumferentially from the first end to the second end, an opening or bore extending from the open first end to the closed second end and a shaft extending from the second end, wherein the bore has an inside diameter at the closed second end and an inside diameter of the bore at the open first end, wherein the inside diameter at the closed second end is less than the inside diameter at the open second end;

arranging the aerosol container within at least a portion of the opening or bore of the mixing apparatus, wherein at least one third or less of the aerosol container extends outside the bore of the main body, wherein the aerosol container is not attached to the main body with any type of attachment mechanism and the aerosol container is configured to rotate freely and independently of the main body during operation of a rotational device;

attaching the rotational device to at least a portion of the shaft wherein the rotational device is a drill with an attachment mechanism and the attaching step includes releasably attaching the attachment mechanism of the drill to the shaft; and operating the rotational device to rotate the main body about a central axis thereof via the shaft to mix contents of the aerosol container, wherein the main body rotates at a first angular velocity during a first period of time and the aerosol container rotates at a second angular velocity during the first period of time, and wherein the first angular velocity is greater than the second angular velocity of the aerosol container during the first period of time.

9. The method of claim 8, wherein a user can support a portion of the rotating aerosol container with at least a portion of the user's hand.

10. The method of claim 8, wherein the first period of time is about 5 seconds or less.

11. The method of claim 8, wherein the first period of time is about 10 seconds or less.

12. The method of claim 8, wherein the operating the rotational device to rotate the main body and mix contents of the aerosol container step comprises positioning the rotational device to an angle of operation of about 25 degrees to about 35 degrees formed between a surface of a floor a user is standing or sitting on and a central axis of the main body.

13. The method of claim 8, wherein the operation of the rotational device step comprising operating the rotational device at revolutions per minute (RPM) in a range from about 800 RPM to about 2000 RPM or greater.

14. The method of claim 8, wherein the main body comprises an orange color.

15. A method of using a mixing apparatus to mix contents of an aerosol container, comprising:

providing a mixing apparatus with a main body including an open first end having a first inside diameter, a closed second end having a second inside diameter, a bore extending from the open first end to the closed second end, and a radially symmetrical shaft unit extending from the main body in a direction opposite the bore;

arranging at least a portion of the aerosol container in the bore of the main body, wherein the aerosol container is not attached to the main body and the aerosol container is configured to rotate freely and independently of the main body during operation of a rotational device;

providing a drill with an attachment mechanism as the rotational device;

releasably attaching a portion of the shaft unit to the attachment mechanism of the drill; and operating the drill to rotate the main body and the aerosol container about a central axis of the main body at an angular velocity to mix the contents of the aerosol container.

16. The method of claim 15, wherein the main body comprises a color.

17. The method of claim 15, wherein the main body color comprises an orange color.

18. The method of claim 15, wherein the operating the rotational device to rotate the main body comprises rotating the main body at revolutions per minute (RPM) in a range from about 100 RPM to about 1500 RPM.

19. The method of claim 15, wherein the shaft comprises one or more supporting ribs attached to the main body.

20. The method of claim 15, wherein the first inside diameter is greater than the second inside diameter.

* * * * *